US009492037B2

(12) United States Patent
Kee et al.

(10) Patent No.: US 9,492,037 B2
(45) Date of Patent: Nov. 15, 2016

(54) HYBRID ENCLOSURE SYSTEM

(76) Inventors: Christopher M. Kee, Glendora, CA (US); Michael J. Guidos, Lake Arrowhead, CA (US); Michael H. Clark, Alta Loma, CA (US)

( * ) Notice: Subject to any disclaimer, the term of this patent is extended or adjusted under 35 U.S.C. 154(b) by 1636 days.

(21) Appl. No.: 12/910,740

(22) Filed: Oct. 22, 2010

(65) Prior Publication Data

US 2011/0094686 A1 Apr. 28, 2011

Related U.S. Application Data

(60) Provisional application No. 61/254,390, filed on Oct. 23, 2009.

(51) Int. Cl.
*A47K 3/00* (2006.01)
*A47K 3/30* (2006.01)
*A47K 3/34* (2006.01)

(52) U.S. Cl.
CPC .. *A47K 3/30* (2013.01); *A47K 3/34* (2013.01)

(58) Field of Classification Search
CPC ..... A47K 3/30; A47K 3/34; A47K 3/36; A47K 3/38
USPC ..... 4/557, 558, 607, 608
See application file for complete search history.

(56) References Cited

U.S. PATENT DOCUMENTS 1,656,410 A 1/1928 Baer et al.
1,781,692 A 11/1930 Lewis
1,854,443 A 4/1932 Barce
1,873,424 A 8/1932 Kerr et al.
2,394,667 A 2/1946 Dailey
2,610,367 A 9/1952 Nordahl
2,677,268 A 5/1954 Hobbs
D175,684 S * 9/1955 Kellogg ..... D23/305
2,761,150 A * 9/1956 Kellogg ..... 4/558
2,815,543 A 12/1957 Gates
2,897,515 A * 8/1959 Collins ..... 4/608
2,980,969 A 4/1961 Tinfow
3,037,555 A 6/1962 Kochanowski
3,102,581 A 9/1963 Kochanowski
3,335,784 A 8/1967 Risk et al.
3,418,666 A * 12/1968 Rockey ..... 4/608
3,422,464 A 1/1969 O'Brien
3,562,956 A 2/1971 Johnson, Jr.
3,744,827 A 7/1973 Cox
3,879,912 A 4/1975 Cox
3,942,197 A 3/1976 Sudmann et al.
4,014,377 A 3/1977 Kochanowski
4,014,378 A 3/1977 Kochanowski (Continued)

FOREIGN PATENT DOCUMENTS

GB 2182085 5/1987

OTHER PUBLICATIONS

Photos of rollers.

(Continued)

*Primary Examiner* — Huyen Le
(74) *Attorney, Agent, or Firm* — Patent Law Agency, LLC; Peter Ganjian

(57) ABSTRACT

A hybrid enclosure, comprising a flexible, lightweight cover coupled within a rigid frame and at least one rigid stile that functions to confine a space, with minimal structural encroachment into potential ingress and egress area of the space when fully open.

27 Claims, 57 Drawing Sheets

(56) References Cited

U.S. PATENT DOCUMENTS

| | | | | |
|---|---|---|---|---|
| 4,060,267 | A | 11/1977 | Monfardini | |
| 4,089,135 | A | 5/1978 | Beny et al. | |
| 4,115,900 | A | 9/1978 | Mihalcheon | |
| 4,152,789 | A | 5/1979 | Heath | |
| 4,193,500 | A * | 3/1980 | Scott | E05D 15/0634 16/105 |
| 4,256,164 | A | 3/1981 | Agcaoili | |
| 4,316,295 | A | 2/1982 | Whitney et al. | |
| 4,458,449 | A | 7/1984 | Breuer | |
| 4,473,911 | A | 10/1984 | Germain | |
| 4,480,862 | A | 11/1984 | Fleming | |
| 4,484,411 | A | 11/1984 | Rystad | |
| 4,653,127 | A | 3/1987 | Baus | |
| 4,671,026 | A | 6/1987 | Wissinger | |
| 4,769,862 | A | 9/1988 | Skrzelowski | |
| 4,807,312 | A | 2/1989 | Baus | |
| 4,882,795 | A | 11/1989 | Baus | |
| 4,901,380 | A | 2/1990 | Smith | |
| 5,083,822 | A | 1/1992 | Mangin et al. | |
| 5,103,531 | A | 4/1992 | Perrotta | |
| 5,311,707 | A | 5/1994 | LaRoche et al. | |
| 5,473,843 | A | 12/1995 | LaRoche et al. | |
| 5,622,017 | A | 4/1997 | Lynn et al. | |
| 5,657,581 | A | 8/1997 | Husting | |
| D397,928 | S | 9/1998 | Wise | |
| 5,852,837 | A | 12/1998 | Husting | |
| 5,860,264 | A | 1/1999 | Gephart et al. | |
| 5,906,403 | A | 5/1999 | Bestlet et al. | |
| 5,908,064 | A | 6/1999 | Bruce | |
| 6,006,375 | A | 12/1999 | Carr | |
| 6,023,794 | A | 2/2000 | Nein | |
| 6,023,889 | A | 2/2000 | Husting et al. | |
| 6,082,499 | A | 7/2000 | O'Donnell | |
| 6,094,757 | A | 8/2000 | Torres | |
| 6,109,666 | A | 8/2000 | Collet | |
| 6,182,738 | B1 * | 2/2001 | Chen | 160/199 |
| 6,216,287 | B1 | 4/2001 | Wise | |
| 6,470,511 | B1 | 10/2002 | Smale | |
| 6,491,326 | B1 | 12/2002 | Massey et al. | |
| 6,691,339 | B1 | 2/2004 | Thomas | |
| 6,698,037 | B2 | 3/2004 | Lippe | |
| 6,817,144 | B1 | 11/2004 | Tavivian | |
| 6,851,133 | B1 | 2/2005 | Nehring | |
| 6,990,695 | B2 | 1/2006 | Grayson | |
| 7,028,349 | B2 | 4/2006 | Helmetsie et al. | |
| 7,174,944 | B1 | 2/2007 | Guidos et al. | |
| 7,225,480 | B2 | 6/2007 | Mascheron | |
| 7,273,084 | B2 * | 9/2007 | Chen | 160/187 |
| 7,377,076 | B2 | 5/2008 | Shedd | |
| 7,591,492 | B2 | 9/2009 | Nikkhah | |
| 7,634,823 | B2 | 12/2009 | Sisk | |
| 7,694,358 | B2 | 4/2010 | Stimpson | |
| 7,735,795 | B2 | 6/2010 | Wronski | |
| 7,761,935 | B1 * | 7/2010 | Whitaker | 4/558 |
| 7,849,531 | B2 | 12/2010 | Rooke et al. | |
| 7,856,771 | B2 | 12/2010 | Guidos et al. | |
| 7,861,761 | B2 * | 1/2011 | Martineau | E06B 9/54 160/273.1 |
| 8,037,556 | B2 | 10/2011 | Lock et al. | |
| 8,069,506 | B2 | 12/2011 | Hammond | |
| 8,151,385 | B2 * | 4/2012 | Goskowski et al. | 4/610 |
| 2002/0157325 | A1 | 10/2002 | Domanico | |
| 2002/0163203 | A1 | 11/2002 | Donald | |
| 2003/0188379 | A1 | 10/2003 | Cowell et al. | |
| 2004/0003484 | A1 | 1/2004 | D'Assumcao | |
| 2005/0177936 | A1 | 8/2005 | Graells Pane | |
| 2008/0047057 | A1 | 2/2008 | Ho | |
| 2008/0202056 | A1 | 8/2008 | Jantzen | |
| 2008/0250558 | A1 | 10/2008 | Torres | |
| 2009/0038070 | A1 | 2/2009 | Belanger et al. | |
| 2009/0056077 | A1 | 3/2009 | Belanger et al. | |
| 2009/0211175 | A1 | 8/2009 | Guidos | |
| 2010/0147042 | A1 | 6/2010 | Chen | |
| 2010/0281612 | A1 | 11/2010 | Cook | |
| 2010/0293708 | A1 | 11/2010 | Hildebrandt | |
| 2011/0005140 | A1 | 1/2011 | Guidos et al. | |
| 2011/0083393 | A1 | 4/2011 | Guidos et al. | |
| 2011/0094686 | A1 | 4/2011 | Kee et al. | |
| 2011/0203046 | A1 | 8/2011 | Donnelly et al. | |
| 2011/0283624 | A1 | 11/2011 | Baer | |
| 2011/0291848 | A1 | 12/2011 | Burdenko | |
| 2012/0023658 | A1 | 2/2012 | Bobeck et al. | |
| 2012/0198655 | A1 | 8/2012 | Lapping | |

OTHER PUBLICATIONS

Photos of enclosures; the photos were taken on Jul. 6, 2011.
Photo of adjustable roller; http://cqyqgd.en.made-in-china.com/.
Photo of broken hinge roller.
Photo of garage door roller; Pub. 2006.
Photo of Roller-Hinge replacement.
USPTO: Office action and file history for case U.S. Appl. No. 12/831,199, filed Jul. 6, 2010; Office Action Date: Aug. 8, 2013.
http://www.raumplusna.com/air ; Sliding door system—AIR product list and system description, including accessories ; 2013.
http://www.contractorswardrobe.com/instructions_all.html ; Door Panel MODEL #5000-45-45; assembly and installation instructions.
mobilehomepartsstore.com ; Kinro Vinyl Sliding Patio Door; 2002-2012.
USPTO Office Action From U.S. Appl. No. 12/831,199, filed Jul. 6, 2010; Office action date: Mar. 27, 2014.
File History of U.S. Appl. No. 14/629,422, including Office actions May 6, 2015 and.
File History of U.S. Appl. No. 13/552,603; Filing Date: Jul. 18, 2012 ; Office Action Date: Mar. 28, 2016.

* cited by examiner

HYBRID ENCLOSURE SYSTEM

CROSS-REFERENCE TO RELATED APPLICATIONS

This application claims the benefit of priority of the co-pending U.S. Utility Provisional Patent Application No. 61/254,390, filed 23 Oct. 2009, the entire disclosures of which is expressly incorporated by reference in its entirety herein.

BACKGROUND OF THE INVENTION

Field of the Invention

This invention relates to enclosures, and more particularly, to a hybrid enclosure system that increases the volume of usable space, increases ingress into and egress out of the usable space, and reliably retains and confines water within a shower area (if used as a hybrid shower enclosure).

Description of Related Art

Traditionally, shower enclosures have consisted of either soft or rigid enclosures. The soft enclosures are primarily comprised of a shower curtain (a flexible cloth and/or plastic) in connection with a curtain rod and a sliding feature that allows the curtain to slide open/closed. The rigid enclosures are primarily comprised of glass or rigid plastic, usually using aluminum/plastic extrusions to hold various rigid glass panels together and made to retain water using silicone sealant.

Usage of conventional soft enclosures with shower curtains offers a very low cost option to enclose a shower area. One major drawback to the shower curtain construction is that they are very susceptible to leakage of water outside of the shower space because they cannot and do not reliably close-off the shower area completely. Of course, this is due in part to the well-known Bernoulli's principle, where an increase in the speed of the fluid occurs simultaneously with a decrease in pressure or a decrease in the fluid's potential energy. That is, water speeding out of the showerhead creates a lower pressure inside the shower space defined by the enclosed shower curtain, compared to the outside. This air pressure differential causes the outside higher air pressure to push the curtain enclosure towards the source and cause of the lower air pressure inside the shower space, which is the speeding water existing the showerhead. According, since nothing physically connects the side and or bottom edges of the curtain enclosure to the tub or wall(s) or some other physical structure, the curtain moves towards inside the shower space. In other words, when the bottom and or sides of the curtain remain loose (i.e., unattached), the loose curtain will be susceptible to moving away from the walls or the curb of the tub/shower due to the air pressure differential on either side of the curtain. This movement may even result in the curtain moving toward the user of the shower, with the curtain even sticking to the person's body. This movement of the curtain away from the walls or curb of the tub/shower creates an opening for the water to leak, and not remain within the confine of the shower space. With the curtain able to move in any direction before, during, and after a shower, water is easily allowed to pass into the non-shower space, resulting in creation of a slippery surface, which can lead to water damage. Some attempts have been made to improve problems associated with leakage of water, for example, by sewing magnets or weights into the bottom corner of the curtain so that the curtain can stay within the tub, but water continues to leak out through the lateral vertical sides of the curtain.

The drawback with the usage of conventional rigid enclosures with glass panels with in-line or pivot doors is that rigid enclosures limit access, and narrow ingress into and egress out of the shower space. Most often, rigid enclosures such as glass shower enclosures have portions of their assembly or structures encroach into the potential ingress/egress area of the shower. This is always the case with in-line shower enclosures or sliding door applications. In-line shower enclosure may include bypassing doors that slide and bypass one another or may include one fixed panel on one side with an operating sliding door on the other side that slides and bypasses the fixed panel. In most in-line shower enclosures, the sliding door(s) and or the fixed panel with the sliding door are made slightly larger than one-half the total access space of the shower area, which allows the structures to overlap so to prevent water leakage. However, the result of the overlap is that the access to the shower area is reduced to about less than 40 percent, with over half blocked by either the fixed panel and or the sliding doors due to the overlapping feature.

For pivot door applications, there is generally a door that rotates out from the closed position, most commonly outward away from the shower space and toward the inside of a room. In the recreational vehicle (RV) industry where bathroom areas are minimal, pivot doors are generally not used. In addition, in the RV industry, rigid-type shower enclosures such as glass are generally also not used due to their weight, which, if used, generally result in higher gasoline cost for the operation of the RV. Accordingly, in most instances, in-line enclosures are generally preferred over pivot door applications.

Recent trends in new designs for soft shower enclosures change the curtain rod design to allow the basic enclosure to extend beyond the shower space by a curved curtain rod. This recent trend in shower enclosure designs has encouraged the increase in usable shower space by extending the curtain beyond the traditional confines of the traditionally defined shower area. This type of improvement has been introduced into the market with a curved shower rod used in connection with soft enclosures, such as a shower curtain. As indicated above, one major drawback to the shower curtain construction with or without this curved improvement is that they continue to be very susceptible to leakage of water outside of the shower space. As for the rigid-type enclosures, since conventional glass panels are solid and flat, they cannot and do not extend beyond the traditional shower space, and remain confined therein. Therefore, they cannot and do not extend or increase the showering area or space.

Accordingly, in light of the current state of the art and the drawbacks to current shower enclosures mentioned above, a need exists for an enclosure system that would combine most of the beneficial features of the soft and rigid shower enclosures, but without their respective drawbacks. In addition, a need exists for a shower enclosure system that would further increase the usable shower space when fully closed, and increase access to and from the shower space when fully open.

BRIEF SUMMARY OF THE INVENTION

An exemplary aspect of the present invention provides a hybrid enclosure, comprising:

a flexible, lightweight cover coupled within a rigid frame and at least one rigid stile that functions to confine a space, with minimal structural encroachment into potential ingress and egress area of the space when fully open.

Another exemplary optional aspect of the present invention provides a hybrid enclosure, wherein:

the frame includes:

a sill;

a header;

a first jamb and a second jamb coupled between the sill and the header at a respective first and second distal ends of the sill and the header; and a soft enclosure that includes:

at least one flexible, lightweight cover having an upper and lower sides coupled respectively with header and sill, and a first and a second lateral ends coupled with one of the respective first jamb and second jamb, and at least one stile.

A further exemplary optional aspect of the present invention provides a hybrid enclosure, wherein:

the sill is coupled with a first structure.

Still a further exemplary optional aspect of the present invention provides a hybrid enclosure, wherein:

the sill has a length that extends longitudinally along a length of the first structure with which the sill is associated.

Another exemplary optional aspect of the present invention provides a hybrid enclosure, wherein:

the sill conforms to a contour of the first structure with which the sill is associated;

and the header is configured independent of the sill contour.

Yet another exemplary optional aspect of the present invention provides a hybrid enclosure, wherein:

the header is curved, extending beyond the contour of the first structure.

Still another exemplary optional aspect of the present invention provides a hybrid enclosure, wherein:

the stile has an axial length that varies longitudinally during an operation of the hybrid enclosure.

A further exemplary optional aspect of the present invention provides a hybrid enclosure, wherein:

while the stile articulates around the curved header at a top distal end of the stile, the stile is continuously and progressively contracted longitudinally along the axial length of the stile as the stile moves along a reciprocating path towards the first and second distal ends of the header and the sill, and is fully contracted at the first and second distal ends;

the stile is continuously and progressively extended longitudinally along the axial length of the stile as the stile moves along the reciprocating path towards an apex of the curved header, and is fully extended at the apex.

Still a further exemplary optional aspect of the present invention provides a hybrid enclosure, wherein:

the sill has one of a straight, a curved, and a combination of straight and curved configuration.

Another exemplary optional aspect of the present invention provides a hybrid enclosure, wherein:

the stile includes an extension element that moves longitudinally along the axial length of the stile to vary a reach of the stile in relation to the header and the sill as the stile moves along the reciprocating path, thereby varying the axial length of the stile to enable articulation of the stile along the curved header, and one of a straight, curved, and the combination of straight and curved configuration sill.

Yet another exemplary optional aspect of the present invention provides a hybrid enclosure, wherein:

stile includes a first housing at the top distal end of the stile, within which the extension element is housed and reciprocally moves to vary the axial length of the stile.

A further exemplary optional aspect of the present invention provides a hybrid enclosure, wherein:

the extension element is coupled with an articulation mechanism that houses a set of rollers that ride along a track of the header, with the articulation mechanism rotating about a longitudinal axis of the extension element to enable the stile to articulate around the curved header.

Still a further exemplary optional aspect of the present invention provides a hybrid enclosure, wherein:

an angle between a longitudinal axis of the stile and a horizontal plane of the first structure varies, while the longitudinal axis of the stile remains substantially perpendicular to a longitudinal axis of the header and sill.

Another exemplary optional aspect of the present invention provides a hybrid enclosure, wherein:

the longitudinal axis of the rigid stile is maintained substantially perpendicular in relation to the longitudinal axis of the sill by a L-shaped beam.

Yet another exemplary optional aspect of the present invention provides a hybrid enclosure, wherein:

the L-shaped beam has an integral span section that is coupled with a sill track, and an integral support section substantially perpendicular the span section that is inserted within the stile.

A further exemplary optional aspect of the present invention provides a hybrid enclosure, wherein:

the integral support section is housed within the stile at the bottom distal end of the stile, inserted along an axial length of the stile to maintain and support the weight of the stile; and the axial length of the span section is oriented parallel the axial length of the sill, and coupled with the sill track by a connection module having a set of wheels that ride along the sill track.

Still a further exemplary optional aspect of the present invention provides a hybrid enclosure, wherein:

the track of the header and the sill have a substantially circular cross-sectional profile that extends longitudinally along the length of the track and enables a set of concaved wheels to roll on the track and rotate about the axial length of the substantially circular track while moving transversally across the header and the sill, with a first concaved wheel and a second concaved wheel of the set of concaved wheels substantially oriented opposite, across the substantially circular track;

the track of the header and sill further include a second channel that extends longitudinally along the length of the track and enables a posturing mechanism to slide within the track while moving transversally across the header and the sill.

Another exemplary optional aspect of the present invention provides a hybrid enclosure, wherein:

the wheels are comprised of a ride surface that is concaved with lateral projections that hug the header and sill track profile, thereby preventing the wheels from disengaging the track.

Still another exemplary optional aspect of the present invention provides a hybrid enclosure, further comprising:

a posturing mechanism associated with the flexible cover to provide proper posture for the flexible cover during operation.

Yet another exemplary optional aspect of the present invention provides a hybrid enclosure, wherein:

the posturing mechanism includes:

horizontal reinforcement for horizontal posturing of the flexible cover;

lateral reinforcement elements for vertical posturing of the distal lateral ends of flexible cover.

A further exemplary optional aspect of the present invention provides a hybrid enclosure, wherein the flexible cover is coupled with the header and sill by a set of vertical reinforcement elements positioned along a horizontal span of the flexible cover, which further aid in the vertical posturing of the entire flexible cover.

Still a further exemplary optional aspect of the present invention provides a hybrid enclosure, wherein:

the lateral reinforcement elements of the cover are detachably coupled with one of the first and second wall jamb and the stile.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIG. 2 is an exemplary view that illustrates a disassembled, exploded view of the hybrid enclosure of FIGS. 1A-1 to 1E-4 with the separated parts to show the relationship and manner of assembly of the same in accordance with the present invention;

DETAILED DESCRIPTION OF THE INVENTION

Figures 1, 1A:
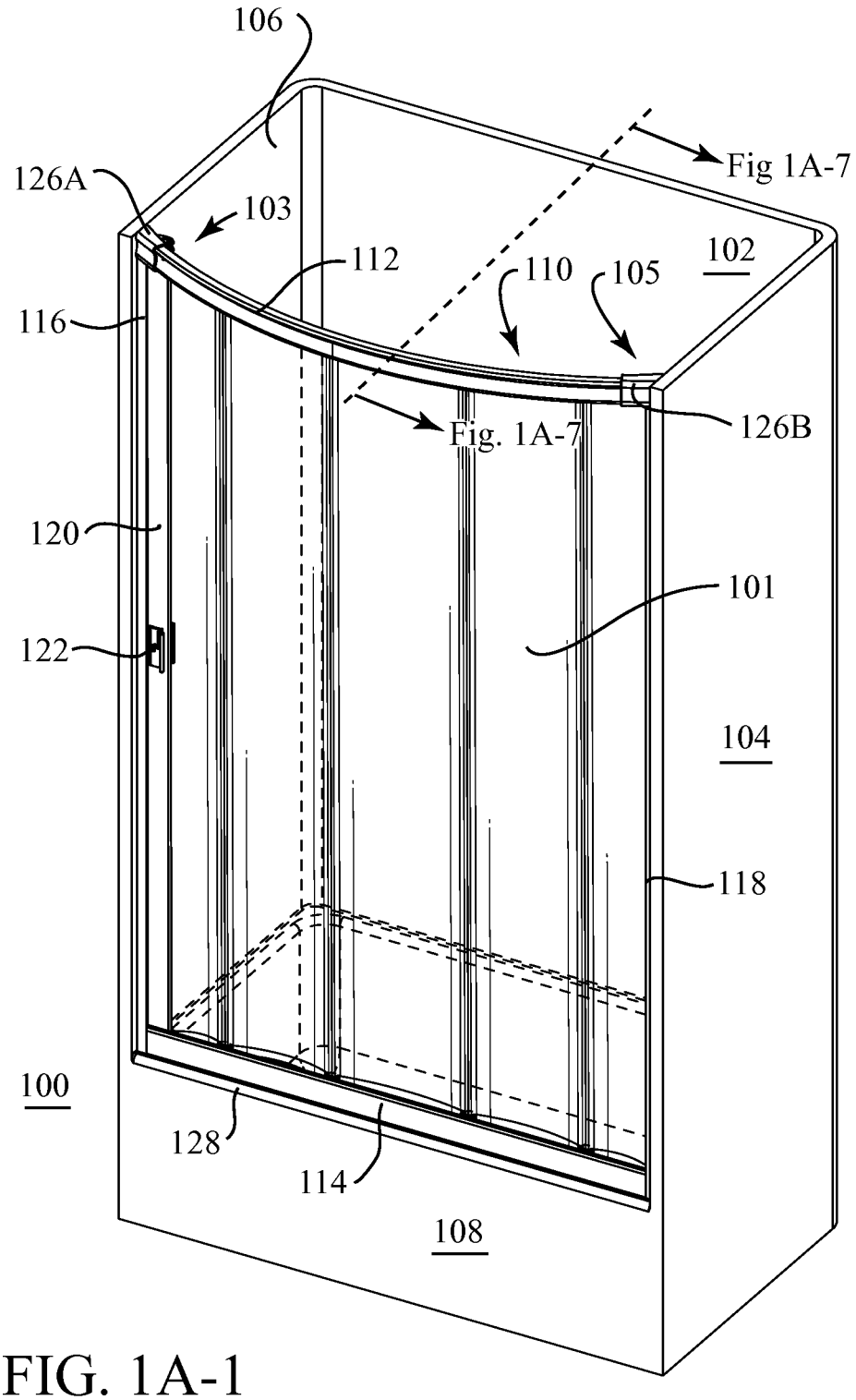
FIGS. 1A-1 to 1E-4 are exemplary illustrations of various views of a fully assembled hybrid enclosure system used in an exemplary shower area in accordance with the present invention.

The detailed description set forth below in connection with the appended drawings is intended as a description of presently preferred embodiments of the invention and is not intended to represent the only forms in which the present invention may be constructed and or utilized.

Throughout the disclosure, references to a shower, shower enclosure, shower space, shower area, or hybrid shower enclosure are meant as illustrative of a preferred embodiment and for convenience of example, only. That is, the use of the hybrid enclosure of the present invention should not be limited to enclosing a shower, shower space, shower area, or as a mere shower enclosure, or a hybrid shower enclosure but may also be used to enclose or close-off a space or an area other than a shower, shower area, or shower space, non-limiting example of which may include dividing and closing off a section of a room.

The present invention provides a hybrid enclosure system that combines most of the beneficial features of the soft and rigid enclosures, but without their respective drawbacks. In addition, the hybrid enclosure system of the present invention increases the usable enclosed space when fully closed, and increases access to and from the enclosed space when fully open.

FIGS. 1A-1 to 1E-4 are exemplary illustrations of various views of a fully assembled hybrid enclosure system used in an exemplary shower area in accordance with the present invention. FIGS. 1A-1 to 1E-4 progressively illustrate the articulation of the hybrid enclosure of the present invention in various corresponding views from a closed position (FIGS. 1A-1 to 1A-7) that closes-off ingress/egress to and from the shower area, to a fully open position (FIGS. 1E-1 to 1E-4). Accordingly, FIGS. 1A-1 to 1A-7 are various views of the fully assembled hybrid enclosure 100 of the present invention in a fully closed position in accordance with the present invention. FIGS. 1B-1 to 1B-3 are various views of the fully assembled hybrid enclosure 100 of the present invention when the hybrid enclosure is about quarter of a way open. FIGS. 1C-1 to 1C-5 are various views of the fully assembled hybrid enclosure 100 of the present invention when the hybrid enclosure is halfway open. FIGS. 1D-1 to 1D-3 are various views of the fully assembled hybrid enclosure 100 of the present invention when the hybrid enclosure is three-quarters-way open, and FIGS. 1E-1 to 1E-4 are various views of the fully assembled hybrid enclosure 100 of the present invention when the hybrid enclosure is fully open.

In particular, FIGS. 1A-1, 1B-1, 1C-1, 1D-1, and 1E-1 are perspective front views of the fully assembled hybrid enclosure 100 used for enclosing the illustrated shower area in accordance with the present invention. FIGS. 1A-1, 1B-1, 1C-1, 1D-1, and 1E-1 exemplarily illustrate from a perspective front view the progressive opening of the hybrid enclosure 100 from a fully closed position (FIG. 1A-1) to a fully open position (FIG. 1E-1) in relation to the entire shower area.

Figures 1, 1A, 2:
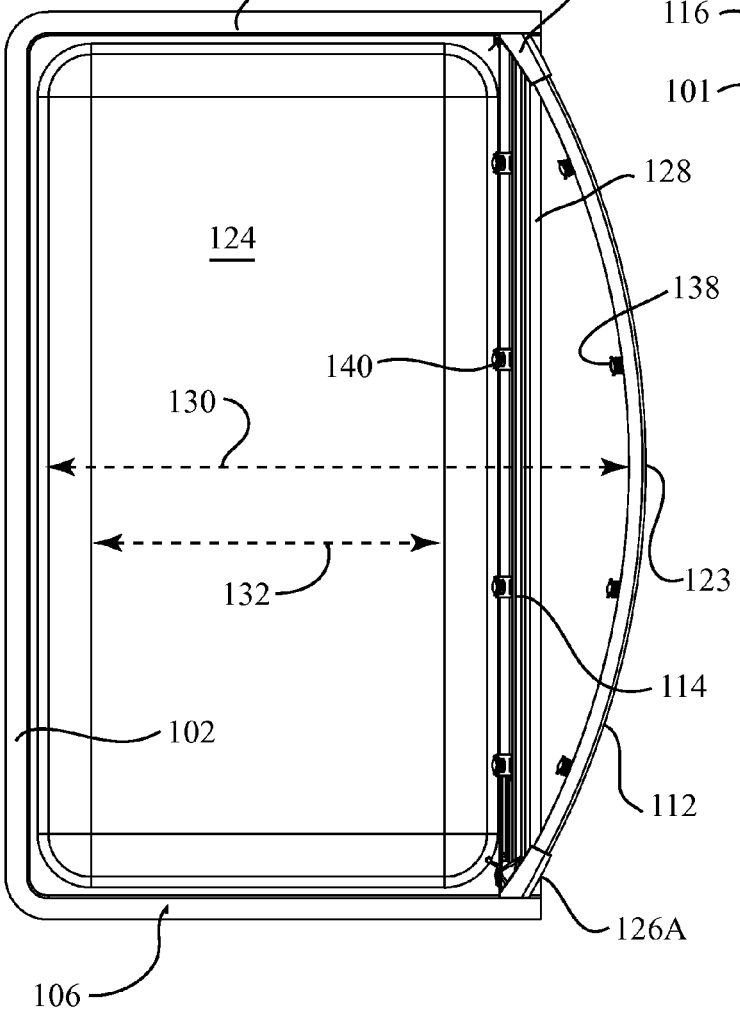
Figures 1, 1A, 2, 3:
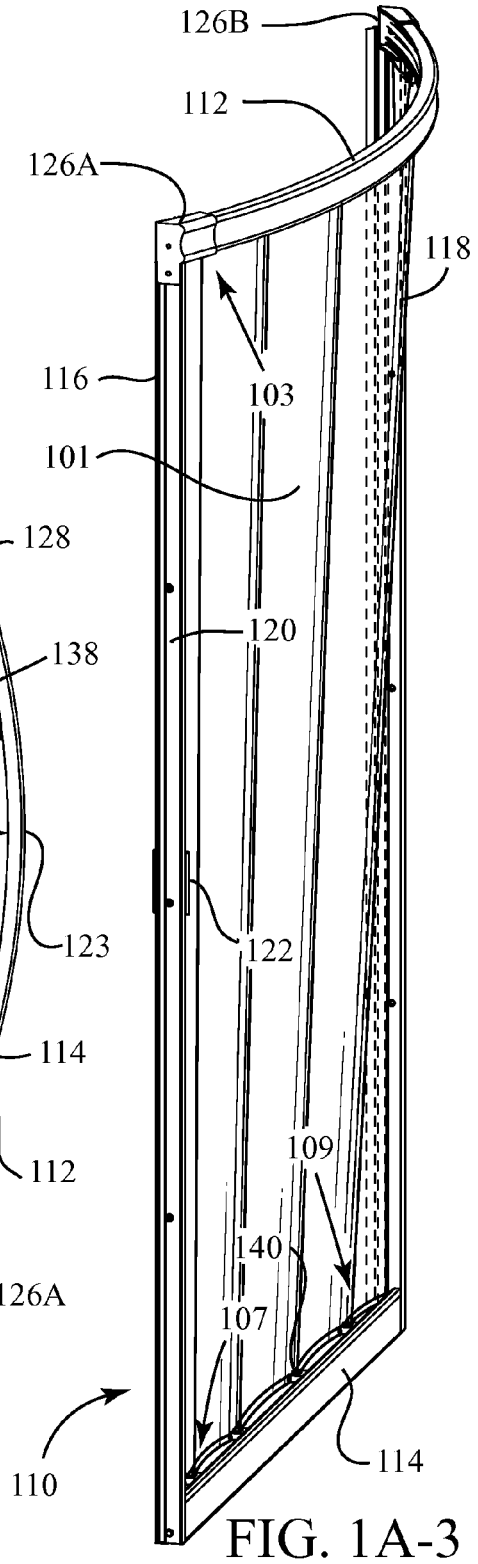
Figures 1, 1A, 2, 3, 4:
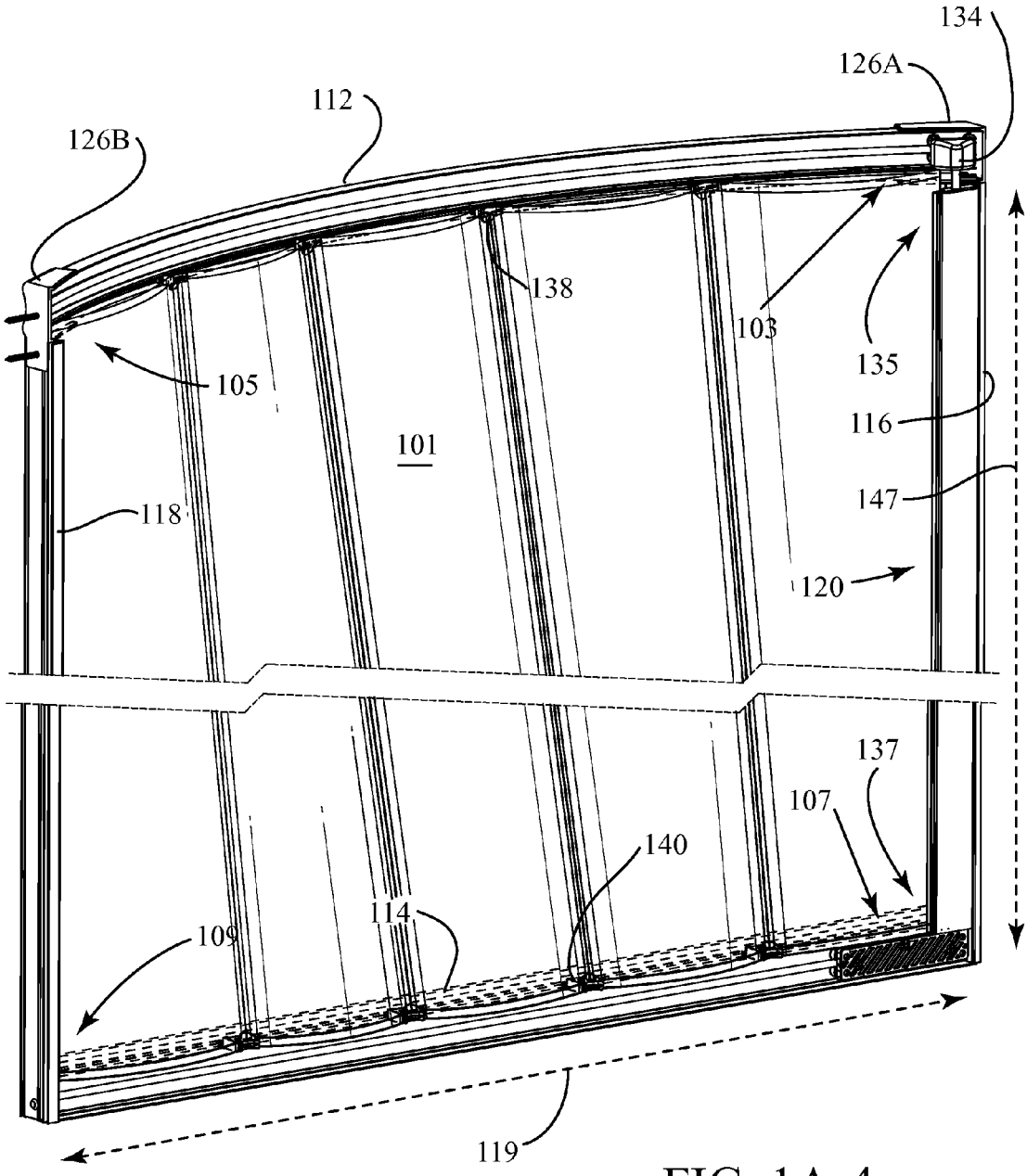
Figures 1, 1A, 2, 3, 4, 5:
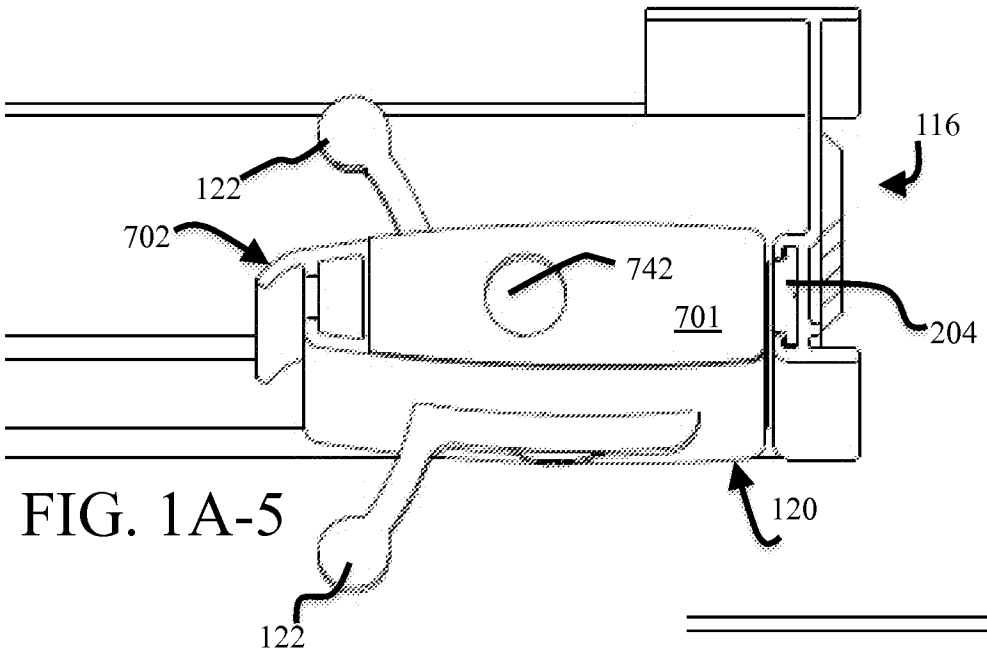
Figures 1, 1A, 2, 3, 4, 5, 6:
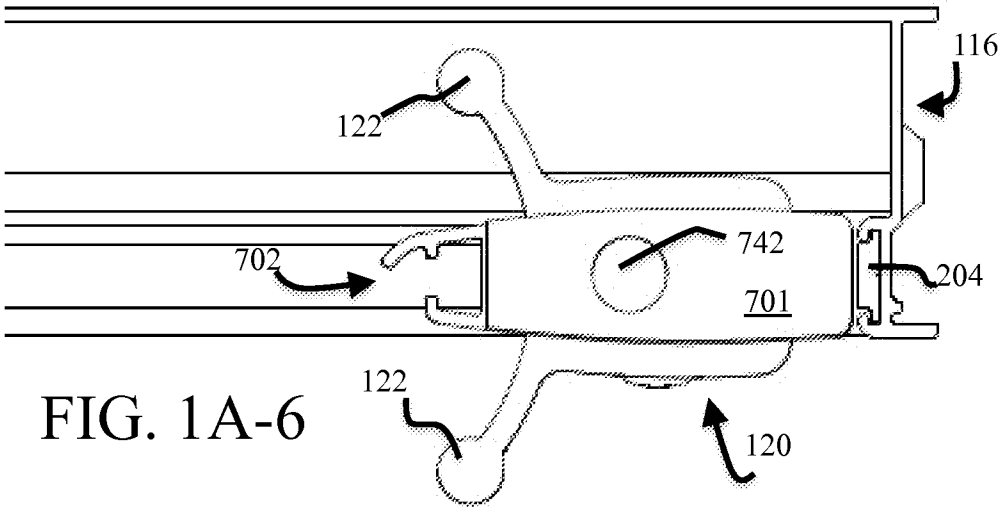
Figures 1, 1A, 2, 3, 4, 5, 6, 7:
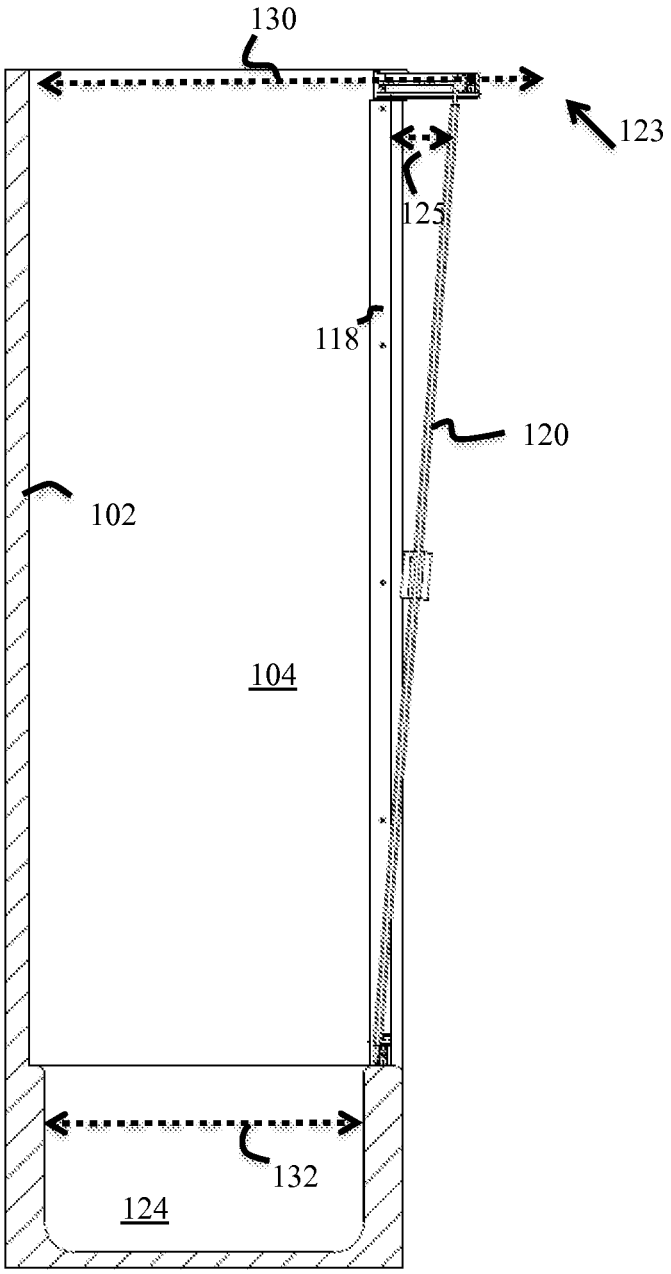
Figures 1, 1B:
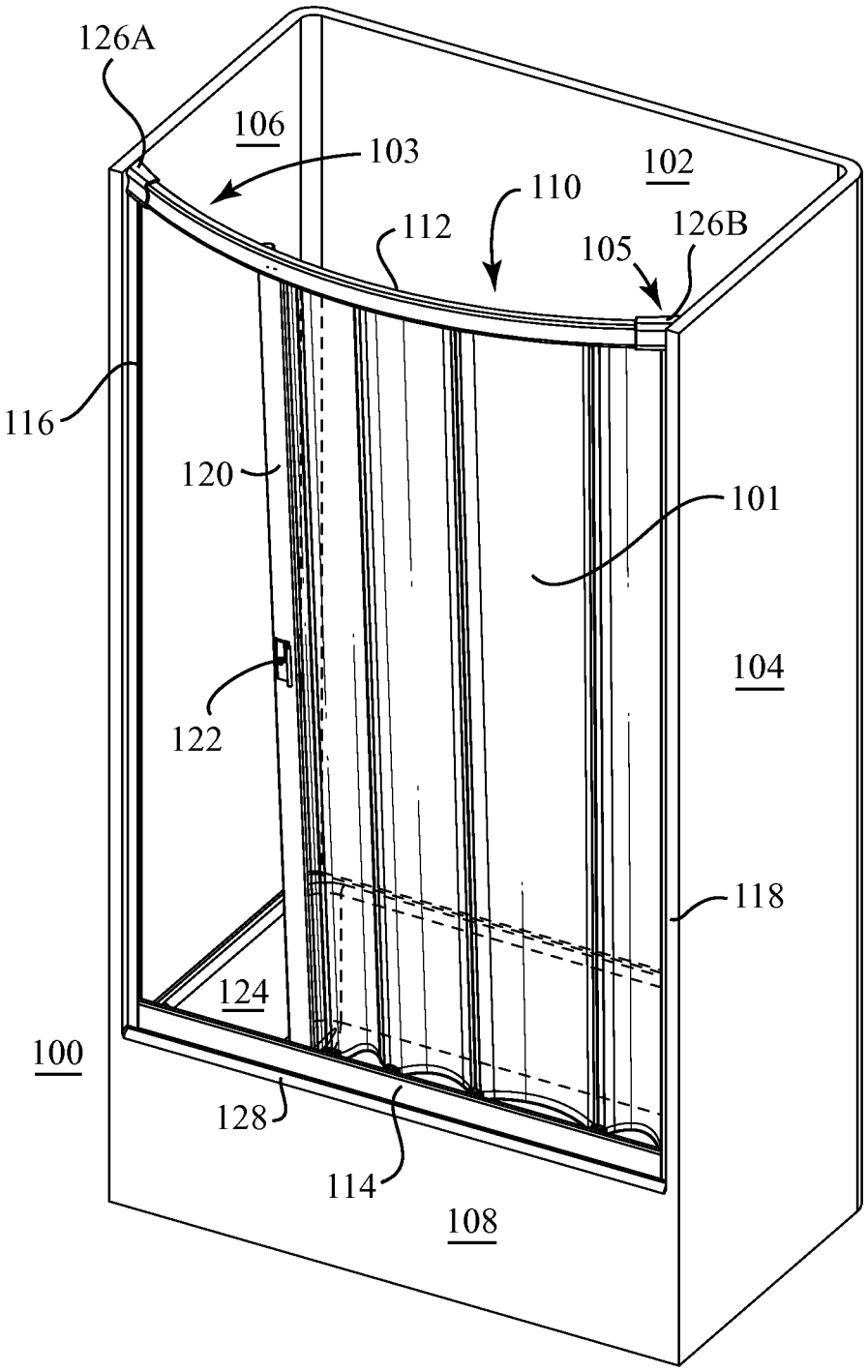
Figures 1, 1B, 2:
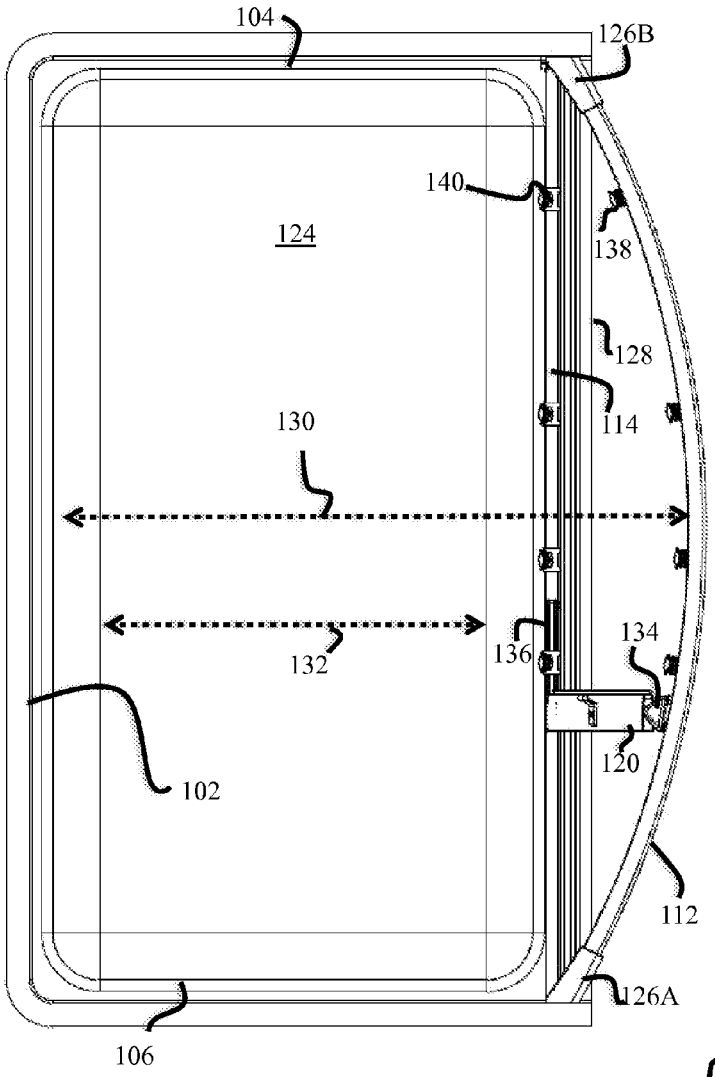
Figures 1, 1B, 2, 3:
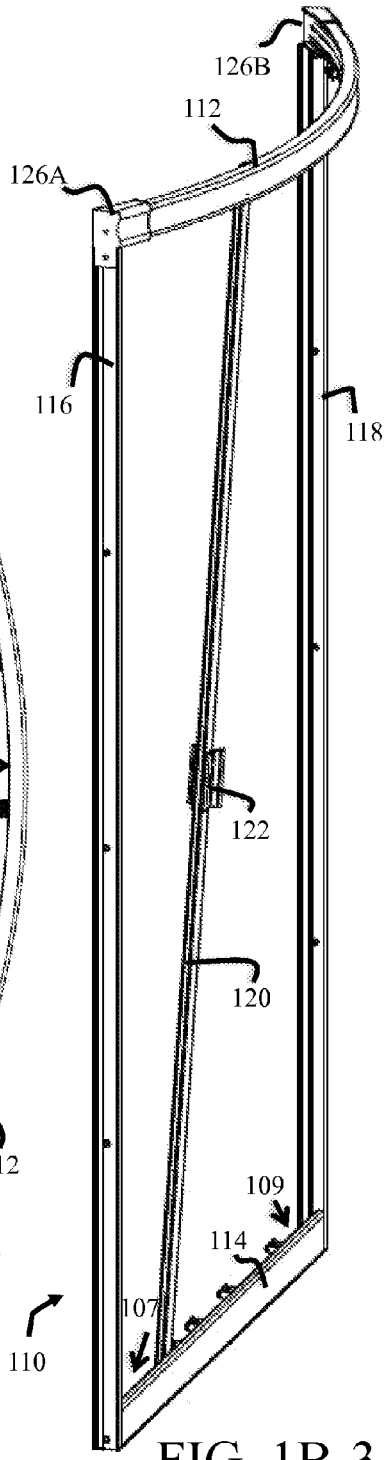
Figures 1, 1C:
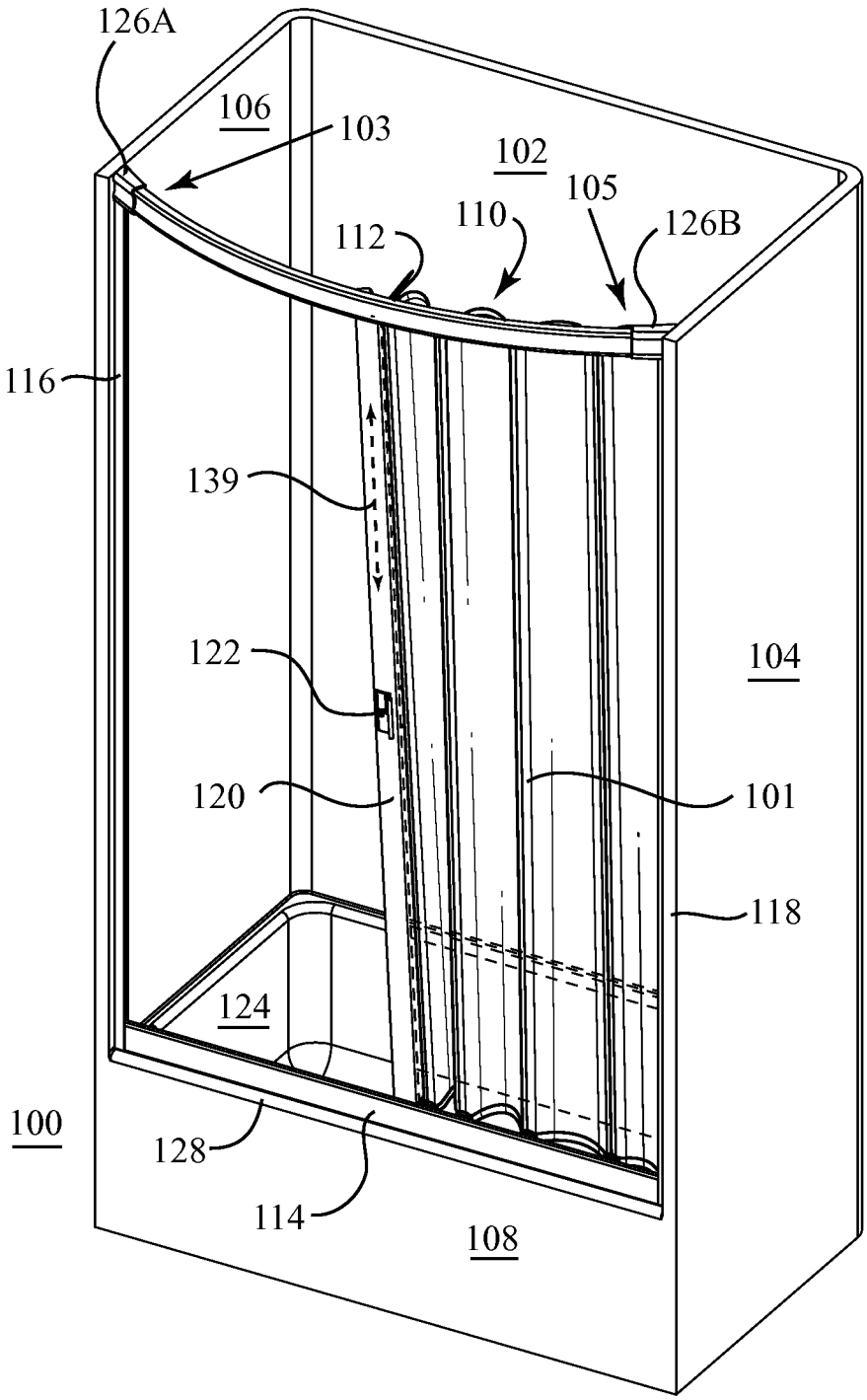
Figures 1, 1C, 2:
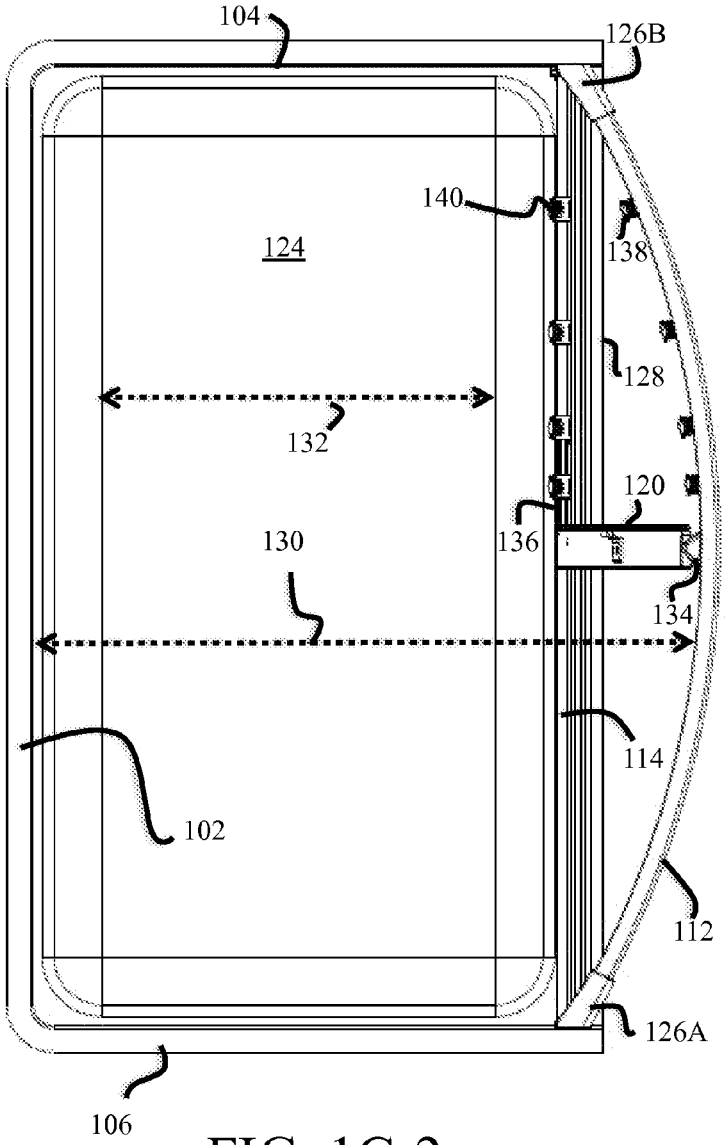
Figures 1, 1C, 2, 3:
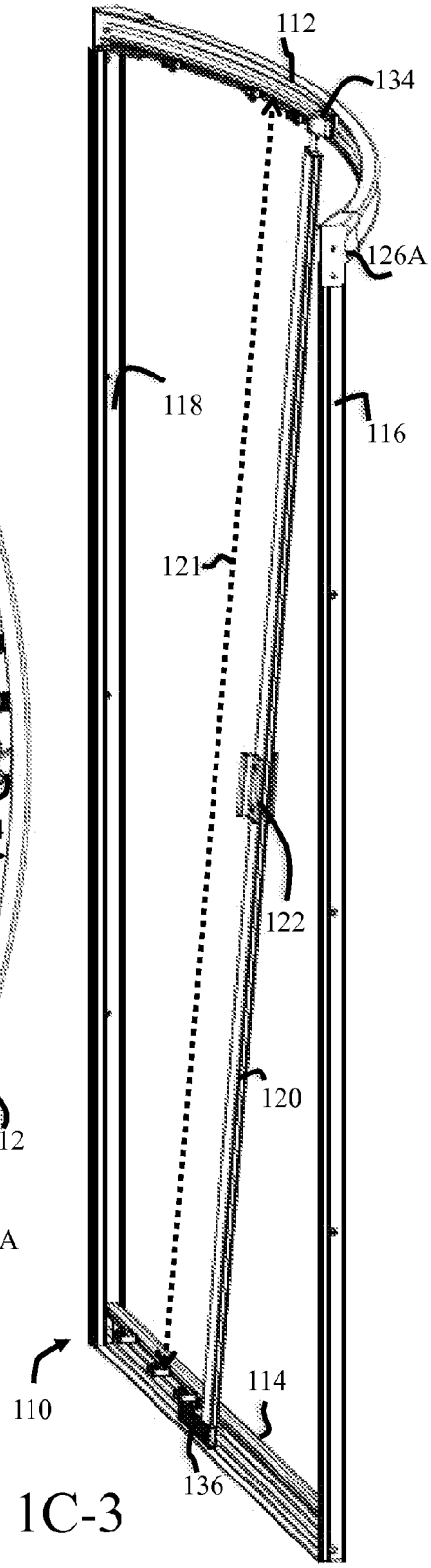
Figures 1, 1C, 2, 3, 4:
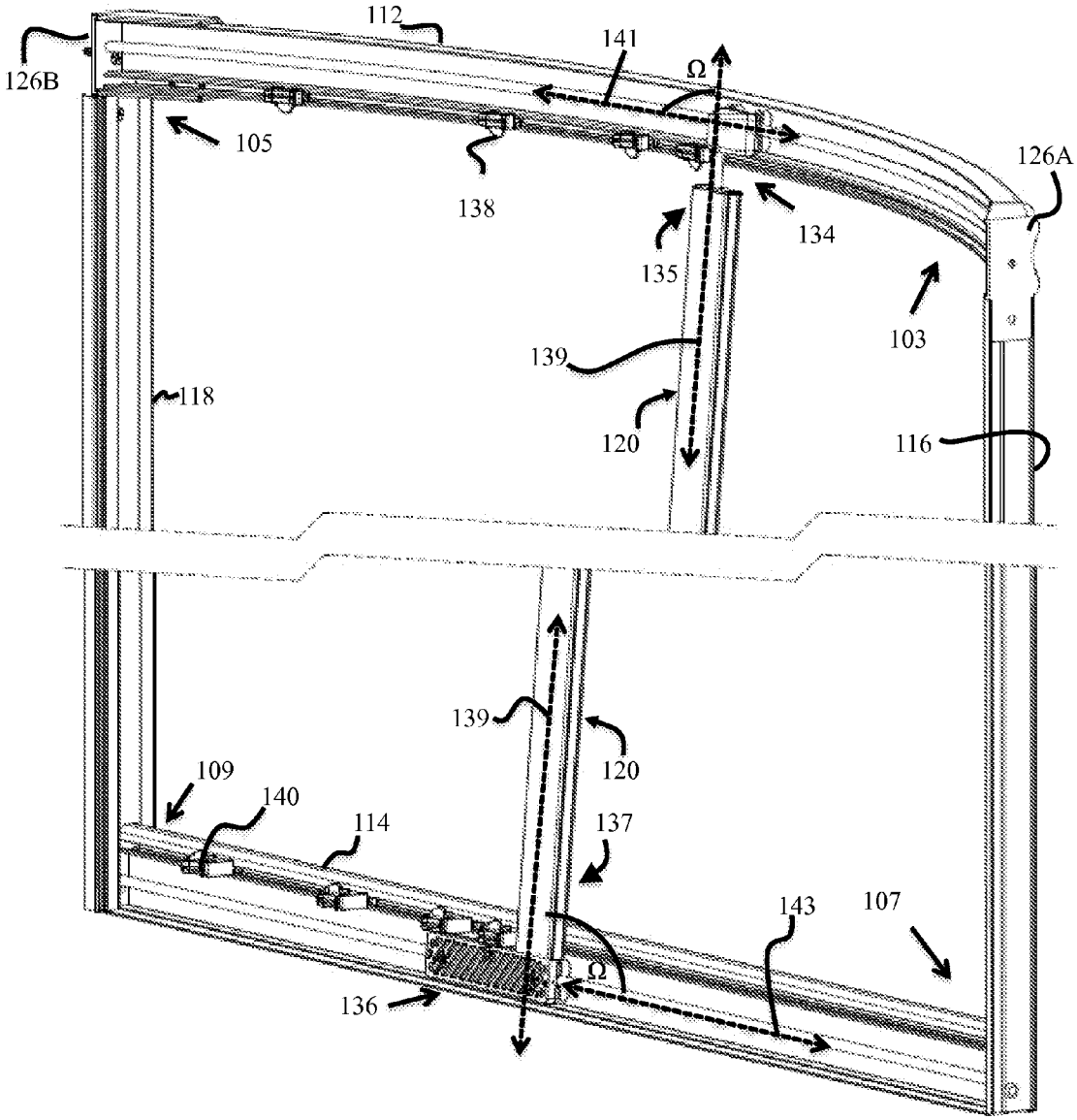
Figures 1, 1C, 2, 3, 4, 5:
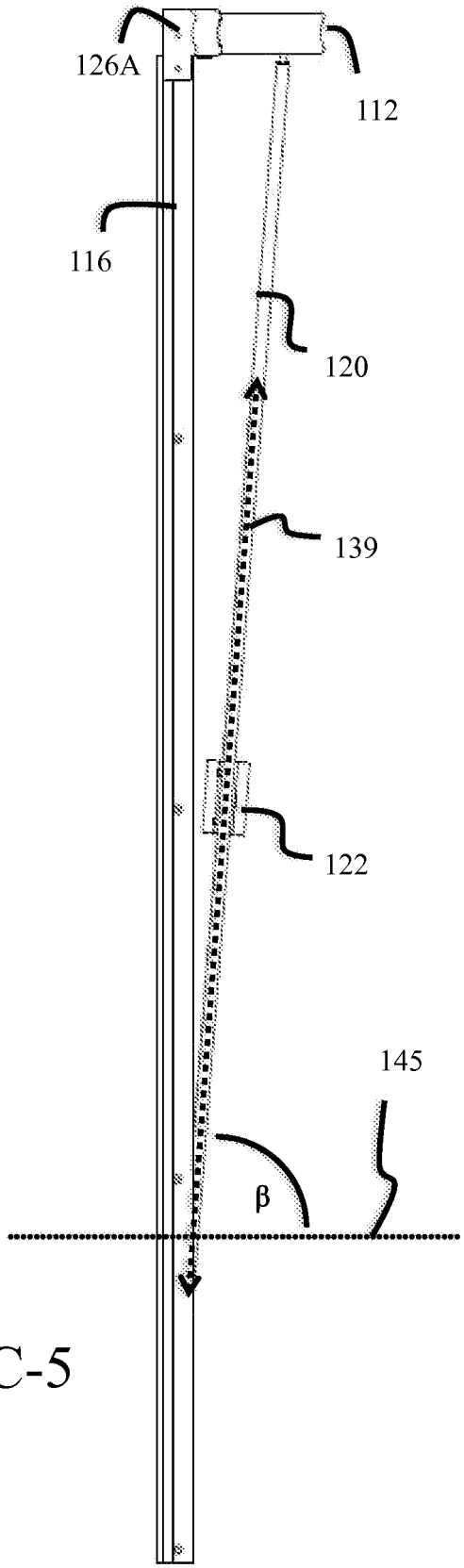
Figures 1, 1D:
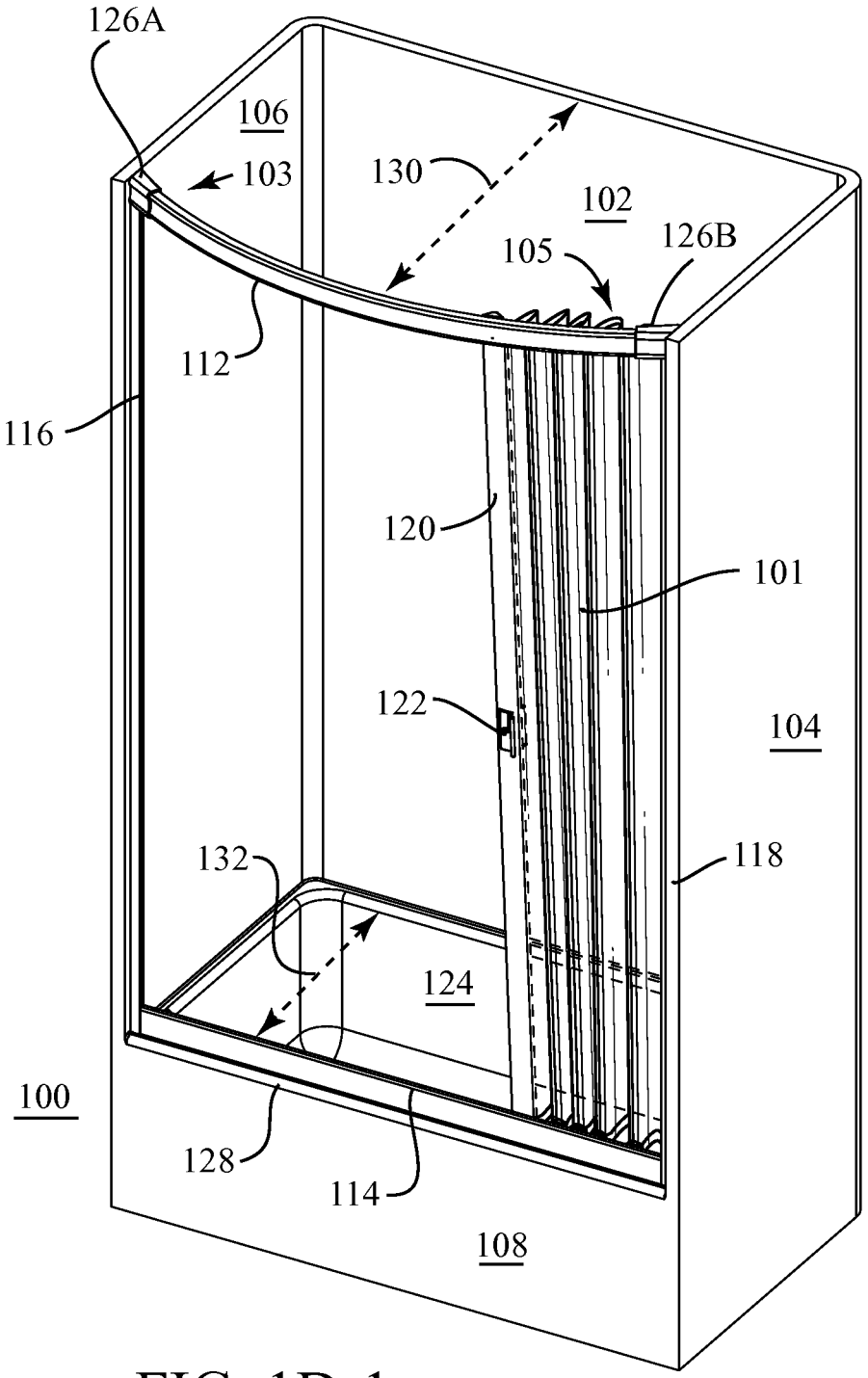
Figures 1, 1D, 2:
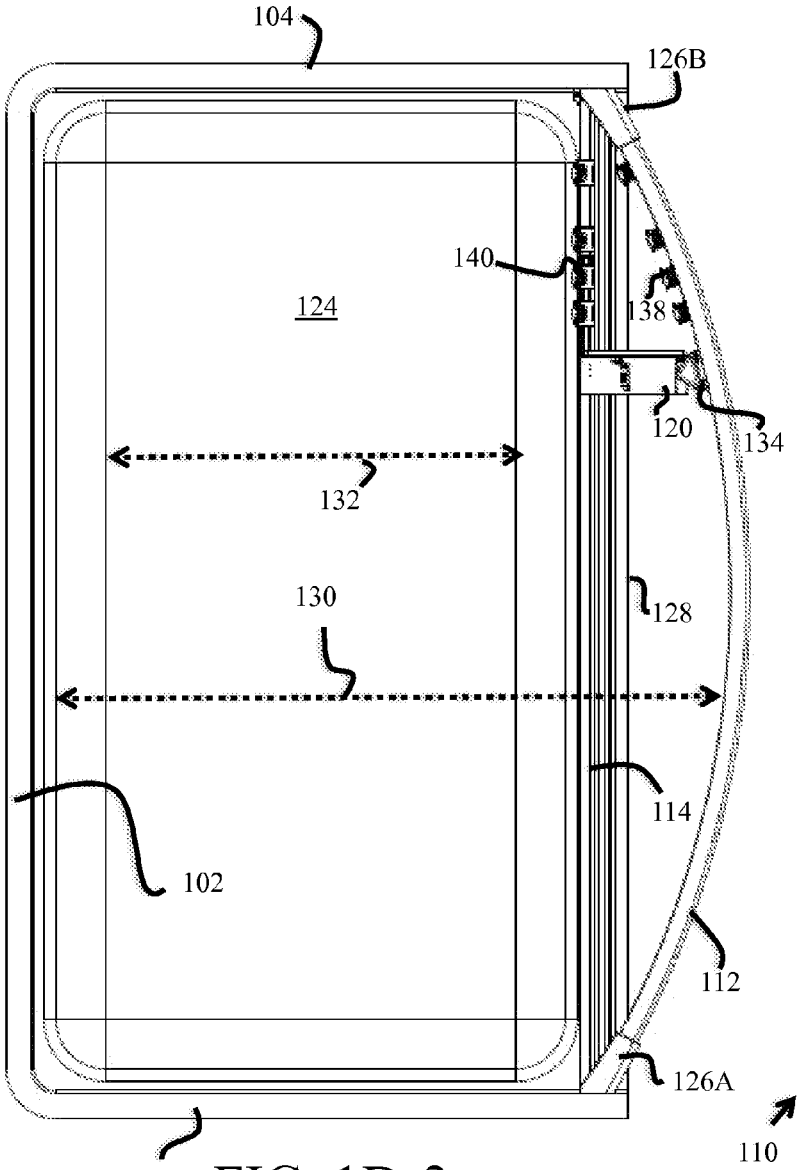
Figures 1, 1D, 2, 3:
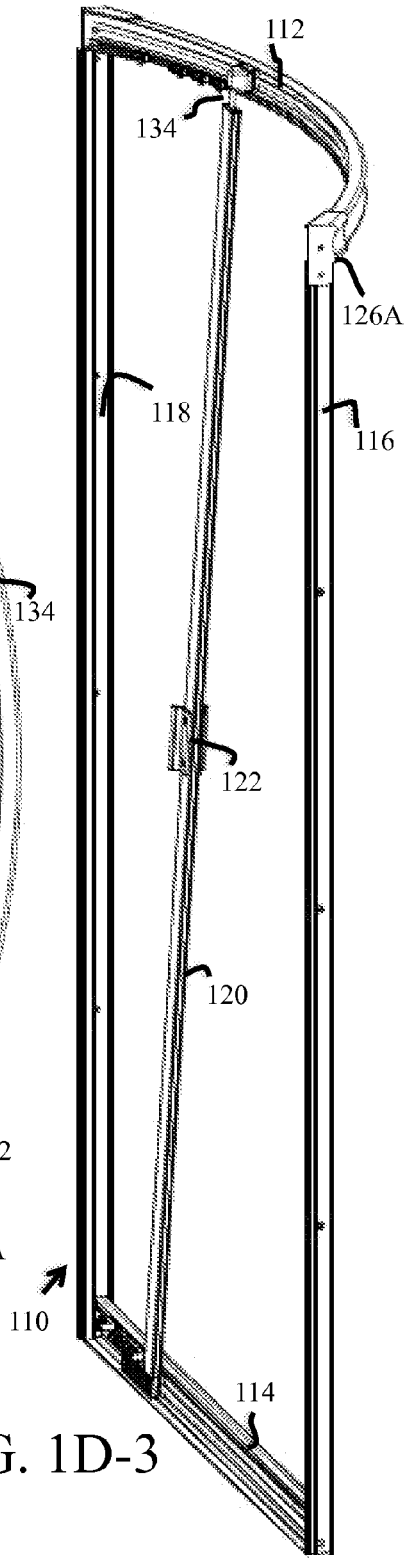
Figures 1, 1E:
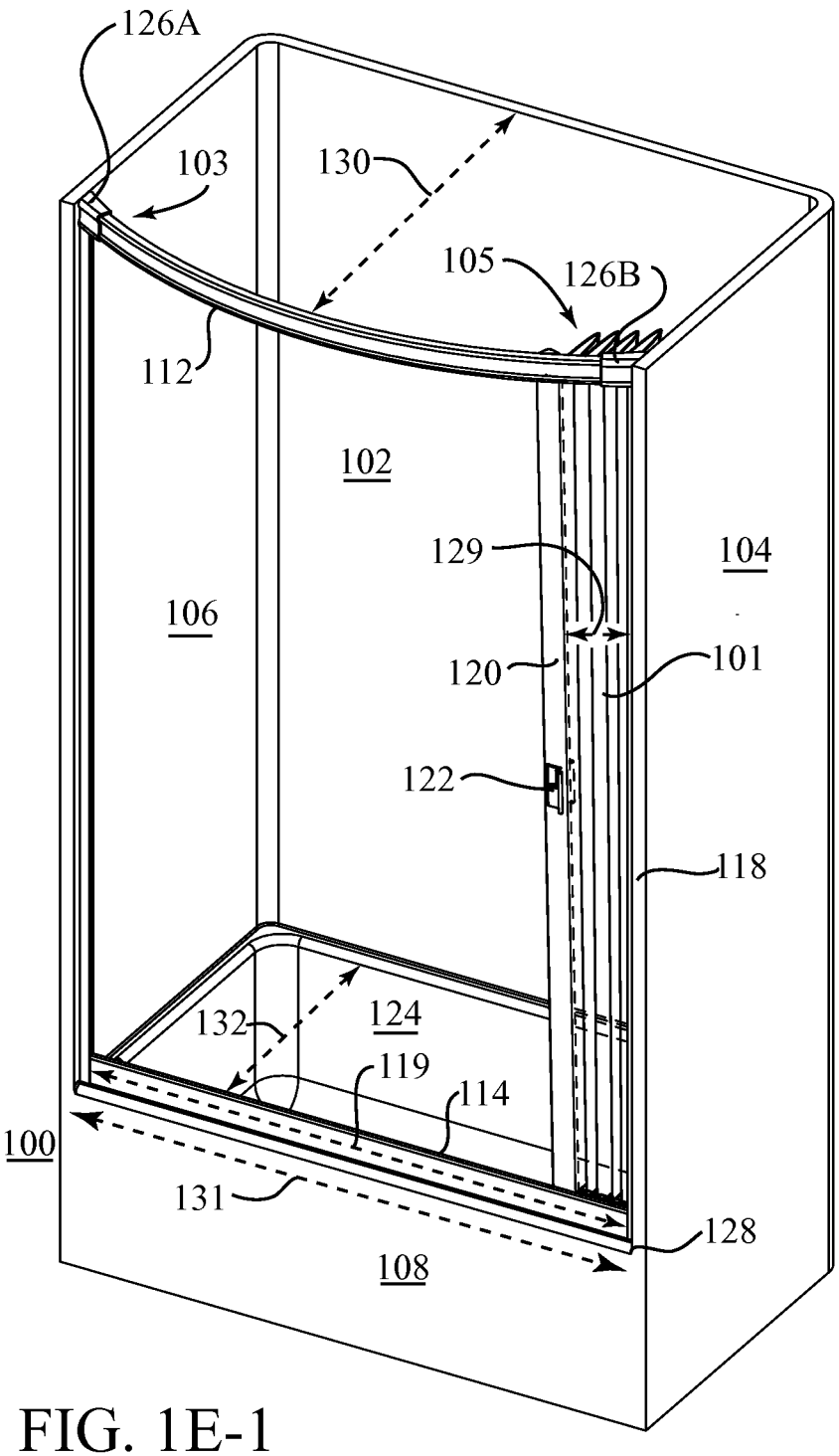
Figures 1, 1E, 2:
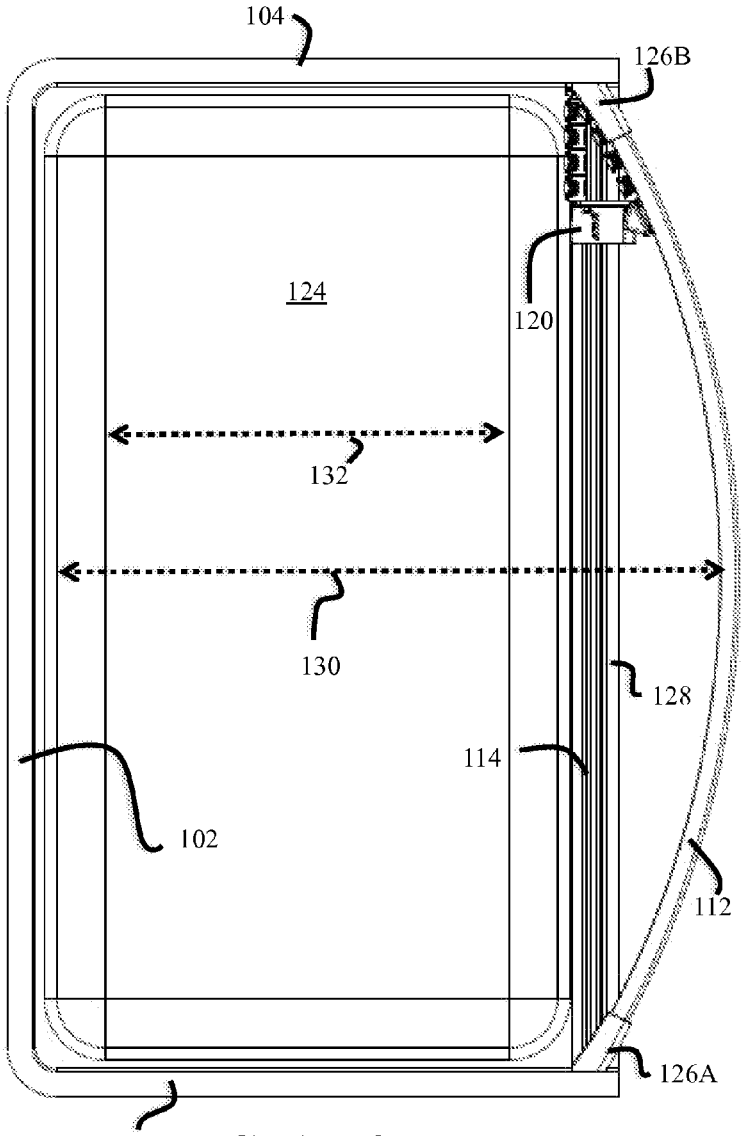
Figures 1, 1E, 2, 3:
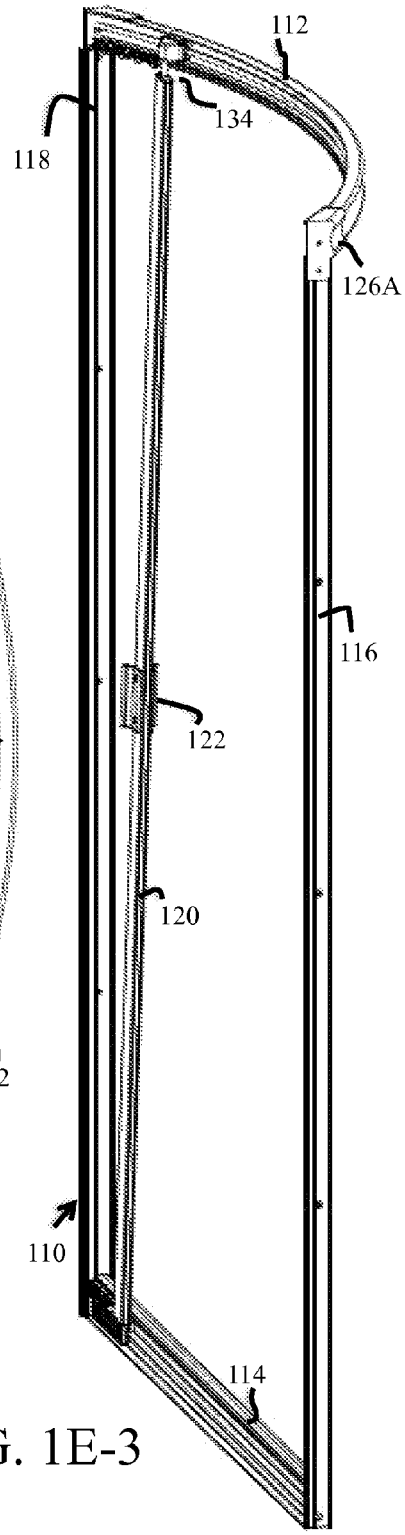
Figures 1, 1E, 2, 3, 4:
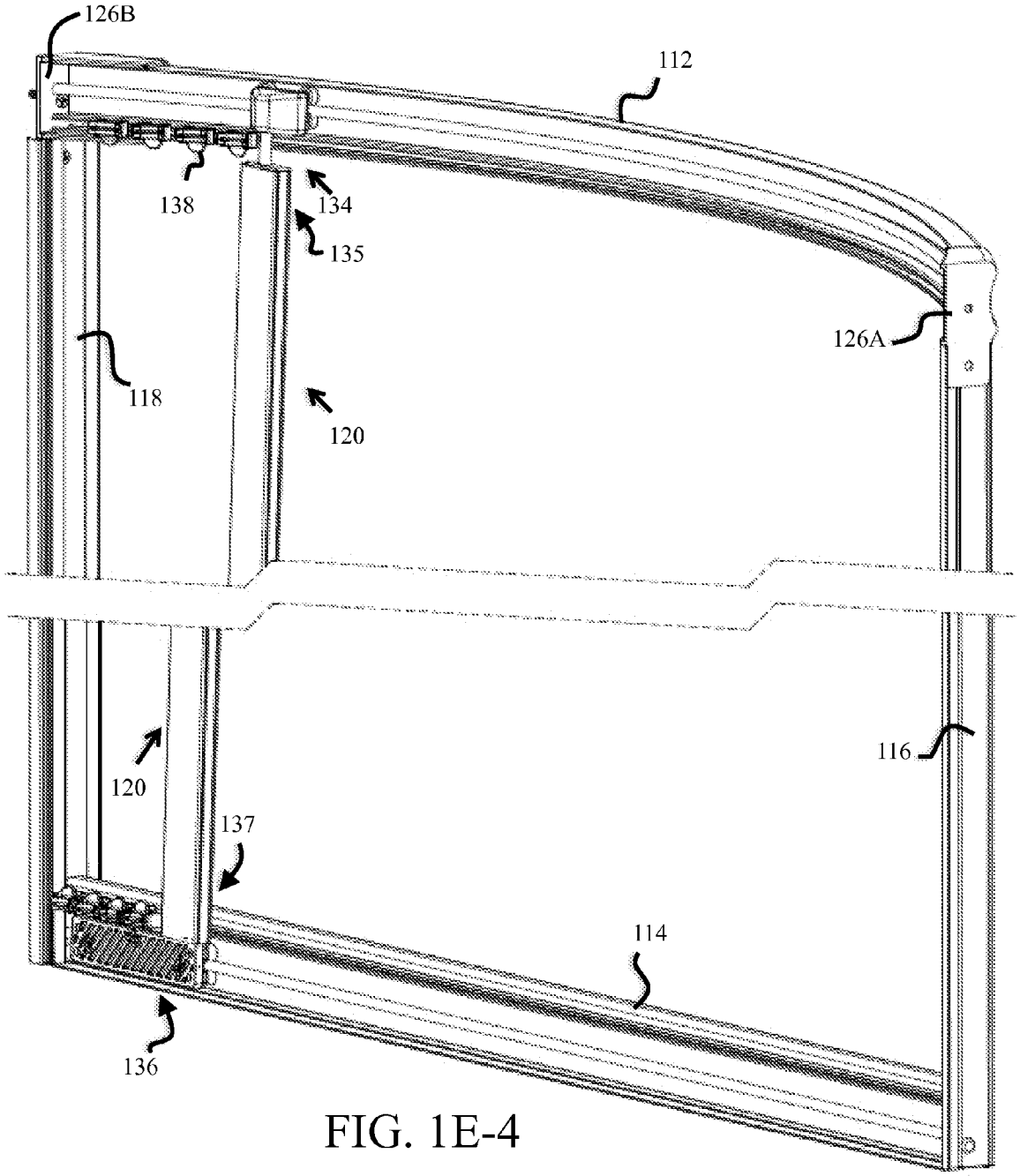
Figure 2:
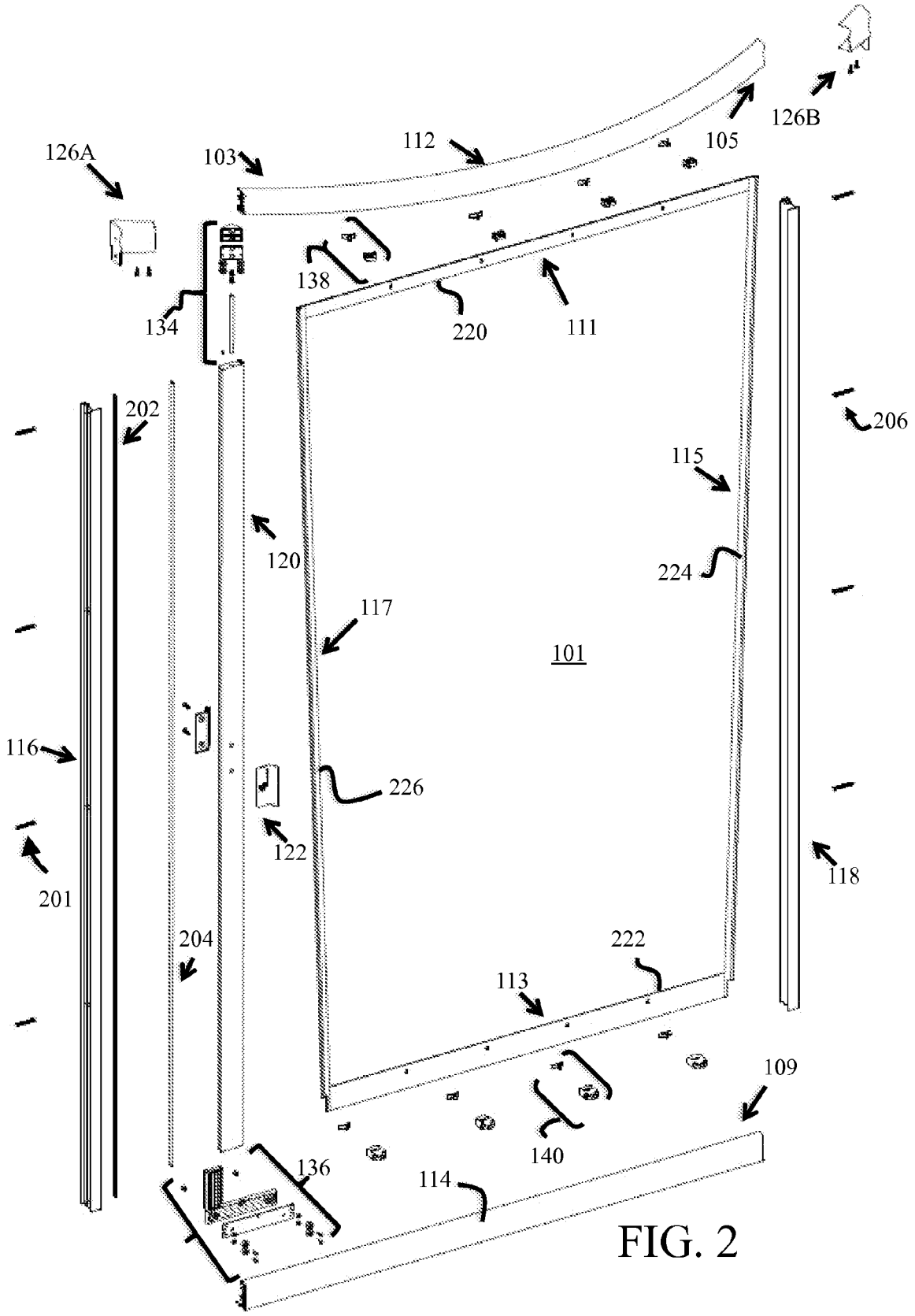

FIGS. 1A-2, 1B-2, 1C-2, 1D-2, and 1E-2 are top plan views of the fully assembled hybrid enclosure 100 of FIGS. 1A-1, 1B-1, 1C-1, 1D-1, and 1E-1, and are used to exemplary illustrate the progressive opening of the hybrid enclosure 100 from the top plan views in the exact corresponding opening positions shown in the perspective front views of FIGS. 1A-1, 1B-1, 1C-1, 1D-1, and 1E-1, from a fully closed position (FIG. 1A-2) to a fully open position (FIG. 1E-2).

FIGS. 1A-3, 1B-3, 1C-3, 1D-3, and 1E-3 are perspective views of the fully assembled hybrid enclosure 100, and are used to exemplary illustrate the progressive opening of the hybrid enclosure 100 in the exact corresponding opening positions shown in the perspective front views of FIGS. 1A-1, 1B-1, 1C-1, 1D-1, and 1E-1, from a fully closed position (FIG. 1A-3) to a fully open position (FIG. 1E-3).

FIGS. 1A-4, 1C-4, and 1E-4 are perspective rear views of the fully assembled hybrid enclosure 100, and are used to exemplary illustrate the progressive opening of the hybrid enclosure 100 from the rear perspective views in the exact corresponding opening positions shown in the perspective front views of FIGS. 1A-1, 1C-1, and 1E-1, from a fully closed position (FIG. 1A-4) to a fully open position (FIG. 1E-4).

As illustrated in FIGS. 1A-1 to 1E-4, the present invention provides a hybrid enclosure system 100, comprising a flexible, lightweight cover 101 coupled within a rigid frame 110 (that includes at least one rigid stile 120) that functions to confine a space, with minimal structural encroachment into potential ingress and egress area of the space when fully open (FIGS. 1E-1 to 1E-4).

As illustrated in FIGS. 1A-1 to 1E-4, the hybrid shower enclosure 100 of the present invention is a combination of part soft enclosure and part rigid enclosure. That is, the present invention uses a flexible, lightweight soft cover (curtain-like) enclosure 101 in combination with a rigid frame 110 (with a rigid stile 120) to close off access to an area when in fully closed position. The hybrid enclosure 100 of the present invention provides the benefit of a rigid shower enclosure by fully confining the water within the shower space, making it difficult for the water to drip out of the shower area. The hybrid shower enclosure of the present invention provides a rigid frame 110 (with a rigid stile 120) and other rigid closing features to maintain water within the confines of the shower area, but without the drawbacks associated with conventional rigid enclosures. In addition, the hybrid enclosure of the present invention provides has minimal structural encroachment into potential ingress and egress access area of the shower space when fully open.

The hybrid enclosure 100 of the present invention provides the rigid stile 120 that is coupled with the flexible, lightweight cover 101 that when pulled (via the stile 120 handles 122) at a closing direction (FIGS. 1A-1 to 1A-7), the soft enclosure cover 101 is pulled to expand and fully extend the flexible, lightweight cover 101 to substantially close-off the space, confining the water within the shower space. It should be noted that the flexible, lightweight cover 101 is coupled with the rigid frame 110 via vertical reinforcement elements 138 and 140, and laterally with the rigid stile 120 from within the enclosed area (e.g., shower area) rather than outside thereof, which facilitates maintaining water confined therein the enclosed space in both the opening and closing process of the hybrid enclosure 100. Therefore, the flexible cover 101 has no part that is outside of the shower area from which water may drip or roll down (no droplets) to a position outside the shower area. Accordingly, whether the hybrid enclosure 100 is open, closed, or moving in a direction to either open or close access to an area, all parts of the flexible cover 101 always remain well within the confines of the area, thereby preventing any water droplets from falling outside the shower area. In addition, as best illustrated in FIGS. 1A-4, 1A-5, and 1A-6, when fully closed, the entire length 131 of the stile 120 of the hybrid enclosure 100 physically contacts the entire length 147 of the first wall jamb 116 to substantially block water from dripping out of the shower area.

When the rigid stile 120 is pulled (via the handle 122) to an opening direction (FIGS. 1E-1 to 1E-4), the stile 120 pushes the flexible, lightweight cover 101 to fully open an ingress and egress access span (127) of the shower space with minimal structural encroachment, which as a length 129. In general, when in the fully open position (FIGS. 1E-1 to 1E-4), the hybrid shower enclosure of the present invention enables access with a span length 127 to the shower area that is almost equal to the total length 131 of the tub 124 (or basin 108) without much encroachment (minus the span length 129 for the volume of space taken by the stile 120 and the gathered cover 101). It should be noted that the length of the tub (basin) 131 parallels the width 119 (FIG. 1A-4) of the hybrid enclosure 100. This is particularly critical in smaller length applications where the total length 131 of the tub 124 is less than 32 inches. For example, with conventional in-line enclosures, more than half of the 32-inch access would be blocked due to structural overlap features, leaving less than 16-inchs for ingress/egress access to the shower area. Conventional pivot doors may be used instead, but the door for the conventional pivot doors rotate out from the closed position, most commonly outward and away from the shower space and toward the inside of room, which may also be very limited and minimal (e.g., a small apartment bathroom or an RV). The present invention provides a hybrid enclosure 100 without the conventional overlap feature that encroach to reduce the ingress/egress access area of the shower space, and can be used with both straight or curved shower tubs 124, pans, or substrates 108.

It should be noted that the hybrid shower enclosure 100 of the present invention may easily replace most conventional pivot door applications where bathroom space is limited. When fully closed (FIGS. 1A-1 to 1A-7) to close-off access to the shower area, the width 119 of the hybrid enclosure 100 of the present invention is equal to the total length 131 of the basin 108 for fully closing-off access and to prevent water leakage. However, when fully open (FIGS. 1E-1 to 1E-4), the potential encroachment width 129 of the hybrid enclosure into ingress/egress access width 127 is very small, leaving almost all of the basin (or curb 128) length 131 for accessing the shower space, enabling the hybrid enclosure to replace the use of conventional pivot door. Further, the flexible, lightweight cover 101 of the present invention has the added benefit in that it can be used in the industries where substantial weight reduction and increased fuel efficiency is desired, including, for example, in the Recreational Vehicle (RV) industry.

As illustrated in FIGS. 1A-1 to 1E-4 and stated above, the hybrid enclosure 100 of the present invention includes the flexible, lightweight cover 101 coupled within the rigid frame 110 and at least one rigid stile 101 that functions to confine a space, with minimal structural encroachment (span 129) into potential ingress and egress area of the space when fully open. The rigid frame 110 is comprised of a sill 114 and a header 112 with a first wall jamb 116 and a second wall jamb 118 coupled between the sill 114 and the header 112. In addition, the hybrid enclosure 100 of the present invention includes the soft enclosure 101 with at least one flexible, lightweight cover having an upper end 111 and lower end 113 coupled respectively with header 112 and sill 114, and a first and a second lateral ends 115 and 117 coupled with one of the respective first wall jamb and second wall jamb 116 and 118, and at least one stile 120.

As illustrated in FIGS. 1A-1 to 1E-4, the frame 110 of the hybrid enclosure 100 encloses an exemplary shower area defined by a surround comprised of a back wall 102, a first lateral wall 106, and a second lateral wall 104, including a shower tub 124 seated within a basin 108. The first wall jamb 116 is vertically oriented and is coupled with the first lateral wall 106, and the second wall jamb 118 is vertically oriented and is coupled with the second lateral wall 104. The first and second distal ends 103 and 105 of the header 112 are coupled with the upper distal ends of the respective first and second wall jambs 116 and 118 via a set of respective brackets 126A and 126B, and the first and second distal ends 107 and 109 of the sill 114 are coupled with the lower distal ends of the respective first and second wall jambs 116 and 118. The stile 120 of the frame 110 is an elongated unit with a top distal end section 135 that adjustably couples with the header 112 through a top articulation mechanism 134, and a bottom distal end section 137 that adjustably couples with the sill 114 though a bottom articulation mechanism 136. The stile 120 has an axial length 121 (FIG. 1C-3) that may optionally vary longitudinally during an operation of the hybrid enclosure 100 with the aid of the top and bottom articulation mechanisms 134 and 136.

The sill 114 of the frame 110 is coupled with a first structure (in this exemplary instance, a curb 128 of the tub 124). The sill 114 may be coupled with the curb of a shower pan (where there is no tub) or any substrate. In other words, the first structure may be the basin, tub, substrate, or foundation or ground of a space to be enclosed. The sill 114 has a length 119 that extends longitudinally along a length 131 of the first structure (e.g., curb 128) while conforming to a contour of the first structure. In general, the length 119 (FIG. 1A-4) of the sill 114 must be sufficient to fully cover the full length 131 of the first structure to prevent water leakage. The height of the sill 114 can be at any reasonable elevation. Although the sill 114 conforms to a contour of the first structure with which the sill 114 is associated, the header 112 is configured independent of the sill 114 contour. In other words, the header 112 and the sill 114 are fully independent of one another in terms of their respective shapes. That is, the sill 114 may take on any reasonable configuration independent of the header configuration. Therefore, the sill 114 may have a straight or a curved configuration to accommodate the configuration of the first structure with which the sill 114 is associated. The present invention provides sufficient flexibility in terms of maneuverability of the stile 120 with respect to its coupling with the sill 114 and the header 112 that it can accommodate different configurations of the sill 114 and header 112 (more details provided below). Accordingly, the header 112 may be of one configuration (shape) and the sill 114 of another shape, different from the shape of the header 112.

As further illustrated in FIGS. 1A-1 to 1E-4, the frame 110 further includes the header 112 that may optionally be curved rather than straight, with the curved section optionally extending beyond the first structure. This optional feature of extending the curvature of the header 112 beyond the contour (e.g., curb 128) of the first structure (e.g., tub 124) increases the usable shower area or interior volume of the shower space, providing a substantially syncline shower space profile (FIG. 1A-7). The distance (indicated by the reference arrow 125) by which an apex 123 of the curved header 112 is optionally extended beyond the first structure (e.g., curb 128) to increase the interior volume of the shower space is only limited by the distance by which header 112 is permitted to encroach the space of the rest of the bathroom. That is, it is preferred that the interior shower space be balanced with the total bathroom space when selecting the radius of the curvature of the header 112 to be extended beyond the first structure. Of course, the greater the extension of the apex 123 of the curved header 112, the greater the volume or space within the shower area. As best illustrated in FIGS. 1A-2, 1A-7, and 1E-1, the interior shower space has a width 132, which is the usable width of the tub 124 (where an individual may stand and take a shower). In a conventional shower area, this width 132 would be constant along the vertical length of the entire shower space. However, the curved header 112 of the present invention enables the upper section of the interior shower space to have a width 130 that is longer than the width span 132 of the tub 124, thereby increasing the volume of the shower area by the distance 125. Accordingly, the present invention provides a hybrid enclosure system 100 that combines all the beneficial features of the soft and rigid enclosures, but without their respective drawbacks. In addition, the hybrid enclosure system 100 of the present invention increases the usable enclosed space when fully closed, and increases access to and from the enclosed space when fully open.

As stated above, the hybrid enclosure 100 of the present invention provides the rigid stile 120, which has the axial length 121 that optionally varies along the longitudinal axis 139 of the stile 120 during the operation of the hybrid enclosure 100, when, for example, the header 112 used is curved out beyond the shower space. In other words, the axial length 121 of the rigid stile 120 may be optionally varied in accordance with the present invention if the longitudinal axis 141 of the header 112 and the longitudinal axis 143 of the sill 114 do not coincide (or exist) within same vertical plane. Stated other wise, if a vertical plane passing through the longitudinal axis 141 of the header 112 is the same as the vertical plane passing through the longitudinal axis 143 of the sill 114, then the axial length 121 of the stile 120 along is longitudinal axis 139 need not vary. That is, if a header is used wherein any section of the header 112 does not substantially vertically coincide or align with a corresponding section of the sill 114 below the header 112, then the axial length 121 of the stile 120 may be optionally implemented to vary along its longitudinal axis 139 in accordance with the present invention to enable proper opening and closing of the hybrid enclosure 100. It should be noted that although a curved header 112 is illustrated that is extended beyond the shower space, other configurations are contemplated. In other words, the axial length 121 of the rigid stile 120 of the present invention may be optionally varied along its longitudinal axis 139 to enable continuous operation of the shower enclosure when the header 112 and the sill 112 are off from their respective vertical alignment or plane (intentionally to increase shower space or otherwise by design).

As cumulatively illustrated in FIGS. 1A-1 to 1E-4, in the instance where an exemplary curved header 112 is used (with the curvature of the header 112 extending beyond the curb 128), the stile 120 is continuously and progressively contracted longitudinally along its axial length 121 as it moves along a reciprocating path towards the first and second distal ends 103 and 105 of the curved header 112 and the first and second distal ends 107 and 109 of the sill 114. That is, while the stile 120 articulates around the curved header 112 at a top distal end section 135 of the stile 120, the axial length 121 of the stile 120 is continuously and progressively contracted along its longitudinal axis 139 as the stile 120 moves along a reciprocating path towards the first and second distal ends 103 and 105 of the header 112 and the first and second distal ends 107 and 109 of the sill 114. The axial length 121 of the stile 120 is fully contracted along its longitudinal axis 139 at the first and second distal ends 103 and 105 of the header 112 and the first and second distal ends 107 and 109 of the sill 114.

As best illustrated in FIGS. 1C-1 to 1C-5, the axial length 121 of the stile 120 is continuously and progressively extended along its longitudinal axis 139 as the stile 120 moves along the reciprocating path towards the apex 123 of the curved header 112, and is fully extended at the apex 123. That is, the axial length 121 of the stile 120 is fully extended at the apex 123 (where it is fully extended beyond the traditionally defined curb 128, by the distance indicated by the reference number 125 in FIG. 1A-7), while the stile 120 articulates around the curved header 112 at a top distal end section 135 and the sill 114 at a bottom distal end section 137. Accordingly, the axial length 121 of the stile 120 progressively grows along its longitudinal axis 139 at the center (or apex 123) of the header 123, and progressively shrinks longitudinally at the end of the closing or opening process, while articulating around the curved header 112, and a straight sill 114. Describing the articulation of the stile 120 from another view point, during articulation of the stile 120 along the header/sill track, an angle β (FIG. 1C-5) between the longitudinal axis 139 of the stile 120 and a horizontal plane 145 of the first structure varies, while the longitudinal axis 139 of the stile 120 remains substantially perpendicular (at angle Ω, shown in FIG. 1C-4) to both the longitudinal axis 141 of the header 112 and the longitudinal axis 143 of the sill 114. Of course, the longitudinal growth and contraction of the axial length 121 of the stile 120 along its longitudinal axis 139 will have different progression from those illustrated if the stile 120 articulates along different reciprocating paths defined by a header and sill (with different shapes). For example, both the header and the sill may have axial lengths that extends in an "S" configurations or, alternatively, the header may be as illustrated, but the sill have an "S" shape. Such variations are contemplated, and will affect the stile articulations in all aspects, including longitudinal expansion/contraction.

FIG. 2 illustrates a disassembled, exploded view of the hybrid enclosure of FIGS. 1A-1 to 1E-4 with the separated parts to show the relationship and manner of assembly of the same in accordance with the present invention. As illustrated, the hybrid enclosure 100 of the present invention is comprised of the flexible, lightweight cover 101 coupled within the rigid frame 110. The frame 110 is comprised of the sill 114 and the header 112 with a first wall jamb 116 and a second wall jamb 118 coupled between the sill 114 and the header 112. In addition, the hybrid enclosure 100 of the present invention includes the soft enclosure 101 with at least one flexible, lightweight cover having an upper end 111 coupled with the header 112 through vertical reinforcement elements 138, and lower end 113 coupled with the sill 114 through vertical reinforcement elements 140. The cover further includes a first and a second lateral ends 115 and 117 coupled with one of the respective first wall jamb and second wall jamb 116 and 118, and at least one stile 120.

As illustrated in FIG. 2, the first wall jamb 116 is vertically oriented and is coupled with the first lateral wall 106 by fasteners 201, and the second wall jamb 118 is vertically oriented and is coupled with the second lateral wall 104 by fasteners 206. The first and second distal ends 103 and 105 of the header 112 are coupled with the upper distal ends of the respective first and second wall jambs 116 and 118 via a set of respective brackets 126A and 126B, and the first and second distal ends 107 and 109 of the sill 114 are coupled with the lower distal ends of the respective first and second wall jambs 116 and 118. The stile 120 of the frame 110 has a top distal end section 135 that adjustably couples with the header 112 through a top articulation mechanism 134, and a bottom distal end section 137 that adjustably couples with the sill 114 though a bottom articulation mechanism 136. The stile 120 further accommodates a first magnetic strip 204 that mates with a second magnetic strip 202, which is accommodated by the first wall jamb 116 to close-off access to and from shower area (best illustrated in FIGS. 1A-5 and 1A-6).

Figures 3A, 3B, 3C:
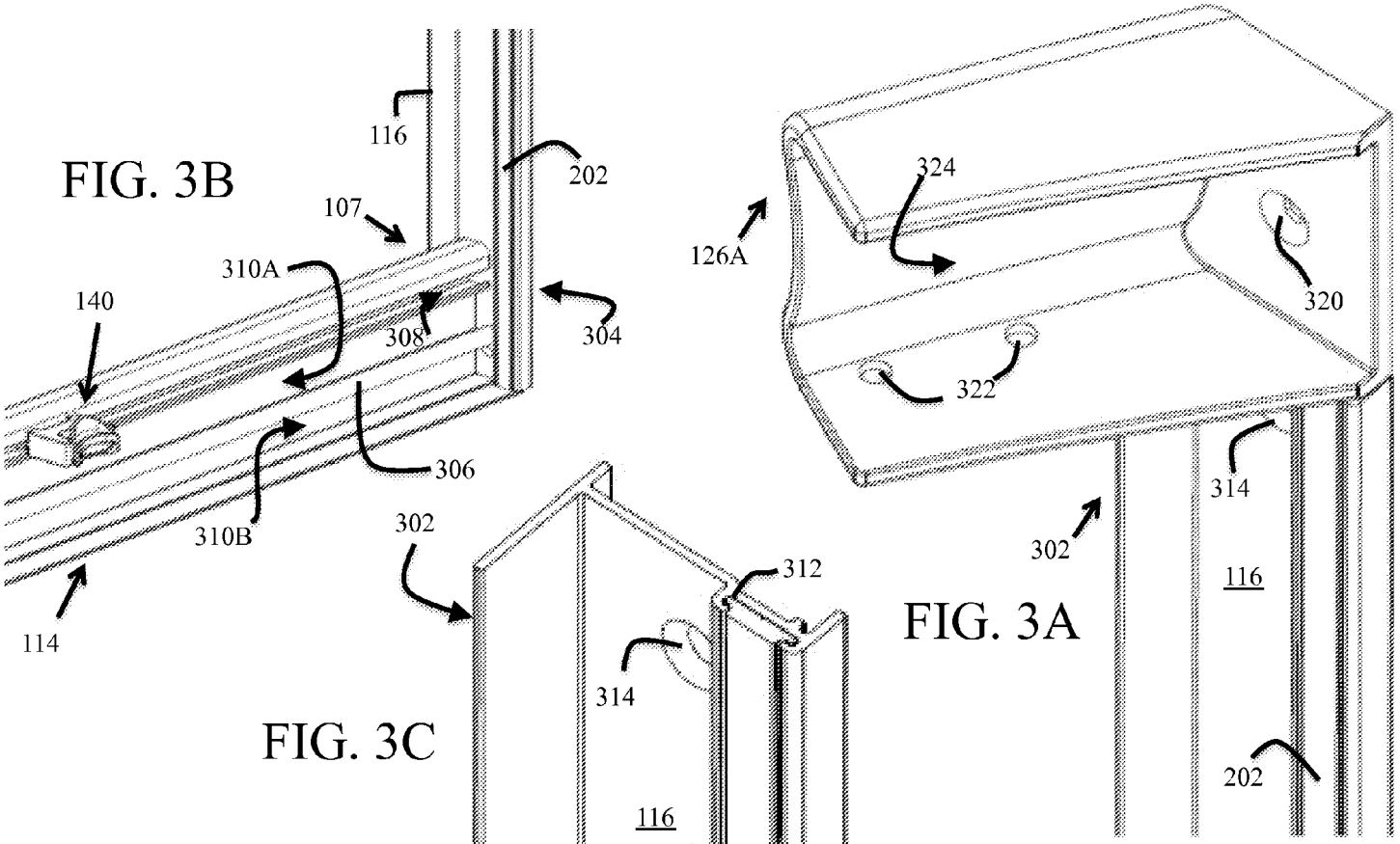
FIGS. 3A to 3C are exemplary illustrations of the various views of a first wall jam of the hybrid enclosure illustrated in FIG. 1A-1 to FIG. 2, and close-up view of a part of the sill and a bracket in accordance with the present invention.

FIGS. 3A to 3C are exemplary illustrations of the various views of a first wall jam of the hybrid enclosure illustrated in FIG. 1A-1 to FIG. 2, and close-up view of a part of the sill in accordance with the present invention. As illustrated, the first wall jamb 116 is in general a single piece, integral unit that is preferably linear that includes a set apertures 314 aligned along its longitudinal axis that allow the first wall jamb 116 to securely couple with the first lateral wall 106. The first wall jamb also includes a groove 312 that accommodates the second magnetic strip 202 (which is used to contact the first magnetic strip 204 accommodated by the stile 120). The upper most aperture 314 (illustrated in FIG. 3C) of the upper distal end 302 of the first wall jamb 116 is aligned with a corresponding aperture 418 on an extension portion 416 (shown in FIGS. 4A and 5A-5B) of the first bracket 126A, both of which are then coupled with the first lateral wall 106 by the set of fasteners 201.

Figure 6B:
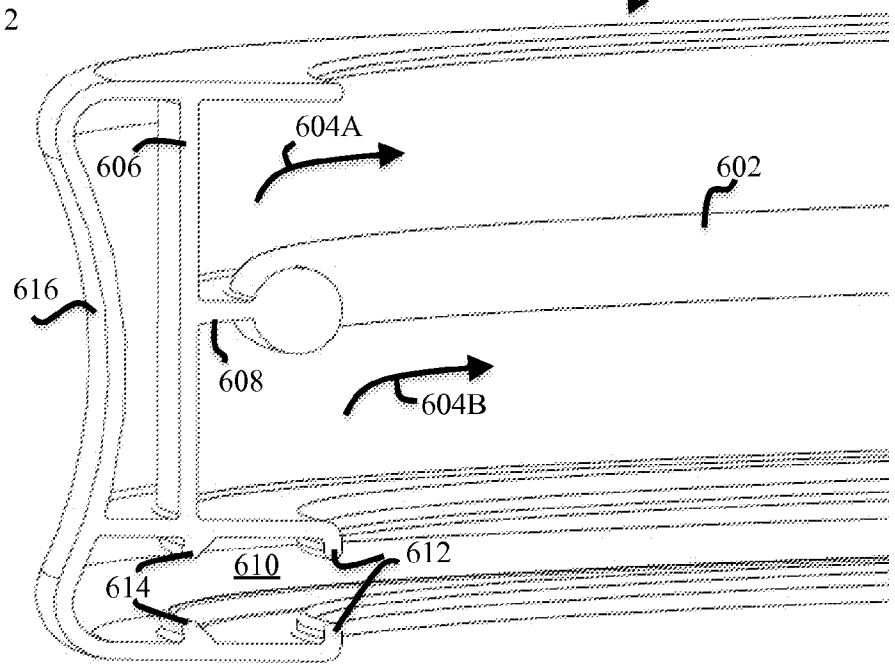
FIGS. 6A to 6B are exemplary illustrations of the various views of the header of the hybrid enclosure illustrated in FIG. 1A-1 to FIG. 5B in accordance with the present invention.
Figure 6A:
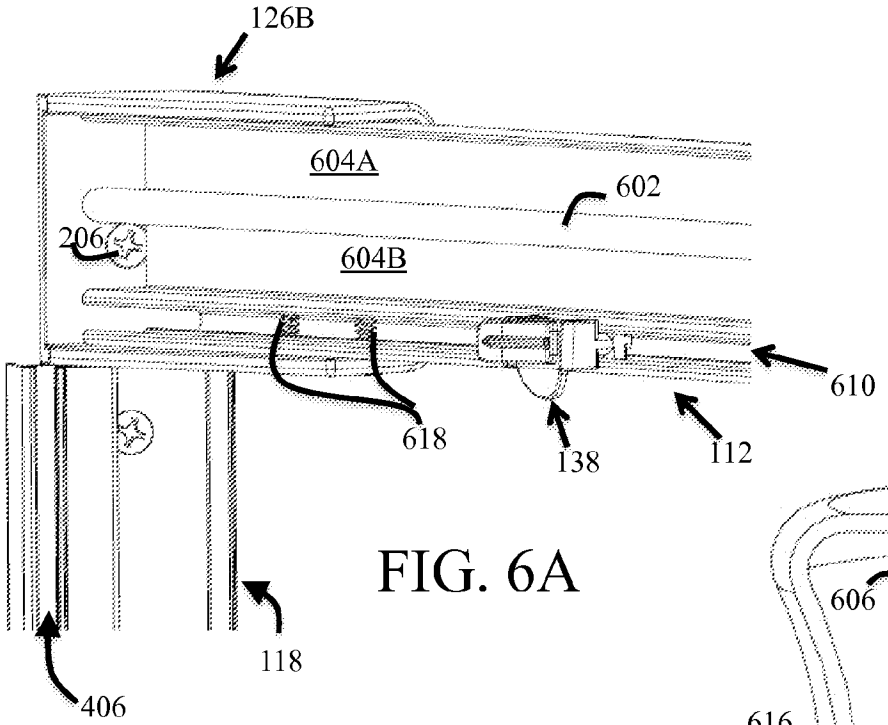

The first bracket 126A accommodates the first distal end 103 of the header 112 within its the inner section 324, with the header 112 secured thereto though the apertures 322 by a set of fasteners 618 (FIG. 6A). The first bracket 126A is itself is also coupled to the first wall 106 through the aperture 320 by a fastener. The first bracket 126A provides structural integrity in terms of added strength for the header 112, for example, preventing it from rotating along its longitudinal axis 141.

The first wall jamb 116 further includes a lower distal end 304 that couples with the first distal end 107 of the sill 114. As further illustrated, the sill 114 includes dual tracks 306 and 308, enabling the respective bottom articulation mechanism 136 of the stile 120 and the vertical reinforcement elements 140 to move along the sill 114. The respective upper and lower channels 310A and 310B provide a space within which the rollers 712 of the bottom articulation mechanism 136 of the stile 120 to articulate.

Figure 4B:
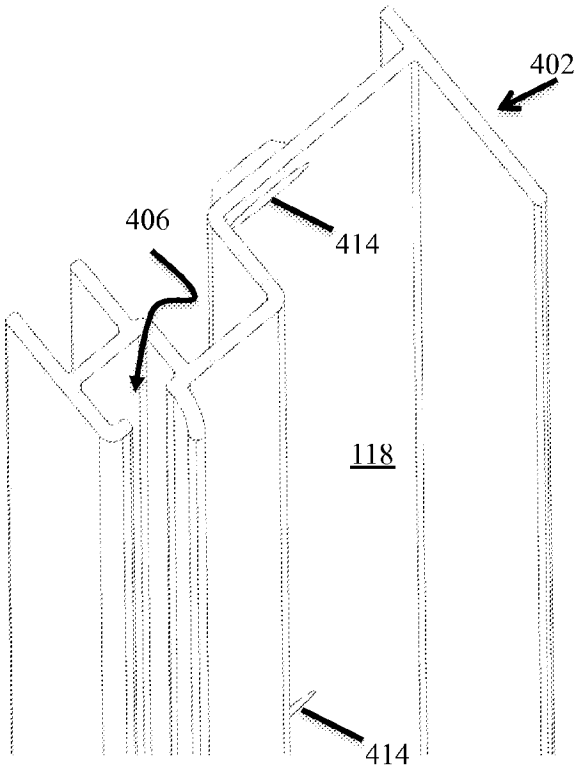
FIGS. 4A to 4D are exemplary illustrations of the various views of a second wall jam of the hybrid enclosure illustrated in FIG. 1A-1 to FIG. 3C, and close-up view of a part of the sill, cover, and a bracket in accordance with the present invention.
Figure 4A:
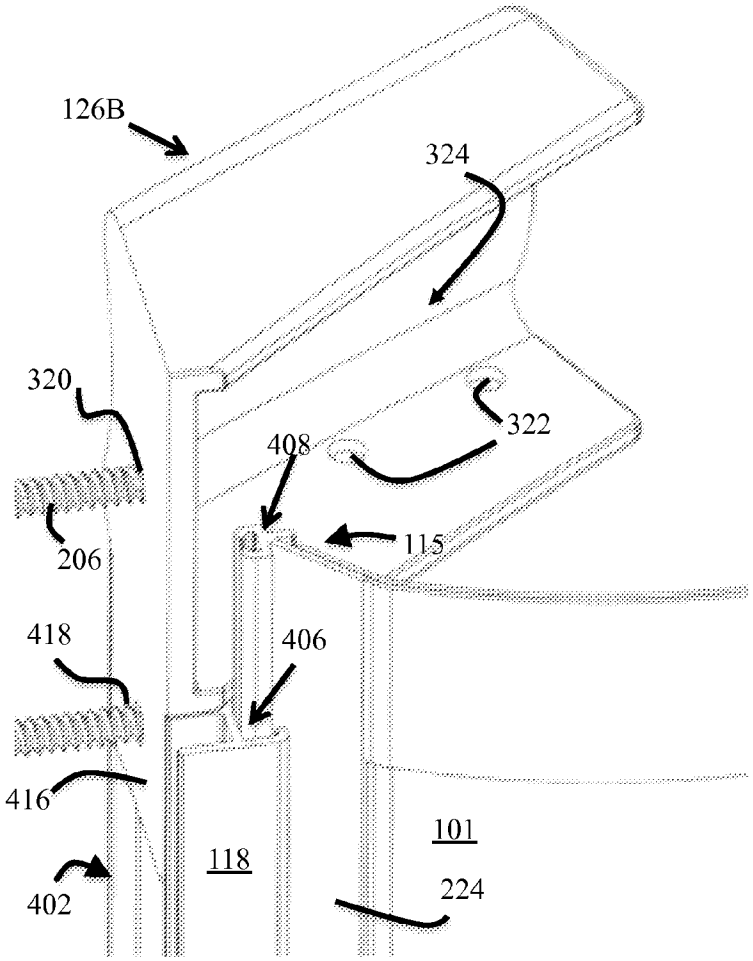
Figure 4D:
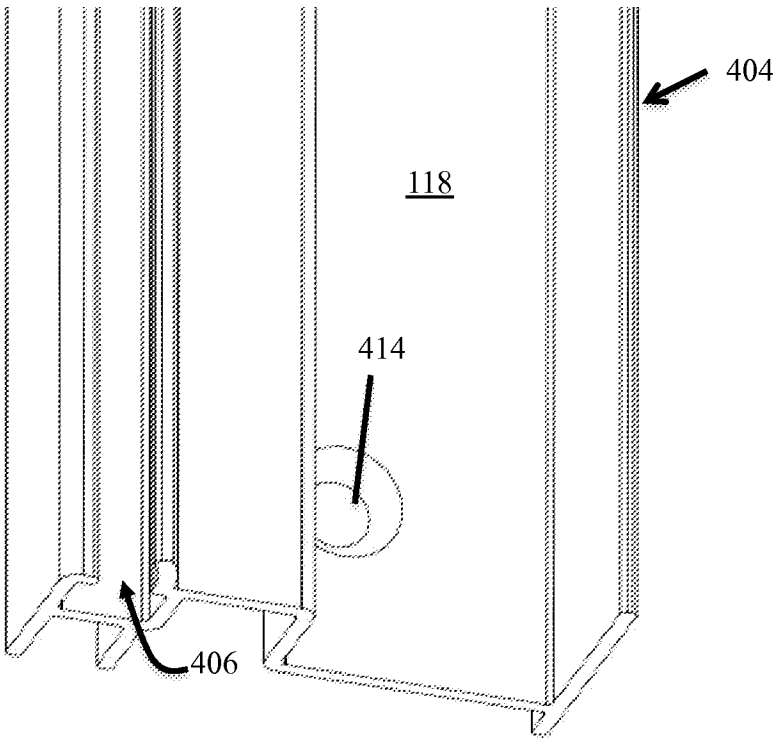
Figure 4C:
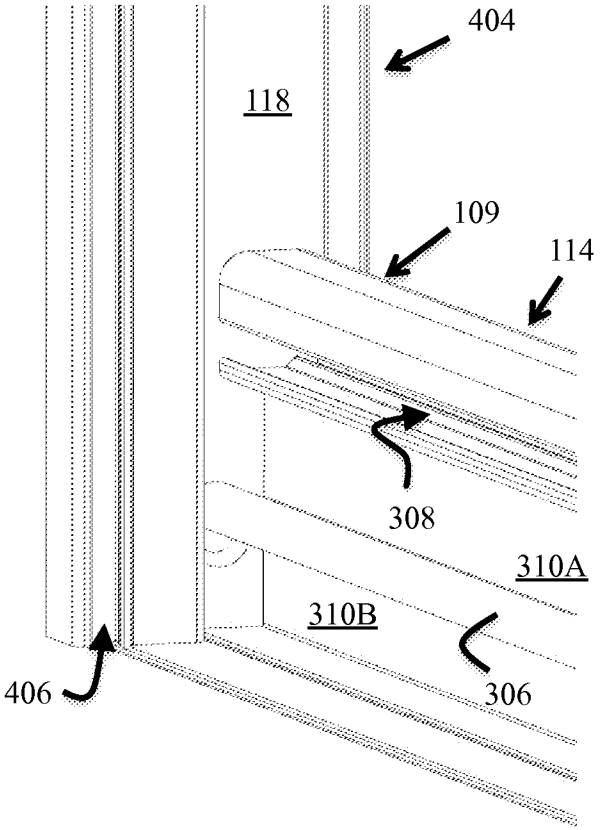

FIGS. 4A to 4D are exemplary illustrations of the various views of a second wall jam of the hybrid enclosure illustrated in FIG. 1A-1 to FIG. 3C, and close-up view of a part of the sill in accordance with the present invention. FIGS. 4A and 4B are exemplary illustrations of the upper distal end 402 of the second wall jam 118 of the hybrid enclosure 100, and FIGS. 4C and 4D are exemplary illustrations of the lower distal end 404 the second wall jam 118 of the hybrid enclosure 100. As illustrated, the second wall jamb 118 is in general a single piece, integral unit that is preferably linear that includes a set apertures 414 aligned along its longitudinal axis that allow the second wall jamb 118 to securely couple with the second lateral wall 104. The second wall jamb 118 also includes a groove 406 that accommodates an interlock section 408 of the first lateral end 115 of cover 101 to secure the cover 101 with the second wall jamb 118. The interlock section 408 of the first lateral end 115 of the cover 101 is commensurately formed in relation to the groove 406, with both the interlock section 408 and the groove 406 extending longitudinally along the axial lengths of the respective first lateral end 115 and the second wall jamb 118. As further illustrated, the upper most aperture 414 (illustrated in FIG. 4B) of the upper distal end 402 of the second wall jamb 118 is aligned with a corresponding aperture 418 on an extension portion 416 (shown in FIGS. 4A and 5A-5B) of the second bracket 126B, both of which are then coupled with the second lateral wall 104 by the set of fasteners 206.

The second bracket 126B accommodates the second distal end 105 of the header 112 within its the inner section 324, with the header 112 secured thereto though the apertures 322 by a set of fasteners 618 (FIG. 6A). The second bracket 126B is itself is also coupled to the second wall 104 through the aperture 320 by a fastener 206. The second bracket 126B provides structural integrity in terms of added strength for the header 112, for example, preventing it from rotating along its longitudinal axis 141. The second wall jamb 118 further includes a lower distal end 404 that couples with the second distal end 109 of the sill 114. It should be noted that neither the sill 114 nor the second bracket 126B cover or overlap the groove 406, enabling easy replacement of the cover 101 after fully installation, assembly, and use.

FIGS. 5A to 5D are exemplary illustrations of the various views of the first and second brackets 126A and 126B of the hybrid enclosure illustrated in FIG. 1A-1 to FIG. 4D in accordance with the present invention. As illustrated, both brackets 126A and 126B are mirror image components and described above, with the outer section 502 designed to have an aesthetic association with the header 112. In general, a conventional straight or inline header connected at distal ends with conventional wall jambs at a straight line, provides great stability. That is, under heavy load conditions (e.g., when a person holds onto the header with one hand), it is preferred if the header withstands the vertical force of the weight of the pull of the person holding and pulling down on the header, with the vertical force being perpendicular (vertically orientation) to the axial length of the header. These vertical forces can cause vertical shearing forces perpendicular to the axial length of the header. In general, the vertical shearing force is at or near where the actual load is experienced by the header, which is generally at the distal ends of the header for a straight or inline header, which are above the first and second wall jambs, with the wall jambs functioning as "pillars" or "support columns" holding up the header ("the beam"). However, with curved headers, in addition to the actual load (vertical force) experienced by the header at its distal ends, additional torque is also experienced that can cause rotation or twisting. That is, since the apex of the curved header is out of line and not in-line with the distal ends, when a force is applied, a torque (e.g., rotation or twisting) is also experienced at the distal ends of the header, with the rotational force (or torque) about the inline axis of the distal ends of the header, which are also known as bending moments. That is, a simple, well-known, textbook definition of a torque is that it is a measure of how much a force (e.g., a user pulling down on the header) acting on an object (e.g., the header) causes that object (e.g., the header) to rotate. The mount by which the torque is increased is related to the distance of the apex of the header from the straight, inline axis between the distal ends of the header. This distance functions as the moment arm of the torque. Accordingly, the set of stability brackets 126A and 126B of the present invention are provided to add stability to the header, preventing the header from twisting about its axial length and provide a more secure attachment of the header with the rest of the shower space structure, including the first and second jambs.

The stability brackets 126A and 126B may be made by a die-casted component that integrates with the cross-sectional (or profile) contour of the distal ends of the header, and include an integrated extension tab that is placed behind and is attached to a preset cavity in the first and second jambs. The stability brackets interlock the header with one of the first and second jambs for a more secure and stable header installation. That is, the extension tab 416 of the set of stability header brackets is attached to the first and second jambs, with the extension tab 416 integral with the stability header bracket. The added stability is critical and needed when the header curves out of its virtual straight line (or inline) connection between the connection points with the first and second jamb, at the distal ends of the header. Accordingly, the combination of the form of the bracket commensurate with the profile form of the distal ends of the header and the integration of the tab of the bracket with the first and the second jambs will counter the torque and vertical shearing forces, providing great stability.

Figure 5B:
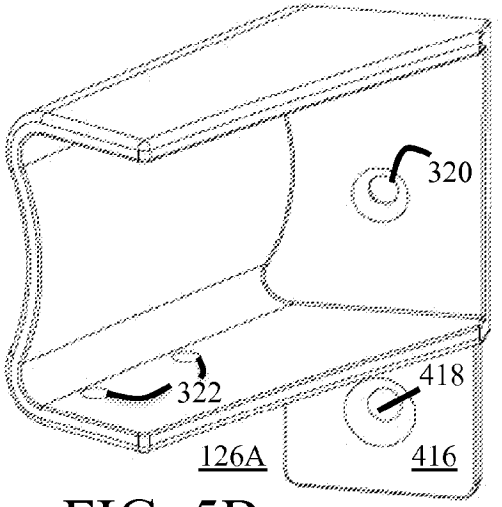
FIGS. 5A to 5D are exemplary illustrations of the various views of the first and second stability brackets of the hybrid enclosure illustrated in FIG. 1A-1 to FIG. 4D in accordance with the present invention.
Figure 5D:
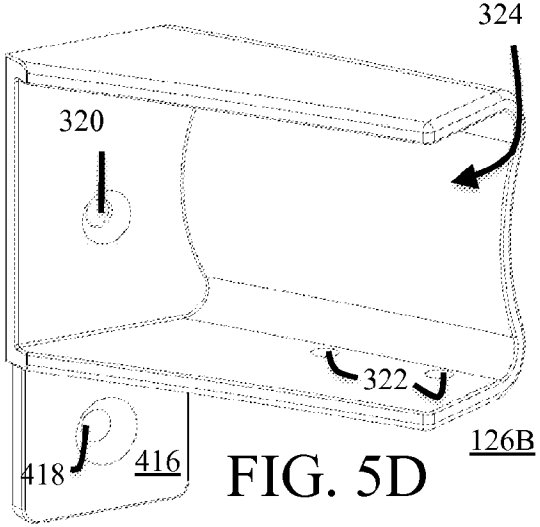
Figure 5A:
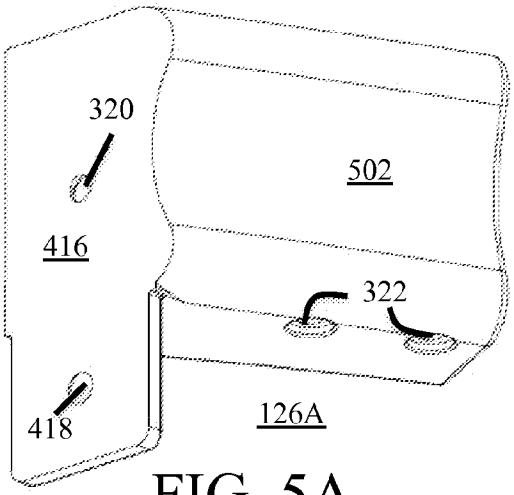
Figure 5C:
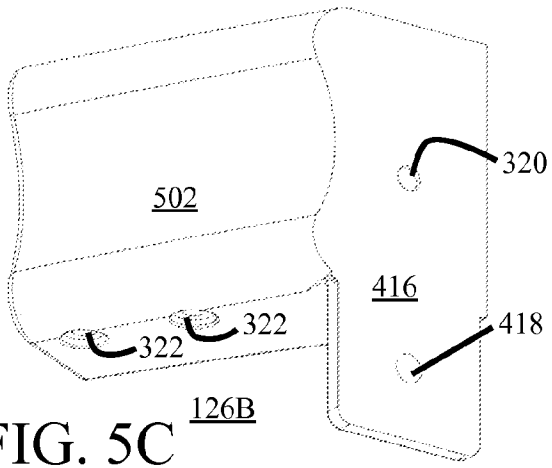

FIGS. 6A to 6B are exemplary illustrations of the various views of the header of the hybrid enclosure illustrated in FIG. 1A-1 to FIG. 5B in accordance with the present invention. As illustrated, the header 112 includes dual tracks 602 and 610, enabling the respective top articulation mechanism 134 of the stile 120 and the upper cover coupling vertical reinforcement elements 138 to move along the header 112. The respective upper and lower channels 604A and 604B of provide adequate space within which the rollers 712 of the top articulation mechanism 134 of the stile 120 to articulate. As illustrated, the first track 602 of the header 112 is coupled with the track support 602 via a support flange 608, forming two substantially equal upper and lower channels 604A and 604B. The first track 602 has a substantially circular cross-sectional profile that extends along the longitudinal axis 141 of the header 112, which enables a set of concaved wheels 712 to roll on the first track 602 and rotate about the central longitudinal axis of the substantially circular track 602 while moving transversally across the header 112. As further illustrated, the entire header 112 has an outer shell support 616 that provides further structural integrity in terms of added strength to the header 112 and an aesthetically pleasing look. The second track 610 of the dual track system of the header 112 include a substantially rectangular cross-sectional profile (with flanges or lips 612 and 614) that define the second track 610, and which extend longitudinally along the longitudinal axis 141 the header. The second track 610 enables a set of vertical reinforcement elements 138 to slide within the track 610 while moving transversally across the header and the sill.

FIGS. 7A to 8F are exemplary illustrations of the various view of the stile of the hybrid enclosure illustrated in FIGS. 1A-1 to 6B in accordance with the present invention. FIGS. 7A to 7I are exemplary illustrations of the various views of a top distal section of the stile, and FIGS. 8A to 8F are exemplary illustrations of the various views of a bottom distal section of the stile.

As illustrated in FIGS. 7A to 8F, the stile 120 is comprised of a first lateral groove or canal 702 that accommodates a second interlock end 704 of the second lateral end 117 of the cover 101. The extended flange 706 of the first lateral groove or canal 702 provides added support for proper, aesthetically pleasing posture of the cover 101 during all operational phases of the hybrid enclosure 100. The second interlock end 704 extends longitudinally along the length of the second lateral end 117 of the cover 101, and the first lateral groove or canal 702 extends along the longitudinal axis 139 along the entire axial length 121 of the stile 120.

The stile 120 is further comprised of a second lateral groove or canal 703 that accommodates the first magnetic strip 204 that mates with the second magnetic strip 202 of the first wall jamb 116 to close-off access to and from shower area (best illustrated in FIGS. 1A-5 and 1A-6). The first magnetic strip 204 extends longitudinally along the axial length 121 of the stile 120, and the second lateral groove or canal 703 extends along the longitudinal axis 139 along the entire axial length 121 of the stile 120.

As more specifically illustrated in FIGS. 7A to 7I, the stile 120 further includes the top distal end section 135 that adjustably couples with the header 112 through the top articulation mechanism 134. As stated above, while the stile 120 articulates around the curved header 112 at the top distal end section 135 of the stile 120, the axial length 121 of stile 120 is continuously and progressively contracted along its longitudinal axis 139 as the stile 120 moves along a reciprocating path (the longitudinal axis 141 of the header 112) towards the first and second distal ends 103 and 105 of the header 112, and is fully contracted at the first and second distal ends 103 and 105. The axial length 121 of the stile 120 is continuously and progressively extended along its longitudinal axis 139 as the stile 120 moves along the reciprocating path towards the apex 123 of the curved header 112, and is fully extended at the apex 123. Accordingly, the axial length 121 of the stile 120 progressively grows at the center (or apex 123) of the header 123, and progressively shrinks at the ends 103 and 105 during the closing or opening process, while articulating around the curved header 112, and a sill that may have a straight, linear configuration.

As illustrated in FIGS. 7A to 7I, the stile 120 of the present invention includes an extension element (or an axial pivot pin) 708 that moves longitudinally along the longitudinal axis 139 of the stile 120 to vary the reach of the stile 120 in relation to the header 112 and the sill 114 as the stile 120 moves along the reciprocating curved path (longitudinal axis 141) of the header 112, thereby varying the axial length 121 of the stile 120 to enable articulation of the stile 120 along the curved header 112, and one of a straight and curved sill 114. The curved header 112 (or non-vertical alignment of the axial length of the header in relation to the axial length of the sill) is an optional feature and therefore, all structure that accommodates for functionality of this optional feature is also optional, and this includes the extension element and others, which are further detailed below. Therefore, the vertical up/down feature and a yaw articulation of a set of upper rollers (more detailed below) that may accompany an optional non-aligned header-sill combination are also optional. In other words, these optional features are used to support a non-aligned header-sill combination feature, only. Therefore, whether a curved basin or straight basin is used, if the header and the sill have commensurate vertical alignment, these optional features would not be needed. For example, both the header and the sill may be straight or curved and vertically aligned on top of one another and therefore, there would not be any need for the vertical and yaw articulations of the stile connections in relation to the header and the sill.

Figure 7B:
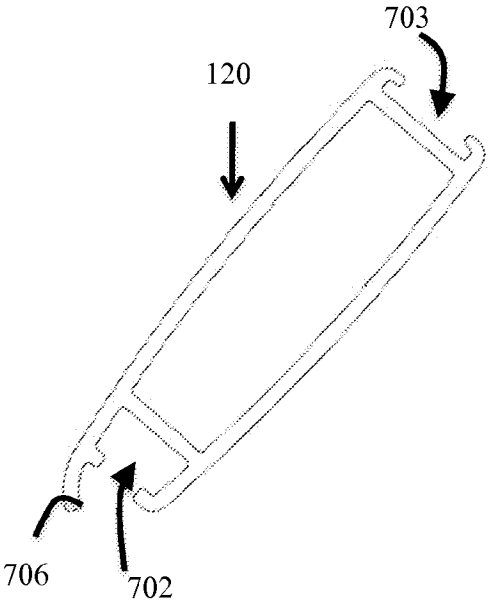
FIGS. 7A to 7I are exemplary illustrations of the various views of a top distal section of the stile of the hybrid enclosure illustrated in FIGS. 1A-1 to 6B in accordance with the present invention.
Figure 7A:
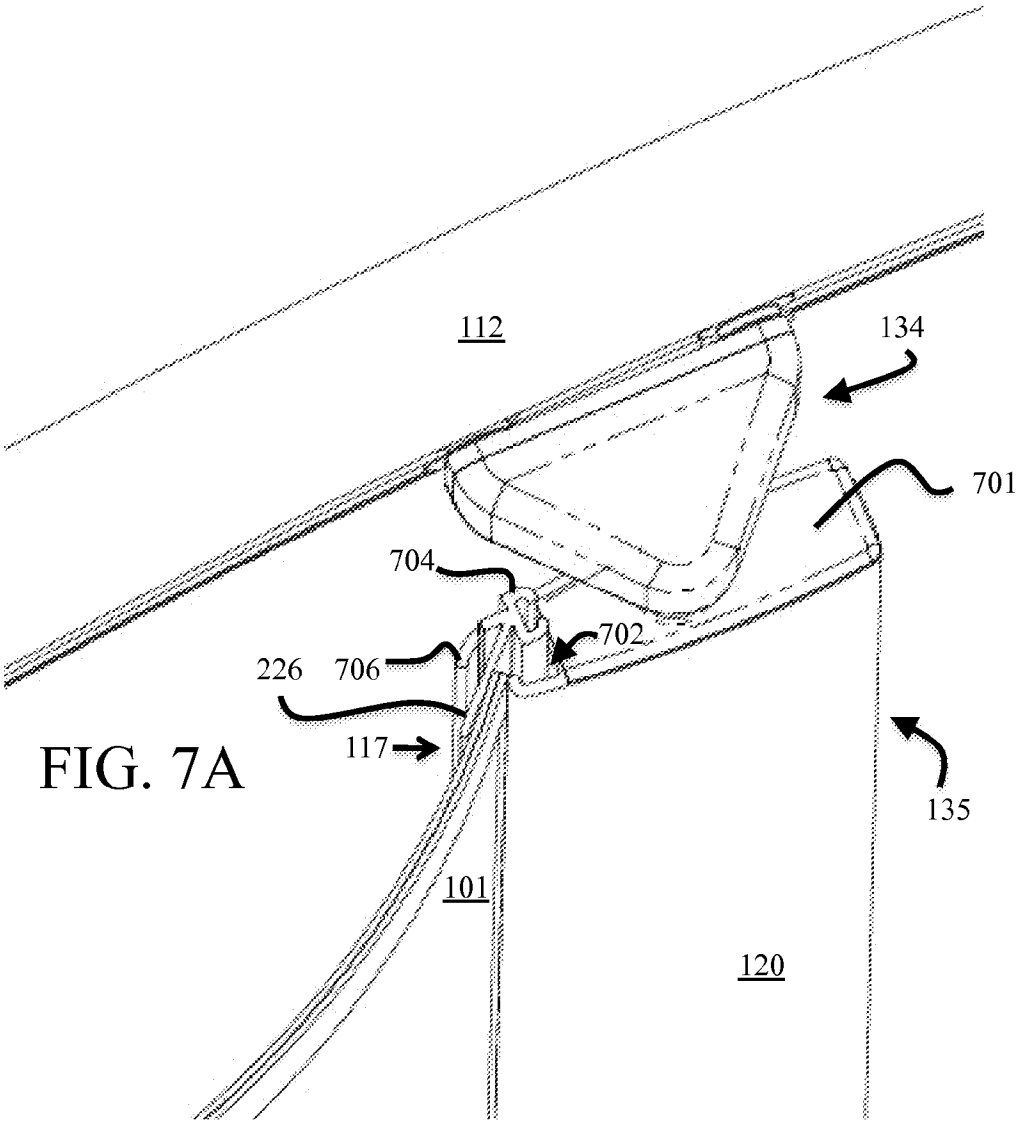
Figure 7C:
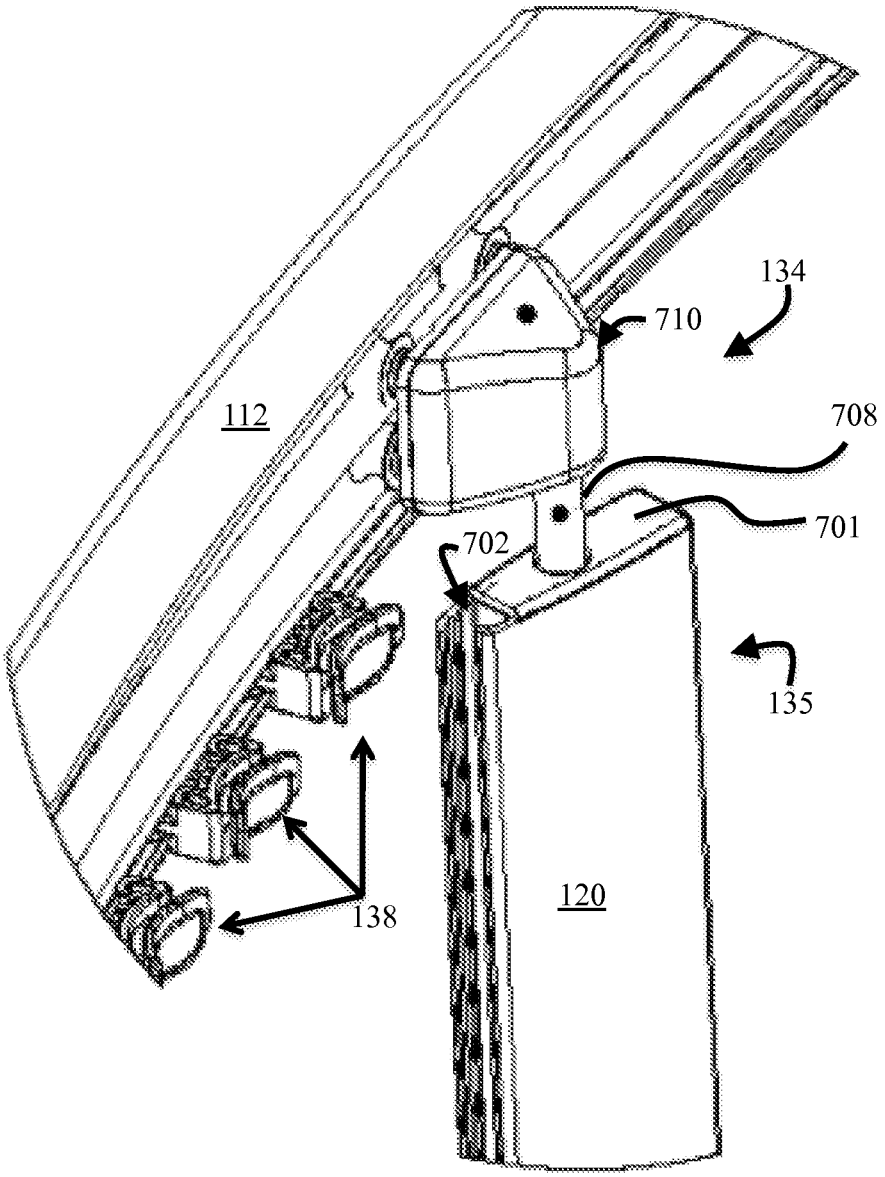
Figure 7D:
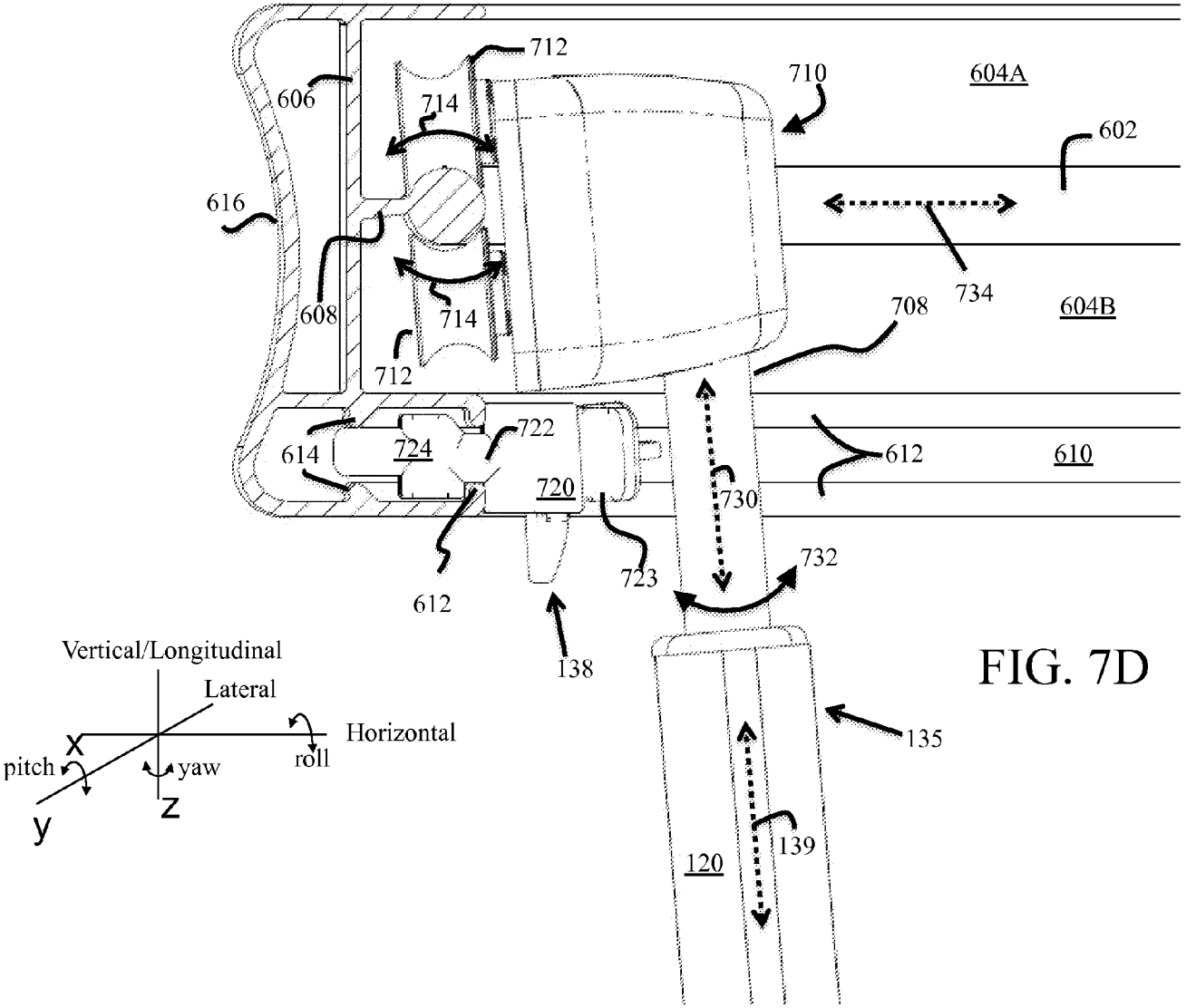
Figure 7E:
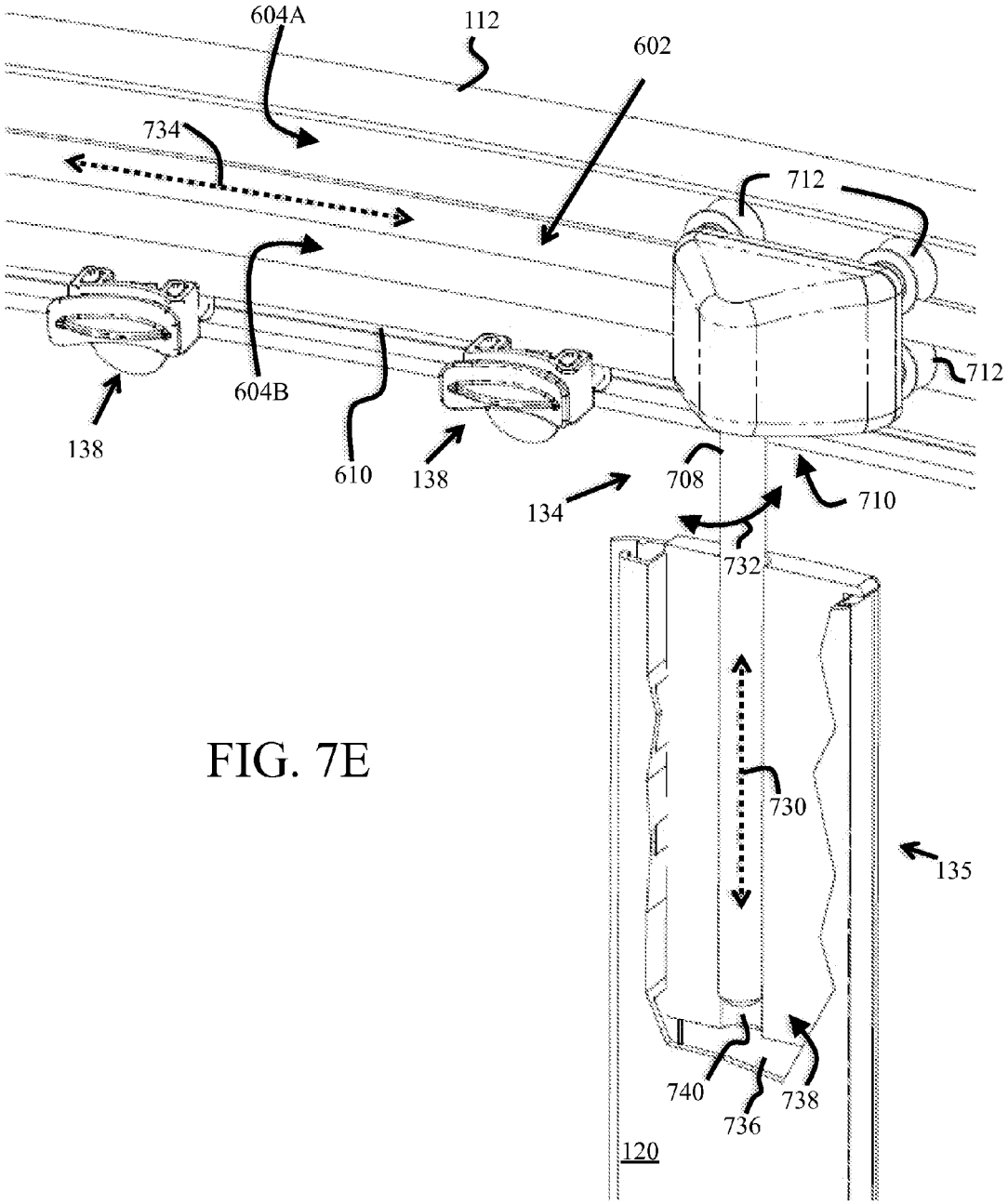

As best illustrated in FIGS. 7D and 7E, the stile 120 includes the top distal end section 135 that adjustably couples with the header 112 through the top articulation mechanism 134, which provides four types of articulations. The articulation mechanism 134 includes the pivoting axis pin 708 that enables the axial length 121 of the stile 120 to extend or contract along the longitudinal axis 139 of the stile 120, enabling the vertical or longitudinal articulation 730 of the top articulation mechanism 134. The pivoting axis pin 708 also pivots about the longitudinal axis 139 of the stile 120, which enables the yaw articulation 732 of the top articulation mechanism 134, and the roller 712 have concaved surfaces that rotate or pivot along reciprocating path 714 about the central longitudinal axis of the track 602, enabling "pitch" articulations. Finally, the entire top articulation mechanism 134 has a horizontal or translational articulation 734 that moves along the axial length of the track 602.

The pivoting axis pin 708 extends or contracts the axis length 121 of the stile 120 along the illustrated Z-axis (vertical, up-down), which is the illustrated longitudinal axis 730, and also enables the entire articulation mechanism 134 (including the pivoting axis pin 708) to rotate about the Z-axis, providing yaw articulation 732. As further illustrated, in FIGS. 7D and 7E, the extension element 708 is coupled with an articulation housing 710 that accommodates the set of rollers 712 that ride along the track 602 of the header 112, with the articulation housing 710 rotating (yaw articulation 732) about the longitudinal axis 730 of the extension element 708 to enable the stile 120 to articulate around the curved header 112. This yaw articulation 732 enables smooth, easy movement of the stile 120 along the entire track 602 of the header 112.

The third articulation of the top articulation mechanism 134 is related to the pivoting motion 714 of the rollers in relation to the track 602, which may be construed as the "pitch" articulation. This pitch articulation 714 enables an angle β between the longitudinal axis 139 of the stile 120 and a horizontal plane 145 of the first structure to vary, while the longitudinal axis 139 of the stile 120 remains substantially perpendicular to a longitudinal axis 141 and 143 of the header 112 and sill 114. It should be noted that the wheels are comprised of a ride surface that is concaved with lateral projections that hug the header track 602, thereby preventing the wheels from disconnecting from the tract 602. Accordingly, the concaved rollers around the track profile maintain the stile on the track, and prevent it from disengaging the track.

Figure 7F:
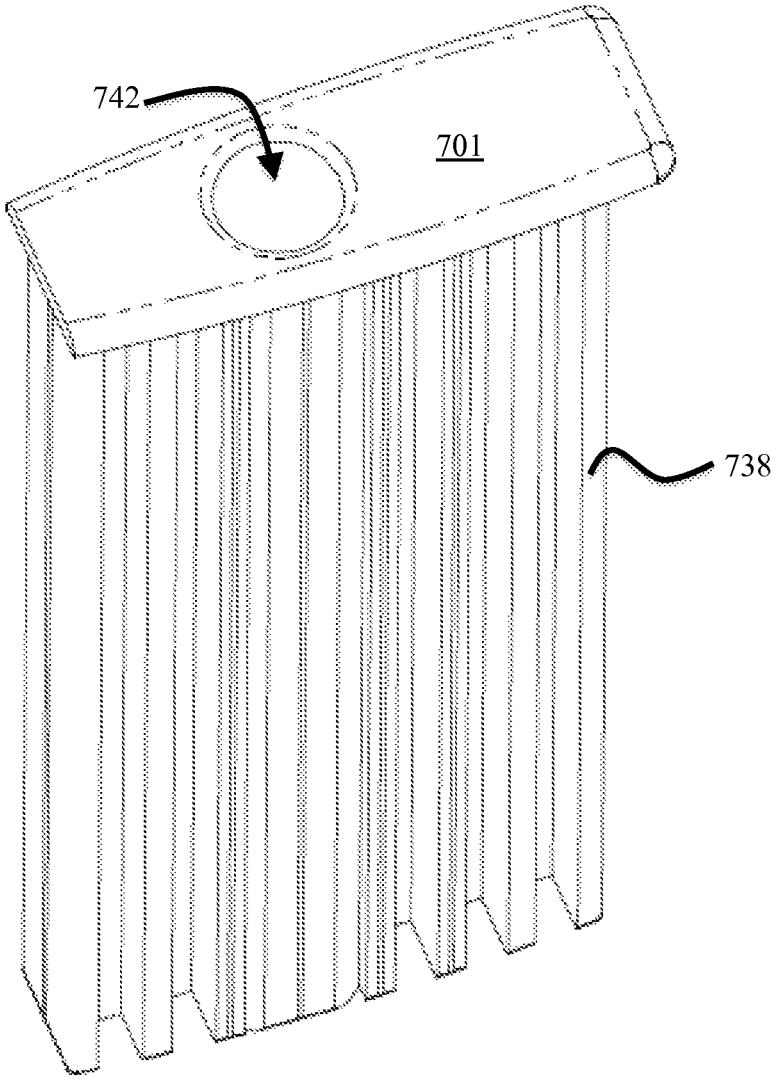

As best illustrated in FIGS. 7E and 7F, the stile 120 may include a first compartment 736 at the top distal end section 135 of the stile 120, within which is inserted a cartridge 738 (FIG. 7F). The cartridge includes a guidance chamber 740 with a top hole 742 wherein the optional extension element 708 is inserted, housed, and reciprocally moves to vary the axial length 121 of the stile 120 and enables rotation. It should be noted that the stile 120 is a continuous extruded component. That is, it has an upper and a lower opening, forming a through hole inside the stile 120. The upper opening is capped by a piece 701 that has the aperture 742 that enables the extension 708 to move and be guided.

Figure 7G:
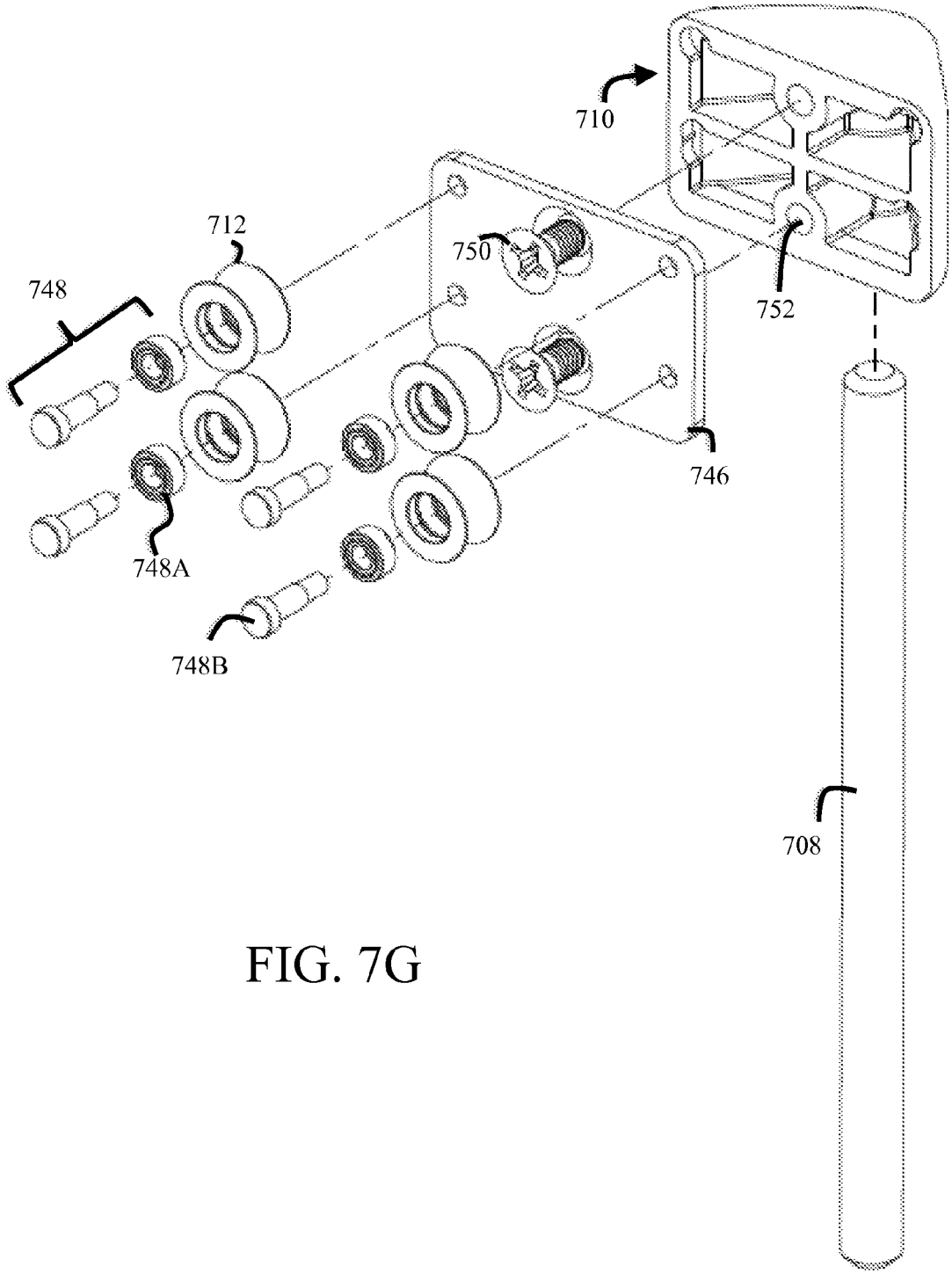
Figures 2, 7H:
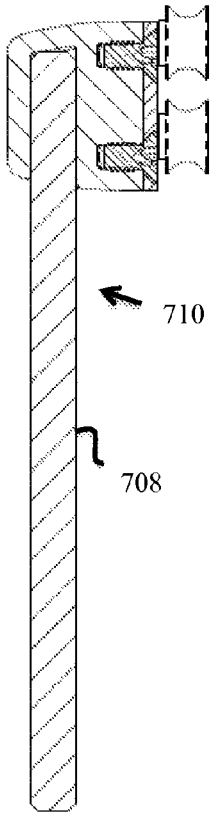
Figures 1, 7H:
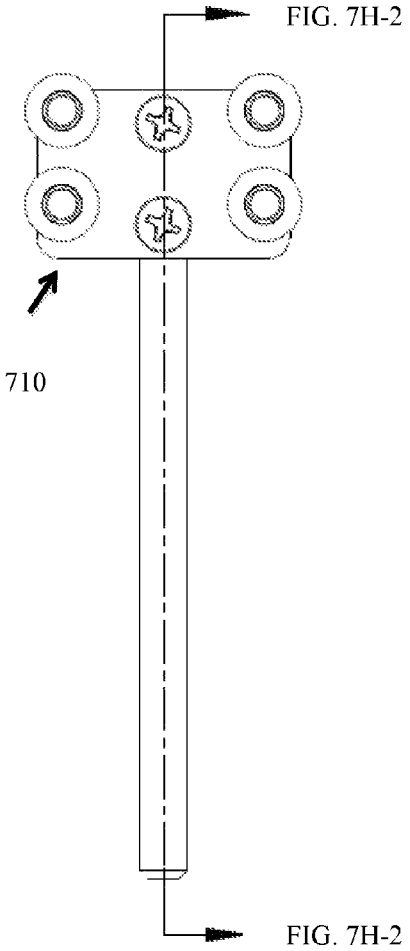
Figure 7I:
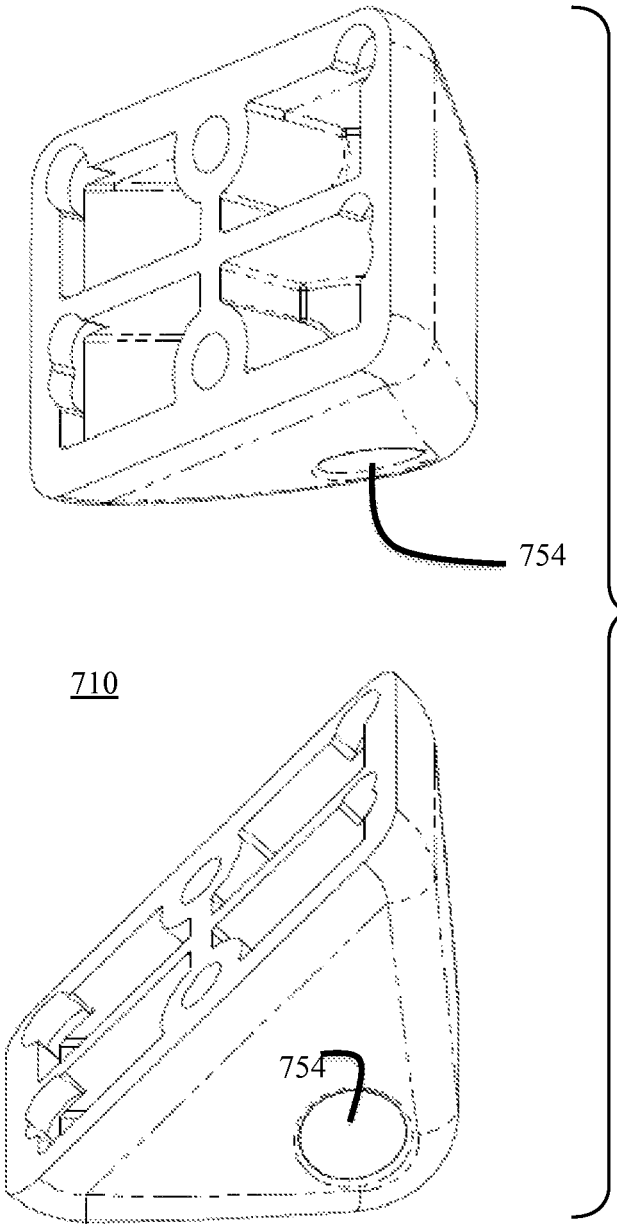

As best illustrated in FIGS. 7G to 7I, the extension element 708 is coupled with an articulation housing 710 via an articulation hole 754 (FIG. 7I), with the articulation housing 710 accommodating the set of rollers 712 that ride along the track 602 of the header 112. The rollers 712 are coupled with the articulation housing by a corresponding set of attachments mechanisms 748 through a cover 746 that is fastened to the articulation housing 710 by a set of fasteners 750. More particularly, the articulation mechanism 134 includes the articulation housing 710 that is a plastic piece, aluminum front plate 746, four wheels 712 with attachment mechanism 748 (e.g., four ball bearings 748A, and four axel pins 748B) on which the wheels ride. The axle pins 748B are riveted inside the aluminum plate 746, with two fasteners 750 securing the aluminum plate 746 itself to the plastic piece housing 710 within apertures 752.

Figure 8A:
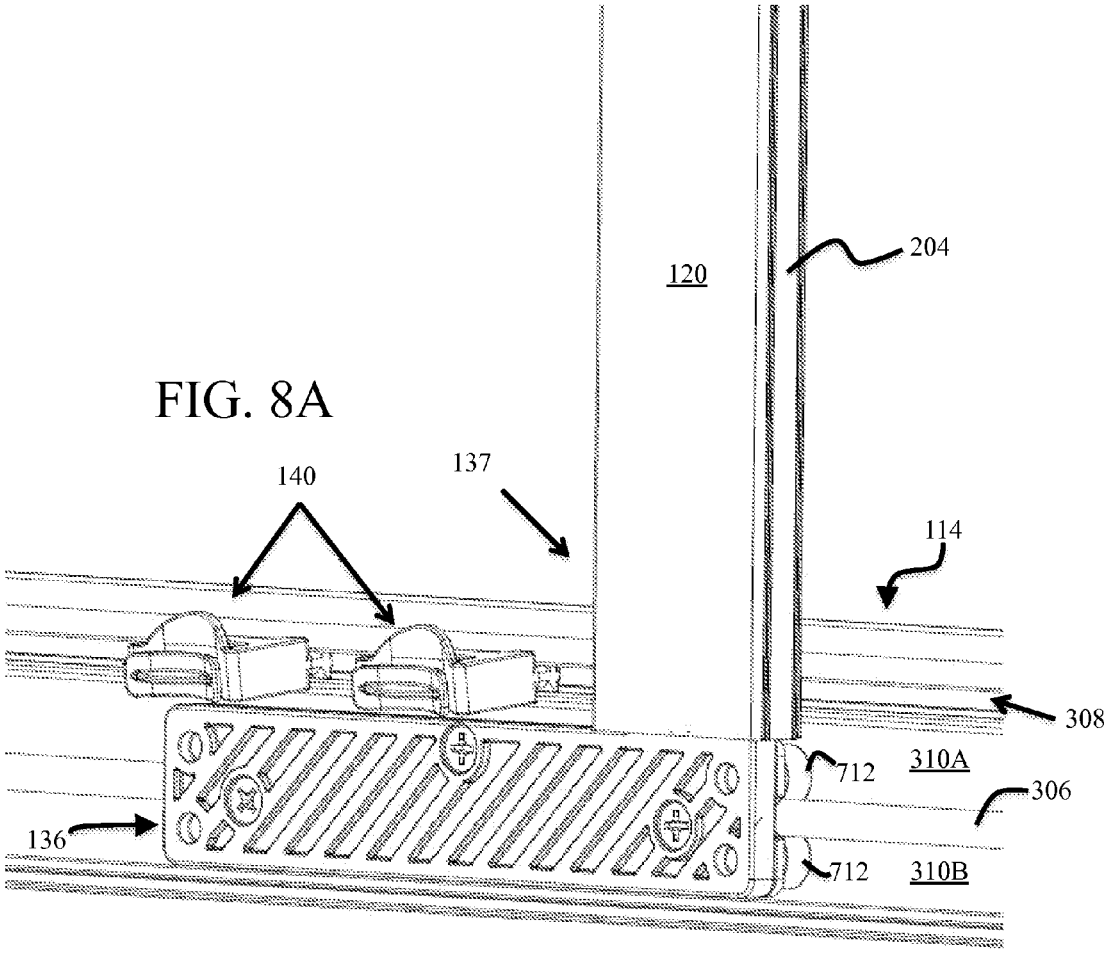
FIGS. 8A to 8F are exemplary illustrations of the various views of a bottom distal section of the stile of the hybrid enclosure illustrated in FIGS. 1A-1 to 7I in accordance with the present invention.
Figure 8B:
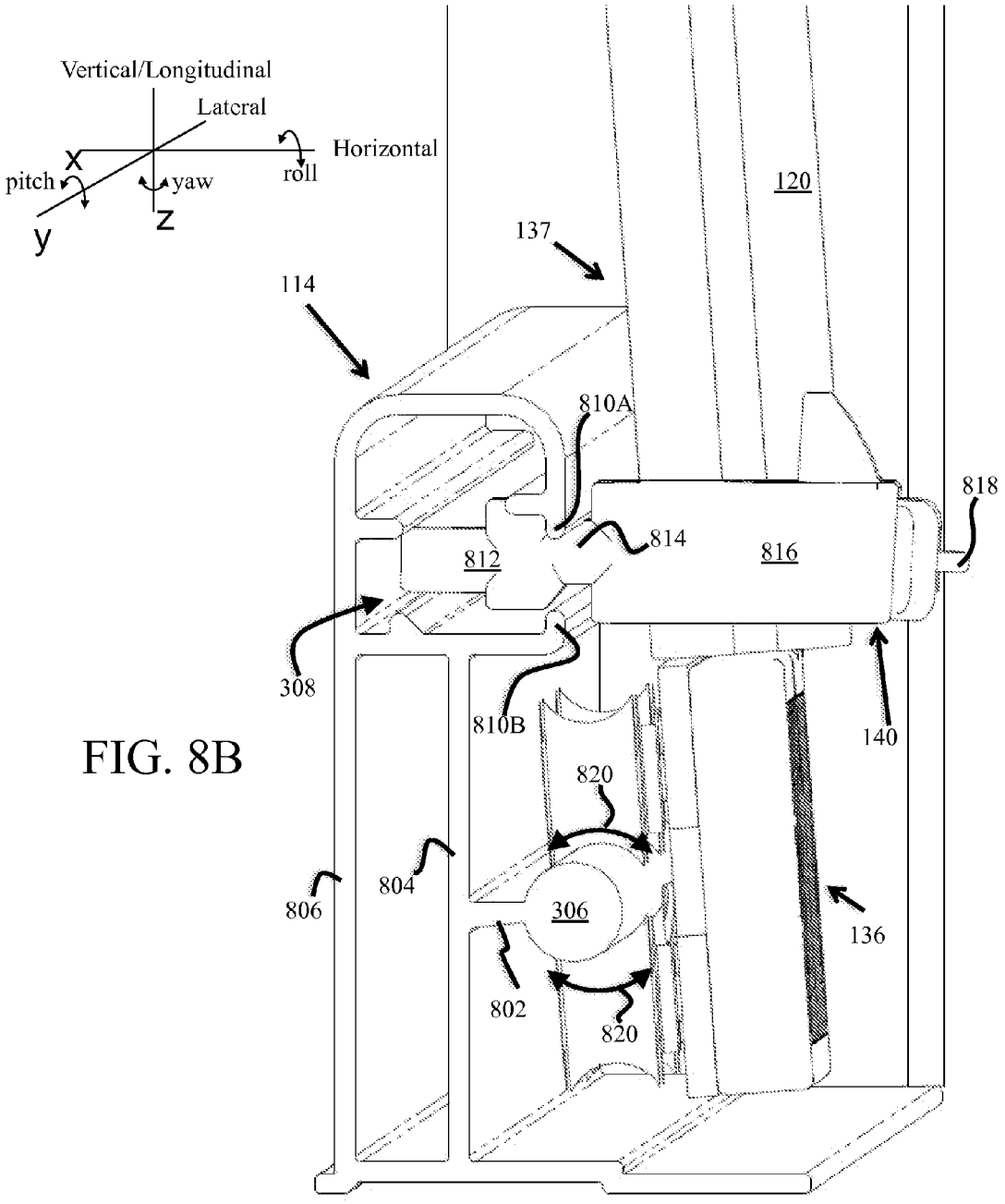
Figure 8C:
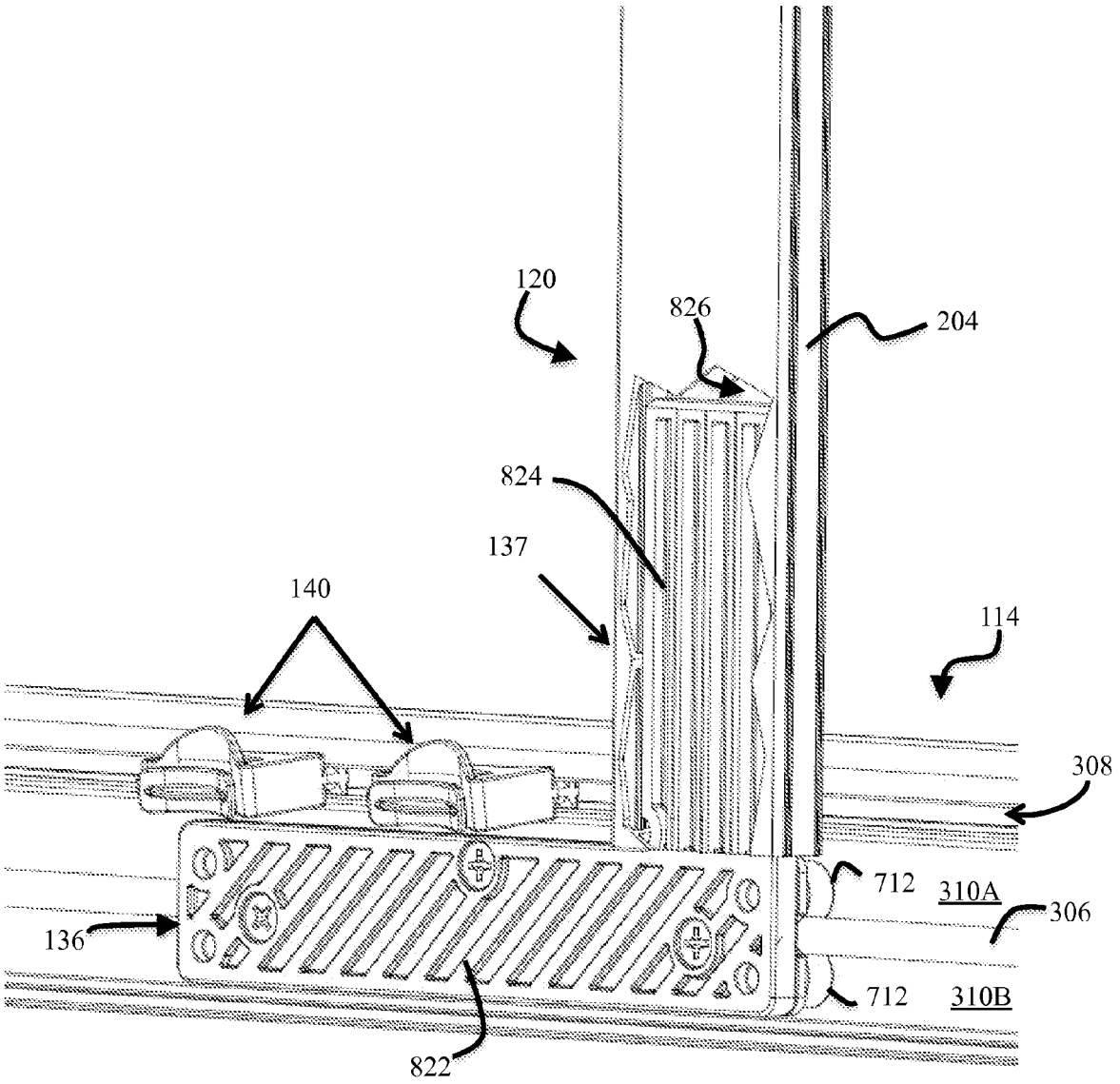
Figure 8D:
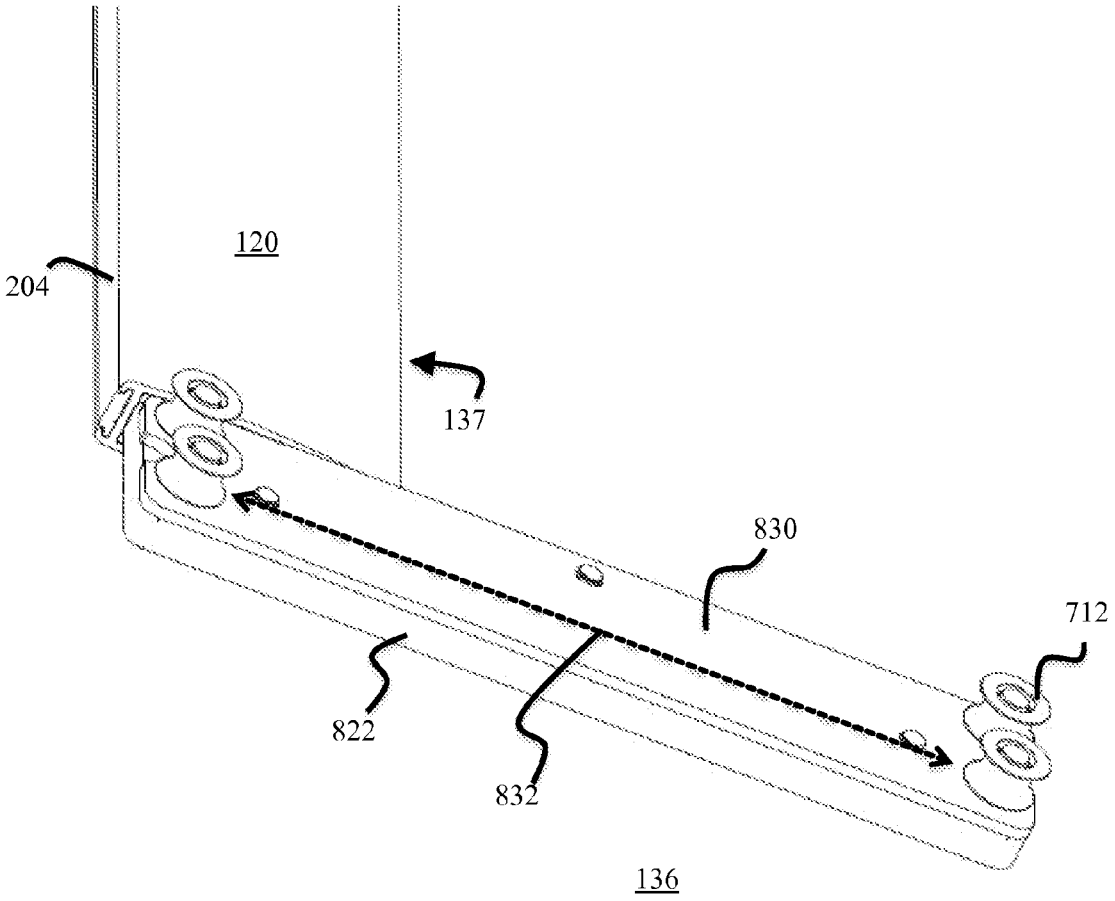

FIGS. 8A to 8F are exemplary illustrations of the various views of a bottom distal section of the stile of the hybrid enclosure in accordance with the present invention. As illustrated, the stile 120 of the frame 110 includes the bottom distal end section 137 that adjustably couples with the sill 114 though the bottom articulation mechanism 136. As illustrated in FIGS. 8A to 8C, the sill 114 includes dual tracks 306 and 308, enabling the respective bottom articulation mechanism 136 of the stile 120 and the lower cover coupling clips 140 to move along the sill 114. The respective upper and lower channels 310A and 310B provide sufficient space within which the rollers 712 of the bottom articulation mechanism 136 of the stile 120 to articulate.

As illustrated, the first track 306 of the sill 114 is coupled with the track support 804 via a support flange 802, forming the two substantially equal upper and lower channels 310A and 310B. The first track 306 has a substantially circular cross-sectional profile that extends along the longitudinal axis 143 of the sill 114, which enables a set of concaved wheels 712 to roll on the first track 306 and rotate about the central longitudinal axis of the substantially circular track 306 while moving transversally across the sill 114. As further illustrated, the entire sill 112 has an outer shell support 806 that provides further structural integrity in terms of added strength to the sill 114 and an aesthetically pleasing look. The second track 308 of the dual track system of the sill 114 include a substantially rectangular cross-sectional profile (with flanges or lips 810A and 810B) that define the second track 308, and which extend longitudinally along the longitudinal axis 143 of the sill 114. The second track 308 enables a set of vertical reinforcement elements 140 to slide within the track 308 while moving transversally across the sill 114.

As with the rollers 712 of the top articulation mechanism 134, the rollers 712 of the bottom articulation mechanism 136 provide pivoting motion 820 in relation to the track 306, which may be construed as the "pitch" articulation. This pitch articulation 820 enables an angle β between a longitudinal axis 139 of the stile 120 and a horizontal plane 145 of the first structure to vary, while the longitudinal axis 139 of the stile 120 remains substantially perpendicular to a longitudinal axis 141 and 143 of the header 112 and sill 114. It should be noted that the wheels are comprised of a ride surface that is concaved with lateral projections that hug the header track 306, thereby preventing the wheels from disconnecting from the tract 306. Accordingly, the concaved rollers around the track profile maintain the stile on the track, and prevent it from disengaging the track.

Figure 8E:
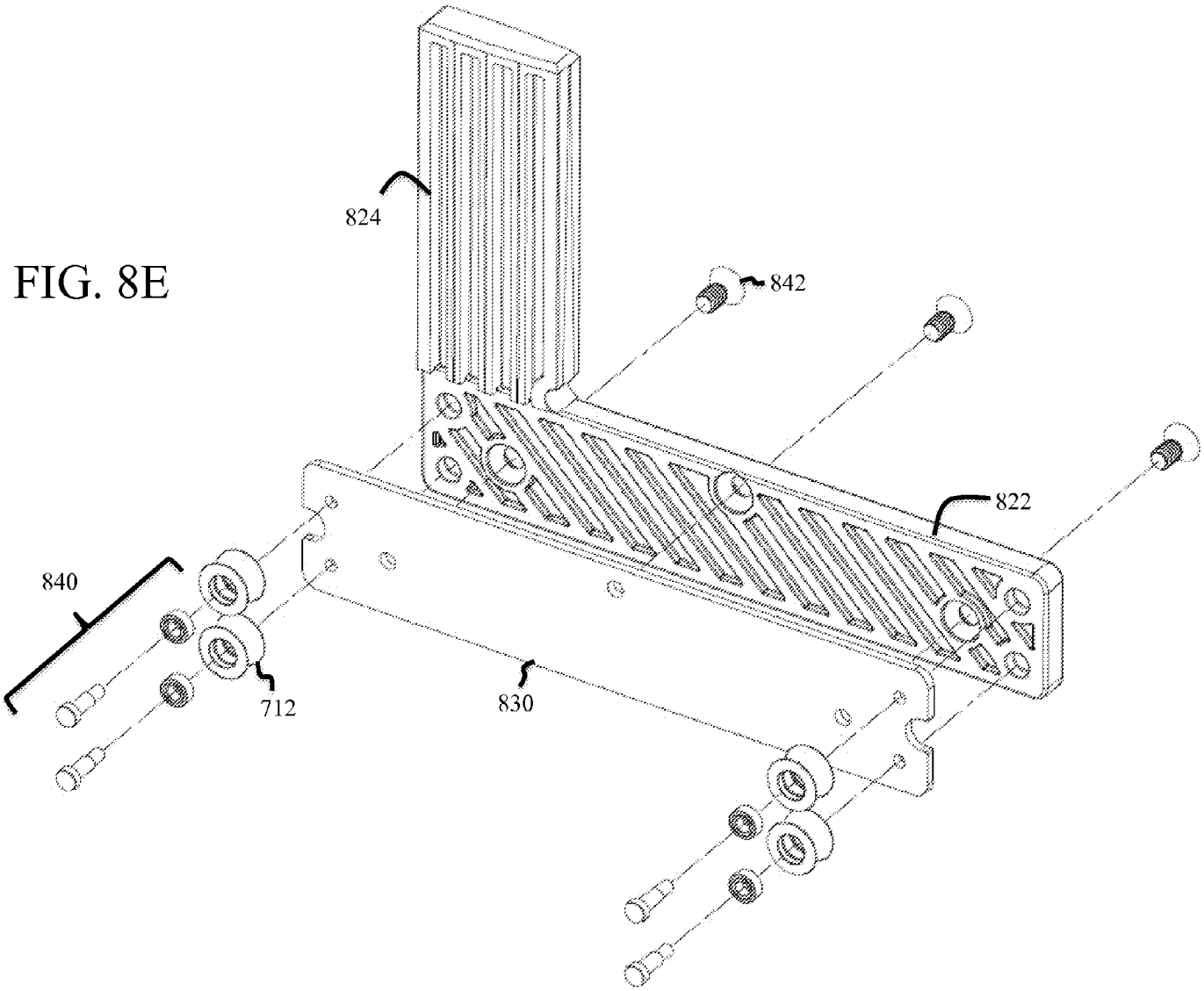

As further illustrated in FIGS. 8C to 8F, the bottom articulation mechanism 136 is comprised of a removable L-shaped beam, which facilitates maintaining the longitudinal axis 139 of the stile 120 substantially perpendicular in relation to the longitudinal axis 143 of the sill 114. The L-shaped beam is a single piece unit with an integral span section 822 that is coupled with the sill 114, and an integral support section 824 substantially perpendicular to the span section 822 that is inserted within a second compartment 826 of the stile 120. The integral support section 824 is housed within the second compartment 826 of the stile 120 located at the bottom distal end section 137 of the stile 120, inserted along the axial length of the second compartment 826 to maintain and support the weight of the stile 120. The span section 822 is oriented parallel the longitudinal axis 143 of the sill 114, and coupled with the sill 114 by a connection module 830 having the set of wheels 712 that are spread out. The separate connection module 830 enables the L-shaped beam to be assembled and coupled with the sill 114 in opposite orientations to enable the hybrid enclosure 100 to open and close in opposite directions to accommodate either left-handed or right-handed installation options. As best illustrated in FIG. 8E, the separate connection module 830 substantially covers a side of the span section 822, and is connected therewith the span 822 by a set of fasteners 842 and the rollers 712, with roller attachments 840.

Figure 8F:
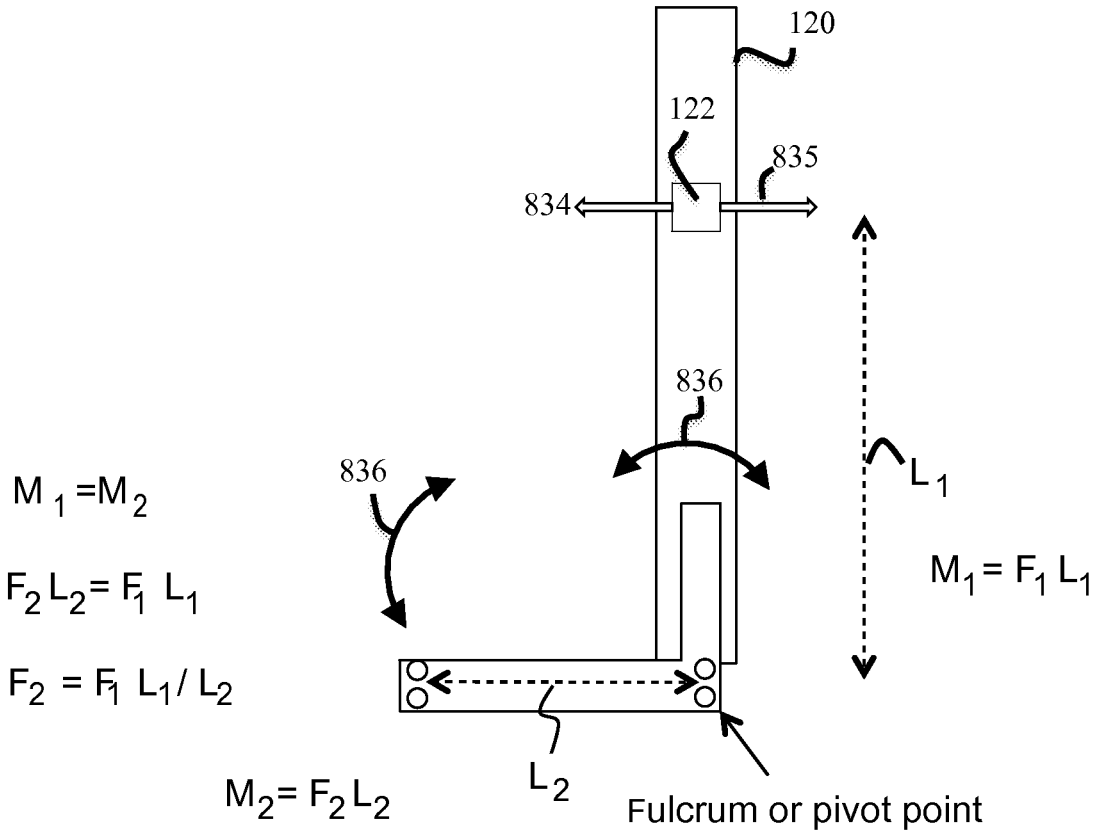

It should be noted that the separation distance 832 between the two sets of roller wheels 712 (best illustrated in FIGS. 8D and 8F) is critical in preventing the stile 120 from in-plane movement when the stile 120 is operational. That is, the length of the span section (in particular the distance 832 between the wheels 712) is of sufficient size so to eliminate in-plane, lateral wobbling of the stile 120 during opening and closing operations. That is, the longitudinal axis of the span section is of sufficient length that in-plane motion of the stile 120 in relation to sill 114 is substantially eliminated, thereby maintaining stability (e.g., substantial perpendicular rigidity) of the stile 120 in relation to the sill 114. The longer length of the span section compensates to minimize the affects of variations in tolerances for the various parts. As importantly, by extending the length or distance 832 between the rollers that are on the span section, the moment arm $L_2$ (FIG. 8F) is extended, which reduces the force $F_2$ exerted on the roller components. This, in turn, reduces the movement of the components (defined by their respect tolerance). As best illustrated in FIG. 8F, when the handle 122 of the stile 120 is pulled in either directions 834 or 835, the force $F_1$ of that pull is leveraged at the fulcrum or pivot point, and translated into a moment (or torque) $M_2$ on the span section 822 of the L-shaped beam. That is, $$M_1=M_2$$

$$F_1L_1=F_2L_2$$

$$F_2=F_1L_1/L_2$$

with $F_1$ equaling the force used on the handle 822 to pull/push the stile 120 and $L_1$ equaling the distance from the location of the applied force to the fulcrum or pivot point. The span $L_2$ is the distance 832 between the wheels 712 on the span section 822, and $F_2$ is the leveraged force 836 experience by the beam. Accordingly, the longer the distance 832 (or the larger the value of $L_2$), the smaller the force 836, providing greater stability by preventing in-plane movement of the stile 120 during its operation.

It should be noted that the present invention should not be limited to the first and second compartments 736 and 826 at the respective top and bottom distal end sections 135 and 137 of the stile 120. That is, the first compartment 736 with its accommodating top articulation mechanism 134 may be located at the bottom distal end section 137 of the stile 120 and the second compartment 826 with its accommodating bottom articulation mechanism 136 located at the top distal end section 135. That is, the first compartment 736 moved to the bottom distal end section 137 of the stile 120 can house the articulation mechanism 134 and all its accompanying components coupled with the sill 112, and with the second compartment 826 moved to the top distal end section 135 of the stile 120 with the L-shaped beam coupled with the header 112.

As a further note regarding the wheels or rollers 712, the track 602 of the header 112 and track 306 of the sill 114 have a substantially circular cross-sectional profile that extends longitudinally along the length of the track and enable the set of concaved rollers 712 to slide on the tracks and rotate radially about the central axial length of the circular tracks while moving transversally across the header and the sill. That is, the wheels 712 are comprised of a ride surface that is concaved with lateral projections that hug the header and sill track profile. The benefit for using concaved wheels is that it enables the wheels to rotate about the axial length of the track sill/header, enabling the stile to move transversally across the header and the sill while maintaining the normal orientation of stile top and bottom distal end with the header/sill. This provides an independent movement of the top distal end section 135 of the stile 120 in relation to the header 112 verse the movement of the bottom distal end section 137 of the stile 120 in relation to the sill 114. Therefore, the wheels riding on the round feature on the track sill/header allow for the rotation of the stile to move beyond the shower space. The same type of wheels is used on both the top and bottom distal end sections 135 and 137 of the stile 120. In addition to facilitating improved articulation, the concaved ride surface of the wheels 712 also provides an anti-jump feature. That is, the concaved rollers with lateral projections that hug the header and sill track profile maintain the stile 120 on the tracks, and prevent it from disengagement. In other words, the lateral projections of the wheels is larger than the outside diameter of the track profile, thereby trapping in within the profile and maintaining smooth operation of the stile.

The present invention further provides a substantially inconspicuous posturing mechanisms associated with the flexible cover 101 to provide proper posture for the flexible cover 101 during operation, confine the flexible cover 101 within the shower area to prevent water leakage, and to provide a look that is esthetically pleasing. The posturing mechanisms include a set of horizontal reinforcement elements 220 and 222 for horizontal posturing of the flexible cover 101 along the upper and lower side 111 and 113, a set of lateral reinforcement elements 224 and 226 for vertical posturing along the respective lateral ends 115 and 117 of the cover 101, and a set of vertical reinforcement elements 138 and 140 for further vertical posturing of the flexible cover 101. In general, the vertical reinforcement elements 138 and 140 are comprised of interlock-guide mechanism 138 and 140 (detailed further below). Therefore, the flexible cover 101 is coupled with the header 112 and sill 114 by a set of vertical reinforcement elements 138 and 140 positioned along a horizontal span of the flexible cover (upper and lower sides 111 and 113), which further aid in the vertical posturing of the entire flexible cover. Non-limiting examples of factors or elements for determining appropriate posture for the cover 101 may exemplarily include the cover folds or pleats when the hybrid enclosure 100 is open or the stretch level of the cover when the hybrid enclosure 100 is closed.

On its own, a stand-alone flexible cover 101 (shown in FIG. 2) is generally loose (not stretched tight or stiff) and can deform easily, and does not maintain appropriate "posture" when coupled with the frame 110 (and the stile 120). In addition, during operation of the hybrid enclosure 100, as sections of the flexible cover collapse to open access to the shower area, the flexible cover generally does not fold (or pleat) appropriately to be esthetically pleasing and, more importantly, various sections of the flexible cover may end outside the shower area, causing water leakage. In order to control appropriate posture and folding, a plurality of individual, vertically oriented support slats may be used (incorporated within the plane of the flexible cover) to provide some level of stiffness to define pleats (or the number and manner of folds during operation of the shower enclosure). However, the addition of vertical slats would take away from the esthetic appearance of a clear, glass-like flexible covering. Accordingly, the hybrid enclosure 100 of the present invention includes the substantially inconspicuous posturing mechanisms associated with the flexible cover to provide proper posture for the flexible cover during operation. The flexible cover of the present invention is properly folded during operation of the hybrid shower enclosure, made to remain within the shower area to prevent water leakage, and looks esthetically pleasing during operation by the addition of the posturing mechanisms. The posturing mechanisms function to create the proper stiffness appropriately commensurate with thickness, length, and height of the flexible cover for proper and esthetically pleasing operation.

Figure 9A:
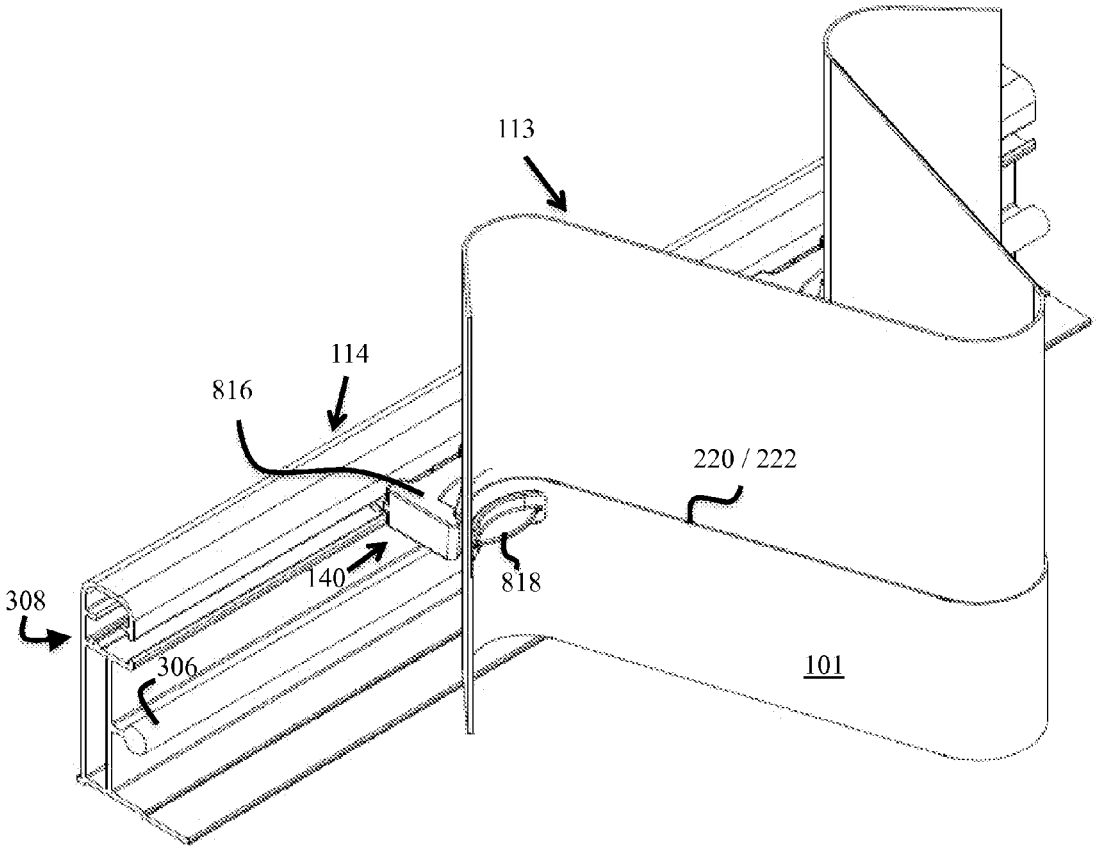
FIGS. 9A to 9I are exemplary illustration of horizontal and vertical reinforcement elements used as posturing mechanisms of the hybrid enclosure illustrated in FIGS. 1A-1 to 8F in accordance with the present invention.
Figure 9B:
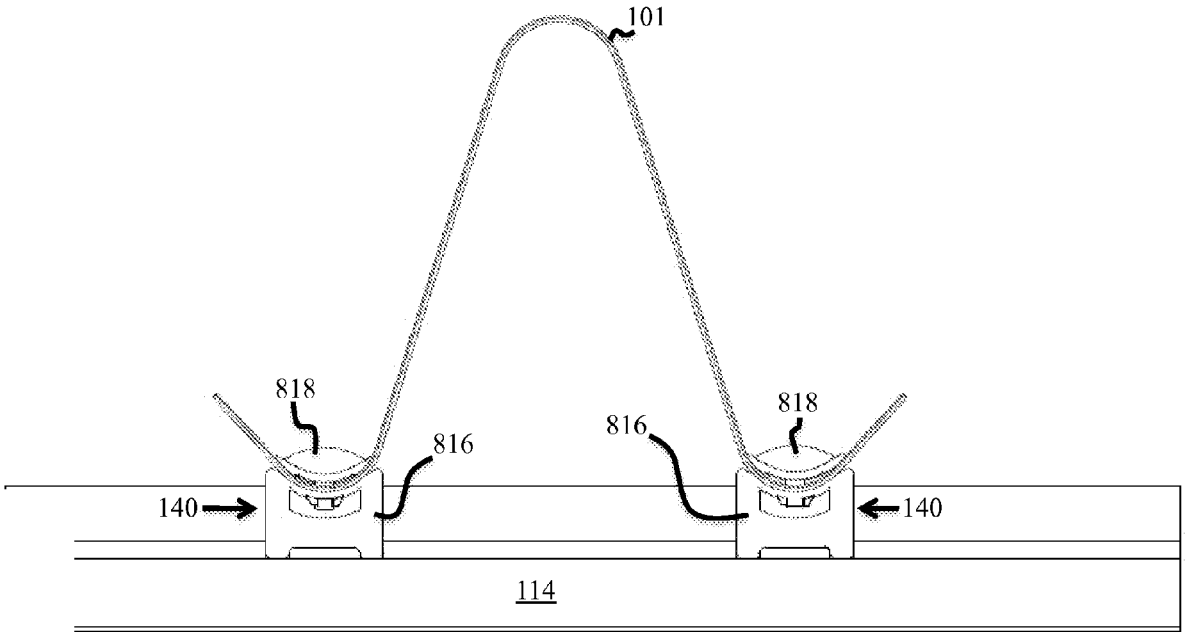
Figure 9C:
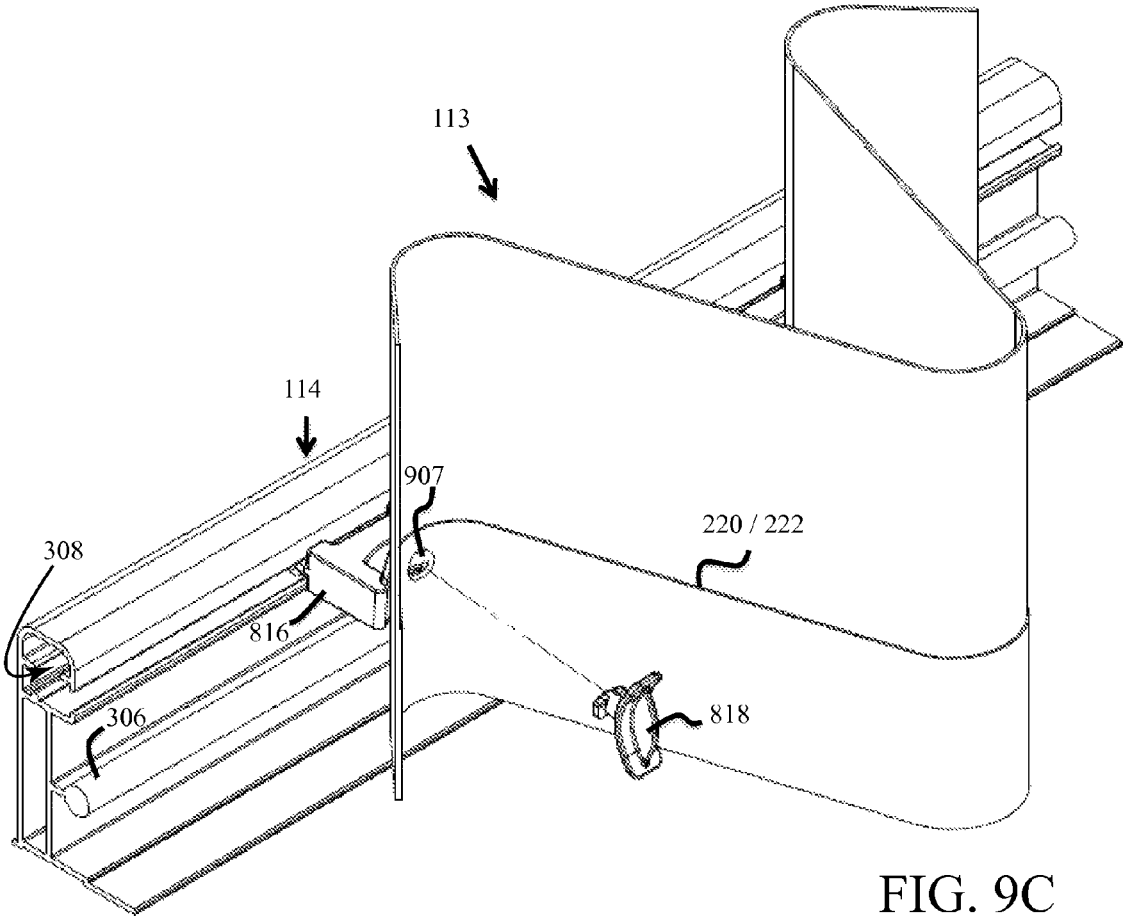
Figure 9D:
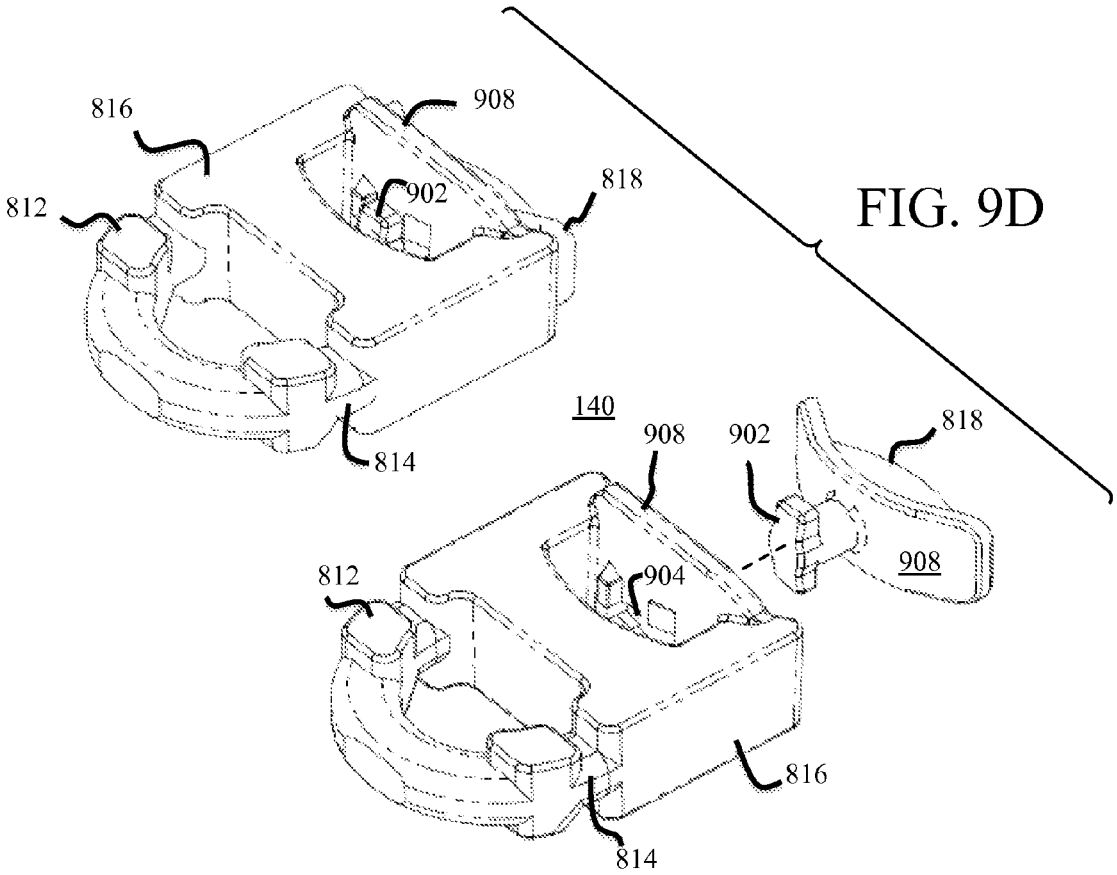
Figure 9E:
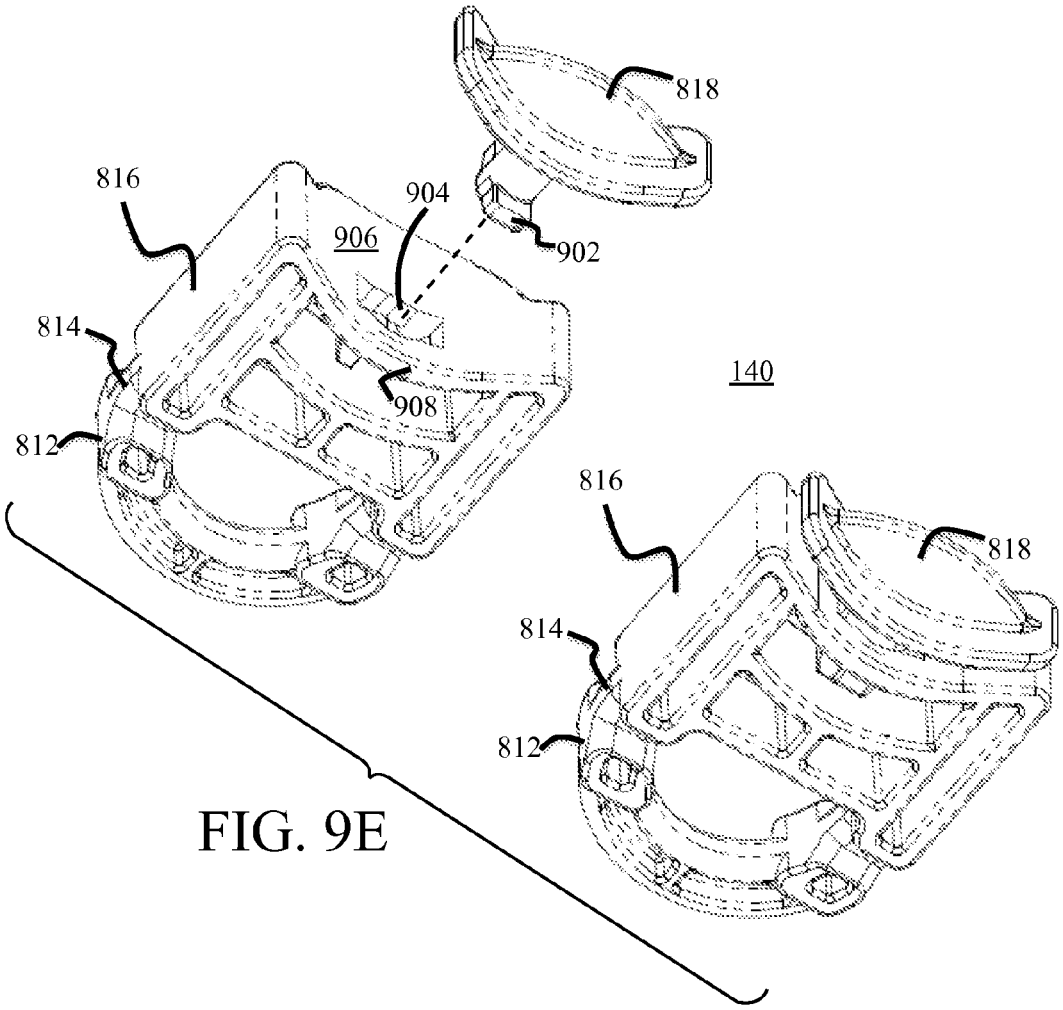
Figure 9F:
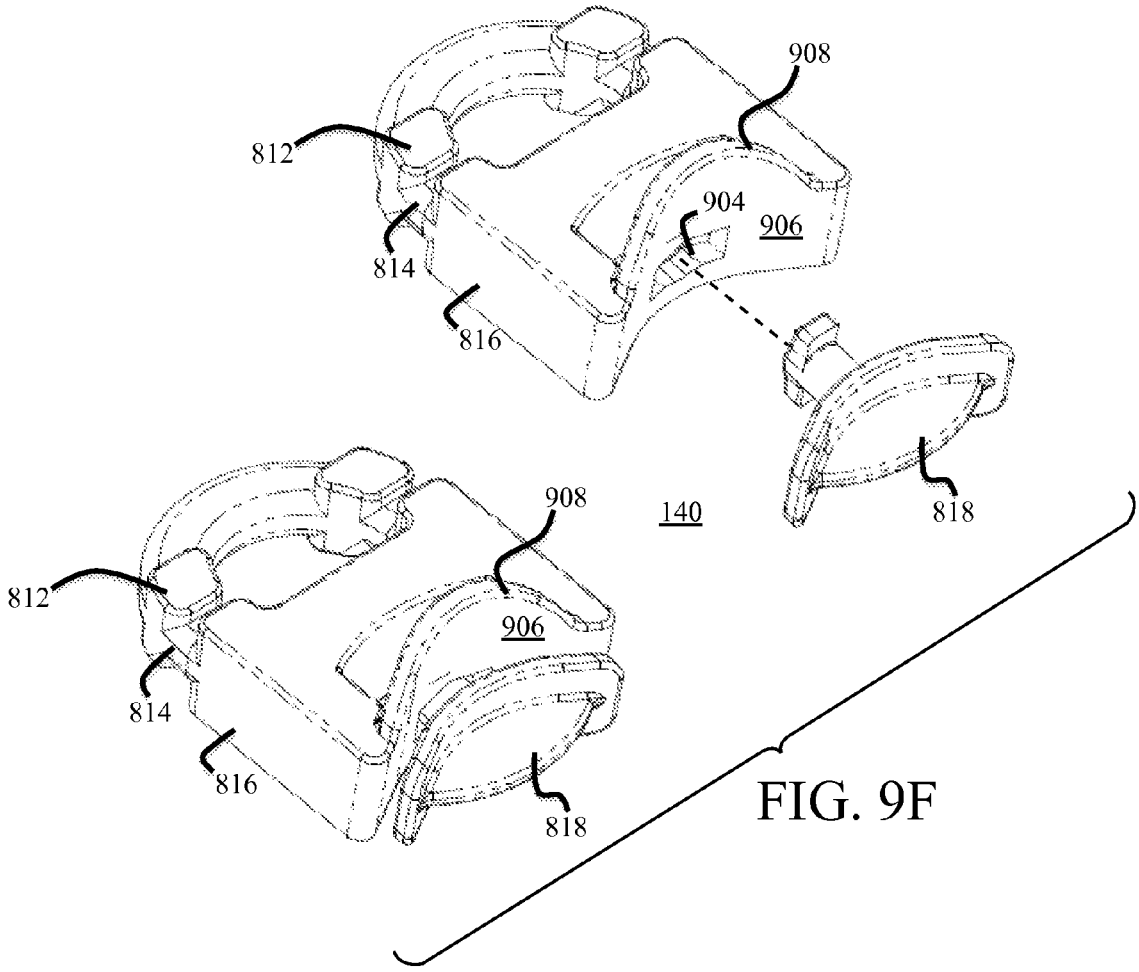
Figure 9G:
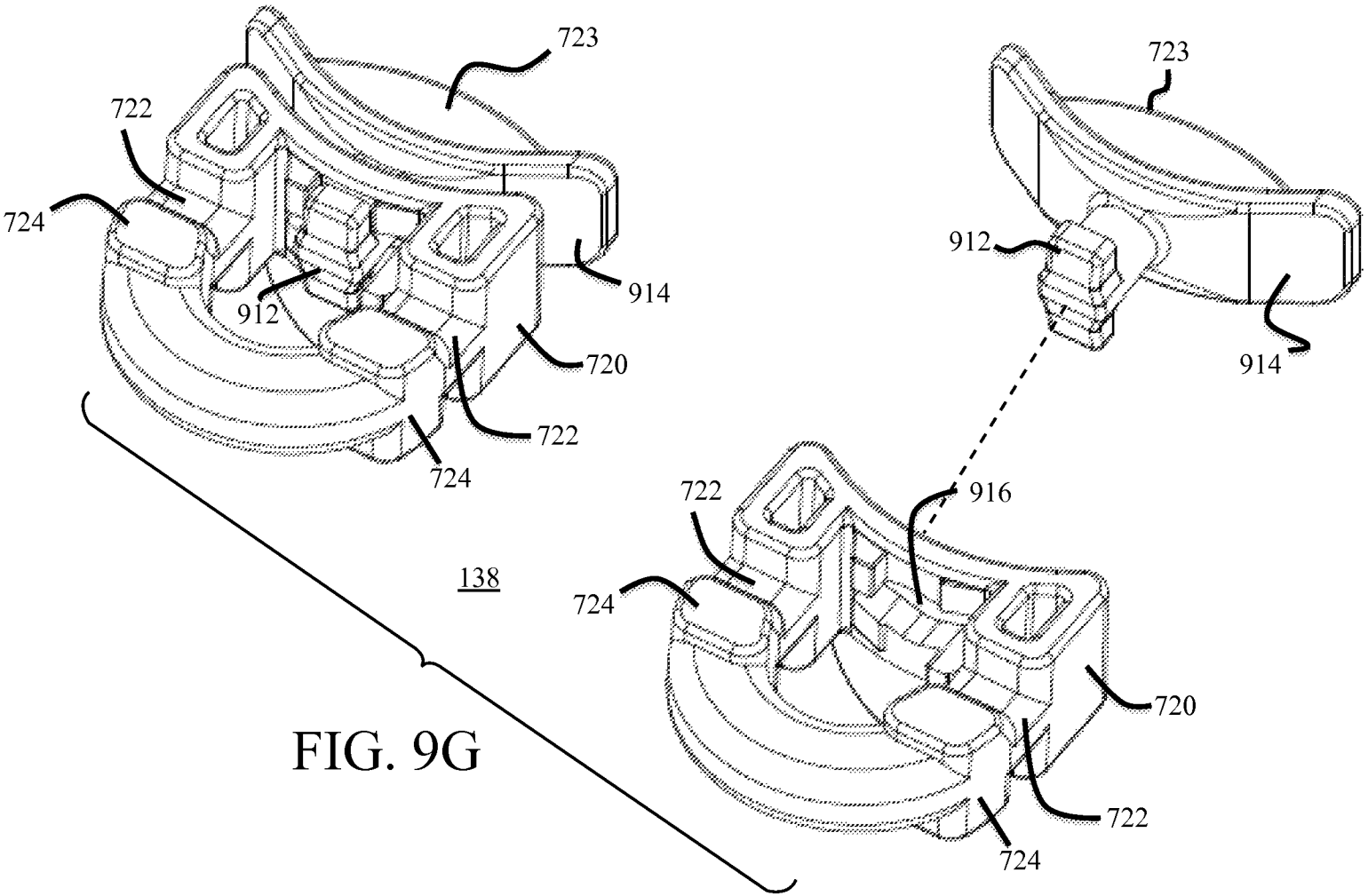
Figure 9H:
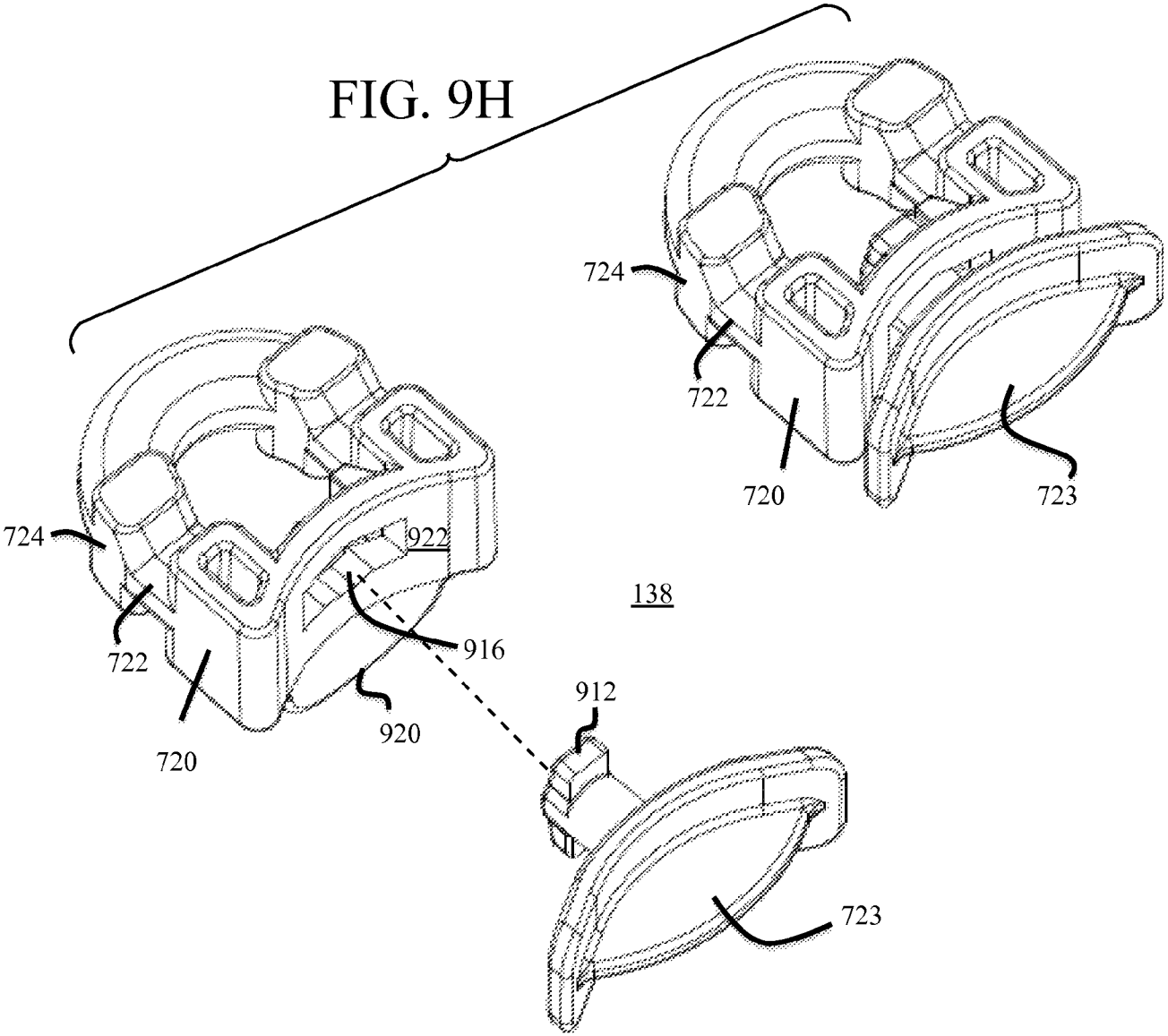
Figure 9I:
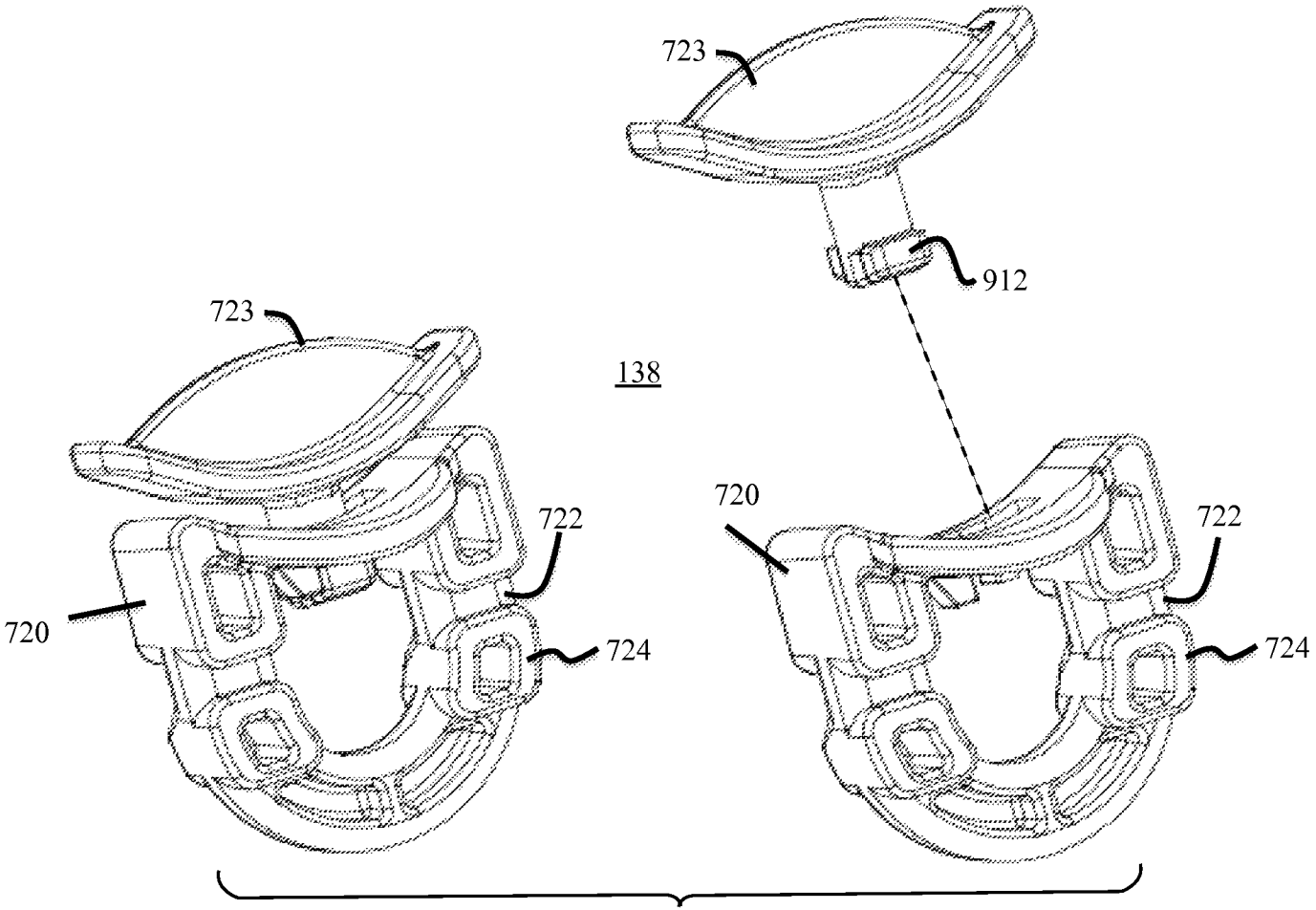

FIGS. 9A to 9I are exemplary illustration of horizontal and vertical reinforcement elements used as posturing mechanisms in accordance with the present invention. As best illustrated in FIGS. 9A to 9C, the posturing mechanisms include the horizontal reinforcement elements 220 and 222, non-limiting exemplary forms of which may include transparent or translucent flexible, but firmer strips or bands of material that add reinforcement across a top and a bottom side 111 and 113 of the flexible cover 101. FIGS. 9A to 9C illustrate the bottom side 113 of the cover 101 in relation to the sill 114, with the top side 111 of the cover 101 in relation to the header 112 being identical (with the except of the vertical reinforcement elements, which is detailed below).

As illustrated in FIGS. 9A to 9C, the added horizontal reinforcement elements 220 and 222 provide some level of stiffness (or rigidity) across the top and the bottom 111 and 113 of the flexible cover 101. In addition to the horizontal reinforcement elements 220 and 222, the posturing mechanism further includes a set of lateral reinforcement elements 224 and 226 for vertical posturing of the cover 101 along the respective lateral ends 115 and 117 of the cover 101 (best illustrated in FIGS. 2, 4A, and 7A). Finally, the posturing mechanisms of the present invention includes the vertical reinforcement elements 138 and 140 that function to detachably couple the horizontal reinforcement mechanisms 220 and 222 of the flexible cover 101 at predetermined locations and angle with the header 112 and the sill 114, and to further facilitate control of the folding of the entire flexible cover 101 from the top and the bottom 111 and 113 by vertically stretching the flexible cover 101.

The horizontal reinforcement elements 220 and 222 function to control the appropriate fold (or pleating) of the flexible cover during operation (the number and the manner of pleats), including retaining the flexible cover fully within the shower area and provide an overall esthetically pleasing look. Accordingly, the horizontal reinforcement elements 220 and 222 across the top and bottom 111 and 113 of the flexible cover 101 are used to control the number and manner of folds (or pleats) of the flexible cover 101 during operation of the hybrid shower enclosure as the sections of the flexible cover collapse to open access to the shower area, and retain the flexible cover 101 within the shower area. More specifically, the manner by which the flexible cover 101 folds is made uniform and within the shower area, with the number of folds proportional with the total longitudinal (or vertical) length of the flexible cover across the access area of the shower space. It should be noted that the a plurality of individual, vertically oriented firmer bands or strips may be used (incorporated within the plane of the flexible cover) to define pleats (or the number and manner of folds) during operation of the shower enclosure, but just as the slats, the vertical bands or strips would take away from the esthetic "look-and-feel" of a soft, flexible, curtain-like covering.

In order to help achieve even a more appropriate and aesthetically pleasing folding or pleating effect during the operation of the hybrid shower enclosure and to assist the horizontal reinforcement elements 220 and 222, the substantially inconspicuous posturing mechanism of the present invention also provides the vertical reinforcement elements 138 and 140 in the form of a non-limiting, exemplary interlock-guide mechanism that stretch and couple the flexible cover 101 with the header 112 and sill 114. In particular, the loose, unsupported sections of the flexible cover 101 in between the interlock-guide mechanisms 138 and 140 simply "hang" and are pulled down or deviated away from a more appropriate, desirable, and aesthetically pleasing parallel relationship with the header 112. The parallel relationship may be achieved by further stiffening the flexible cover, but that would interfere with smooth, easy operation of the hybrid shower enclosure. The addition of the vertical reinforcement elements 138 and 140 in the form of the exemplary interlock-guide mechanism illustrated in FIGS. 9A to 9I enables a vertical stretching action from both the top and bottom 111 and 113 of the cover 101 to provide some level of vertical stiffness to the flexible cover enabling its top and bottom edges 111 and 113 (that are the top and bottom horizontal reinforcement elements 220 and 222) to remain substantially parallel and aligned with the header 112 and the sill 114. In particular, the orientation or angle of the interlock-guide mechanism are such that the upper interlock-guide mechanism 138 are oriented or angled to pull upward the top horizontal reinforcement element 220 (and hence the top 111 of the flexible cover 101). The lower interlock-guide mechanism 140 are oriented or angled to pull downward the bottom horizontal reinforcement element 222 (and hence the bottom 113 of the flexible cover 101). Therefore, the pulling or urging action on opposite sides counters the weight of the flexible cover 101, and vertically stretches the flexible cover to prevent the loose "hang" look, and facilitate correct posture by parallel alignment of the top periphery edge 111 of the flexible cover 101 with the header 112, and the bottom periphery edge 113 with the sill 114. In general, non-limiting, exemplary orientation or angle of the interlock-guide mechanisms 138 and 140 in relation to the header 112 and sill 114 are about 3 or 4 degrees.

Each of the vertical reinforcement elements 138 and 140 are comprised of first piece 818/723 and second piece 816/720, with the flexible cover 100 having holes through which the first piece 818/723 is inserted to interlock with the second piece 816/720, thereby coupling the flexible cover 100 with the vertical reinforcement element 138/140. The first piece 818/723 that is inserted through the hole and interlocks with the second piece 816/720 secures and maintains the flexible cover 100 attach to the vertical reinforcement elements 138 and 140. The flexible cover includes holes 907 at proper positions so to couple with the vertical reinforcement elements 138 and 140. The second piece 816/720 may be called a shade guide because it guides the shade (or cover 101) along its path, it is riding along the inside channel of the header and sill and it guides the path of the flexible cover itself. The first piece 818/723 may be called an internal locking piece (a T-shaped lock) that pass through a hole in the flexible cover (and the stiffener portion) and interface and lock into the shade guide, which is the piece that resides in the channel of the sill/header and slides within the channel along the path of the header and the sill. The T-shaped lock 902/912 is a quarter turn fastener that twists to interlock with the second piece (the shade guide). The T-shaped lock facilitates ease of replace-ability of the flexible cover 101.

As best detailed in the illustrated FIGS. 9A to 9I, the vertical reinforcement elements 138 and 140 couple the cover 101 along its horizontal upper and lower sides 111 and 113 with the respective header 112 and sill 114 via holes 907. The vertical reinforcement elements in the exemplary forms of the interlock-guides 140 (FIGS. 9D to 9F) and 138 (FIGS. 9G to 9I) are comprised of a first detachable respective piece 818 and 723 that interlocks with a second respective piece 816 and 720 by a respective extension 902 and 912 of the first piece 818/723 that is inserted within a respective interlock aperture 904 and 916 of the second piece 816/720. The second piece 816 has a glide section 814 that enables the second piece 816 to glide on the flanges 810A and 810B of second track 308 of the sill 114, and the second piece 720 has a glide section 722 that enables the second piece 720 to glide on the flanges 612 of the second track 610 of the header 112. The respective final interlock sections 812 and 724 of the interlock-guide mechanisms 138 and 140 enable the respective second piece 816 and 720 to movably interlock with the second tracks 308 and 610 at an angle (best illustrated in FIGS. 7D and 8B), which would vertically stretch the cover 101 in opposite directions as described above.

As further illustrated, the interlock-guide mechanisms 138 and 140 are curved along the surfaces at which the respective first piece 818 and 723 joins the respective second piece 816 and 720. That is, the respective surface 908 and 914 of the respective first piece 818 and 723 are convex in relation to the respective concaved surface 906 and 922 of the respective second piece 816 and 720. The convex and concave relationship between the first and second pieces compels the cover 101 (which is interlocked in between, best shown in FIGS. 9A to 9C) to have a slight folding or pleat for a more aesthetically pleasing look. As further illustrated, the respective second piece 816 and 720 of interlock-guide mechanisms 138 and 140 includes a protruded rounded edge in the form of an extended lip 908 and 920, which facilitate in better posturing of the cover 101. In general, extended lip 908 of the interlock-guide mechanisms 138 is oriented or pointed "up" when coupled with the sill 114, and the extended lip 920 of the stretch clip 140 is oriented or pointed "down" when coupled with the header 112. A final distinction between the interlock-guide mechanisms 138 and 140 is that the interlock-guide mechanisms 138 for the sill 114 is larger in size than the interlock-guide mechanisms 140 used with the header 112. One reason for this difference in size between the "upper" interlock-guide mechanisms 140 that are smaller and those of the lower interlock-guide mechanisms 138 that are larger is because the lower ones need to extend further into the shower area to enable the lower articulation mechanism 136 (i.e., the L-shaped beam) to pass between the cover and the sill 114. The lower interlock-guides 140 are also wider in width because the extra width provides further structural integrity in terms of added strength to reduce in-plane horizontal twisting forces.

Figure 10A:
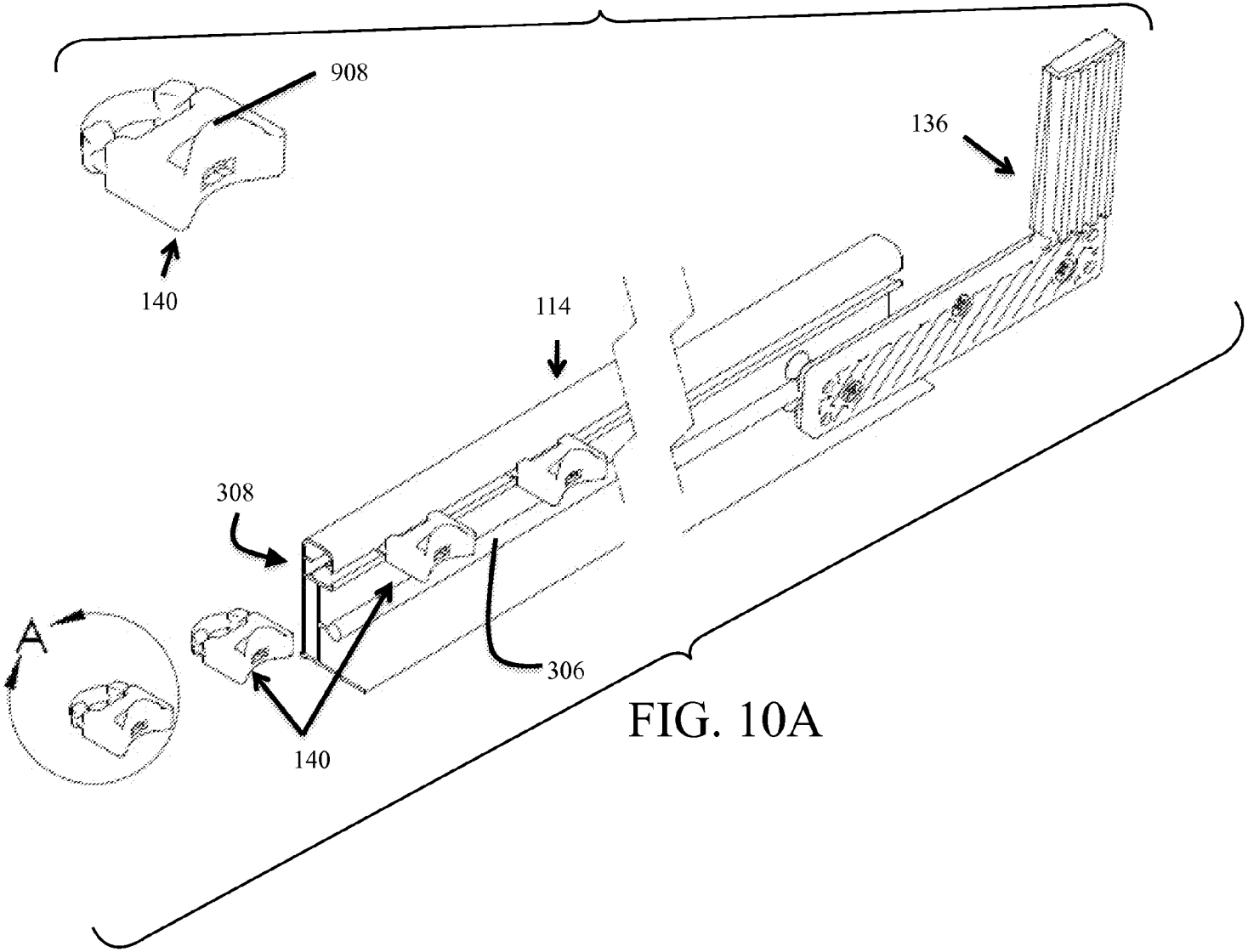
FIGS. 10A to 10H are exemplary illustrations of a method of installing the hybrid enclosure illustrated in FIGS. 1A-1 to 9I of the present invention within a shower area in accordance with the present invention.
Figure 10B:
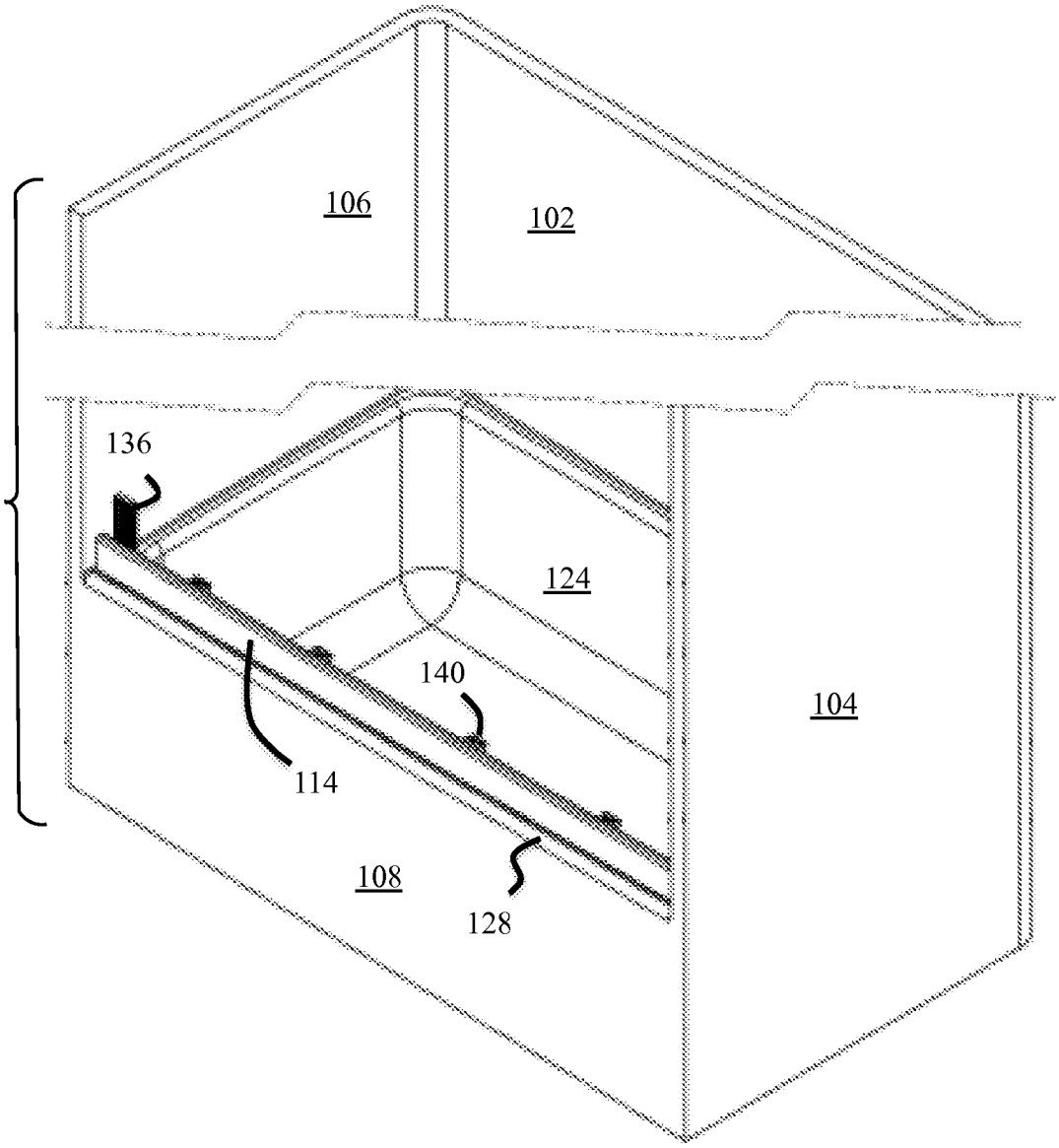
Figure 10C:
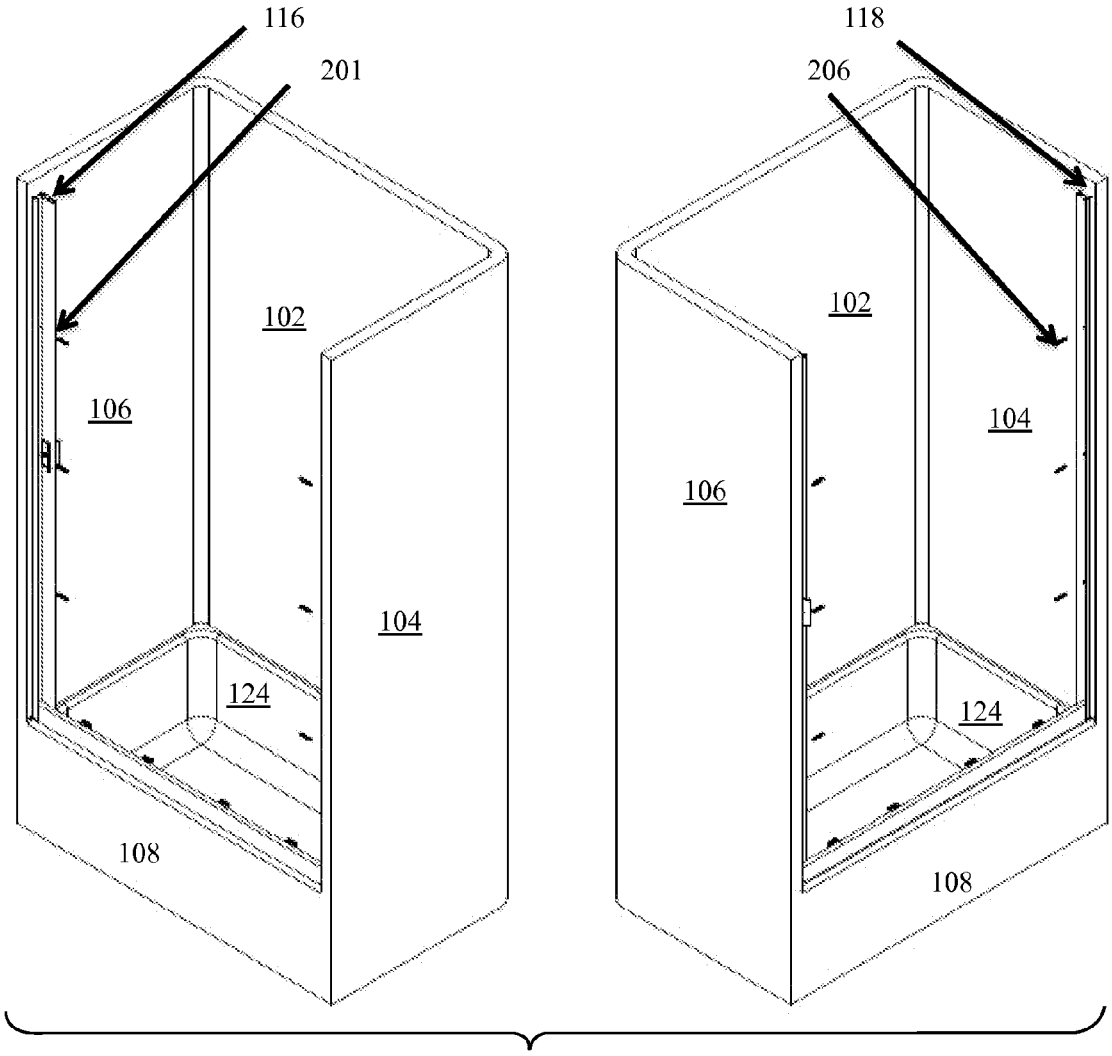

FIGS. 10A to 10H are exemplary illustrations of a method of installing the hybrid enclosure of the present invention within a shower area in accordance with the present invention. A non-limiting exemplary step for installing the hybrid enclosure 100 includes measuring the curb 128 of the first structure to determine the length of the sill 114 to be used therewith. In general, the length of the sill 114 used should be less than the total length of the curb 128 by a sufficient distance to enable room for installation of the wall jambs (FIG. 10C).

As illustrated in FIG. 10A, installation further includes inserting the bottom articulation mechanism 136 onto the first sill track 306 of the sill 114. As described above, the bottom articulation mechanism 136 is comprised of a steel backing 830, and is separate from the L-shaped beam. The separate connection module 830 enables the L-shaped beam to be assembled and coupled with the sill 114 in opposite orientations to enable the hybrid enclosure 100 to open and close in opposite directions to accommodate either left-handed or right-handed installations. This way, the user has the option to install the hybrid enclosure to open the door to the right or to the left. Either way, the wheels are always within the shower area. The direction of opening, and hence, the orientation of the connection of the L-shaped beam in connection with the wheel module (the steel backing) depends on the floor plan of the bathroom. In general, the door is open in a direction that would allow free access to ingress/egress out of the shower area.

The next, a set of first vertical reinforcement elements (the lower vertical reinforcement elements 140) are installed within the sill channel 308 of the sill 114. As indicated above, the vertical reinforcement elements are in the non-limiting, exemplary from of stretch clips that serve as attachment mechanism for the flexible cover 101. Thereafter, as best illustrated in FIG. 10B, the sill 114 is coupled with the first structure. Again, the first structure may be the curb 128 of a tub (basin), the curb of a shower pan or substrate.

Prior to installing the remaining components of the hybrid enclosure 100, a closing-side of the hybrid enclosure for closing-off access to shower space must be determined and, thereafter (as best illustrated in FIG. 10C), commensurately, installing one of the first wall jamb 116 and the second wall jamb 118 on the closing-side, and installing another of the first wall jamb 116 and the second wall jamb 118, opposite the closing side. The installation may be accomplished by a variety of mechanism, one non-limiting example of which may including slipping the wall jambs over the sill 114 and secure them by the use of fastener in non-limiting, exemplary from of one or more screws.

Figure 10D:
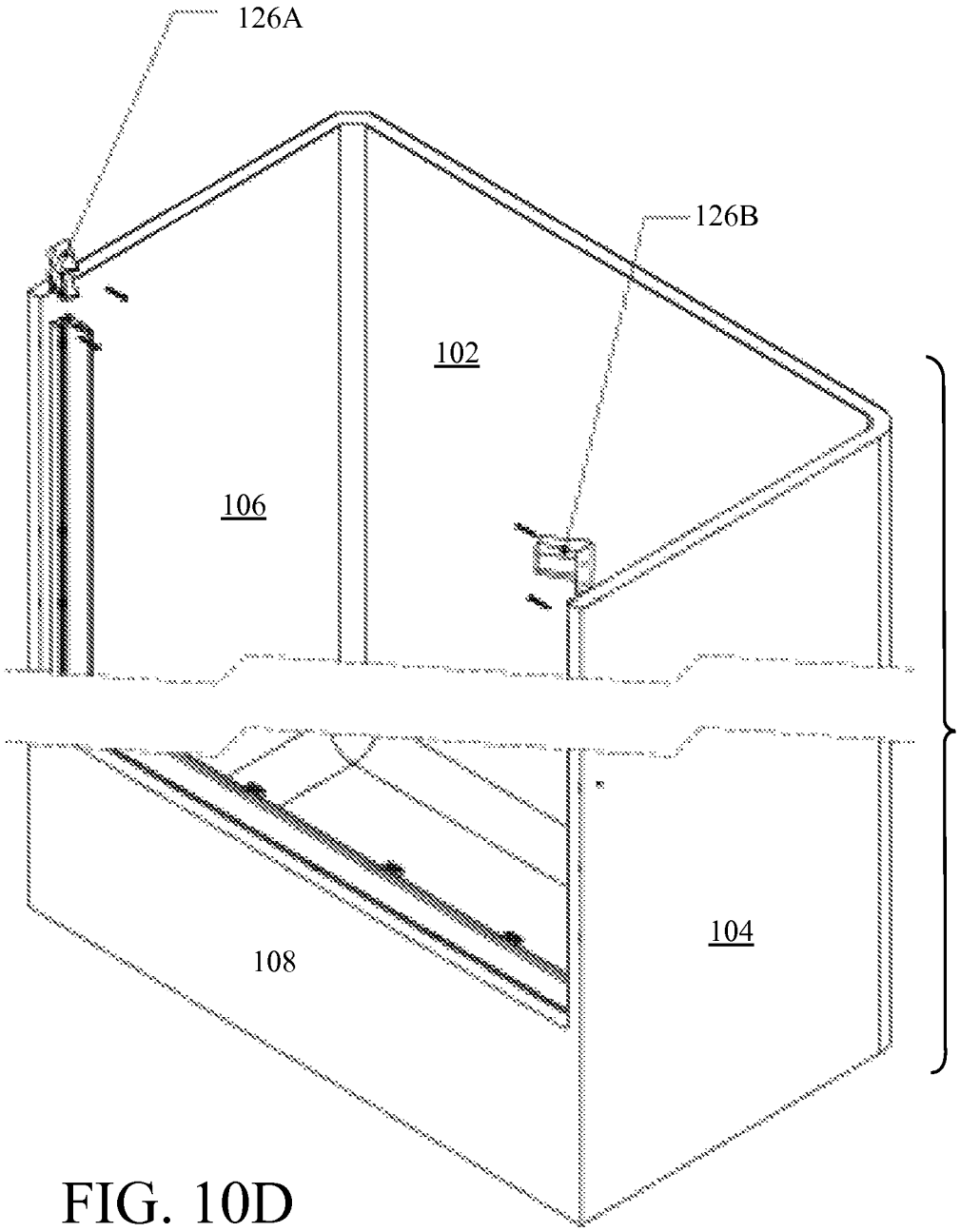

As best illustrated in FIG. 10D, after installing the wall jambs, a set of stability brackets 126A and 126B at upper distal ends of the wall jambs 116 and 118 are installed. The upper most aperture of the upper distal end of the first and second wall jambs 116 and 118 are respectively aligned with a corresponding aperture 418 on an extension portion 416 of the first and second bracket 126A and 126B, both of which are then coupled by the set of fasteners 201.

Figure 10E:
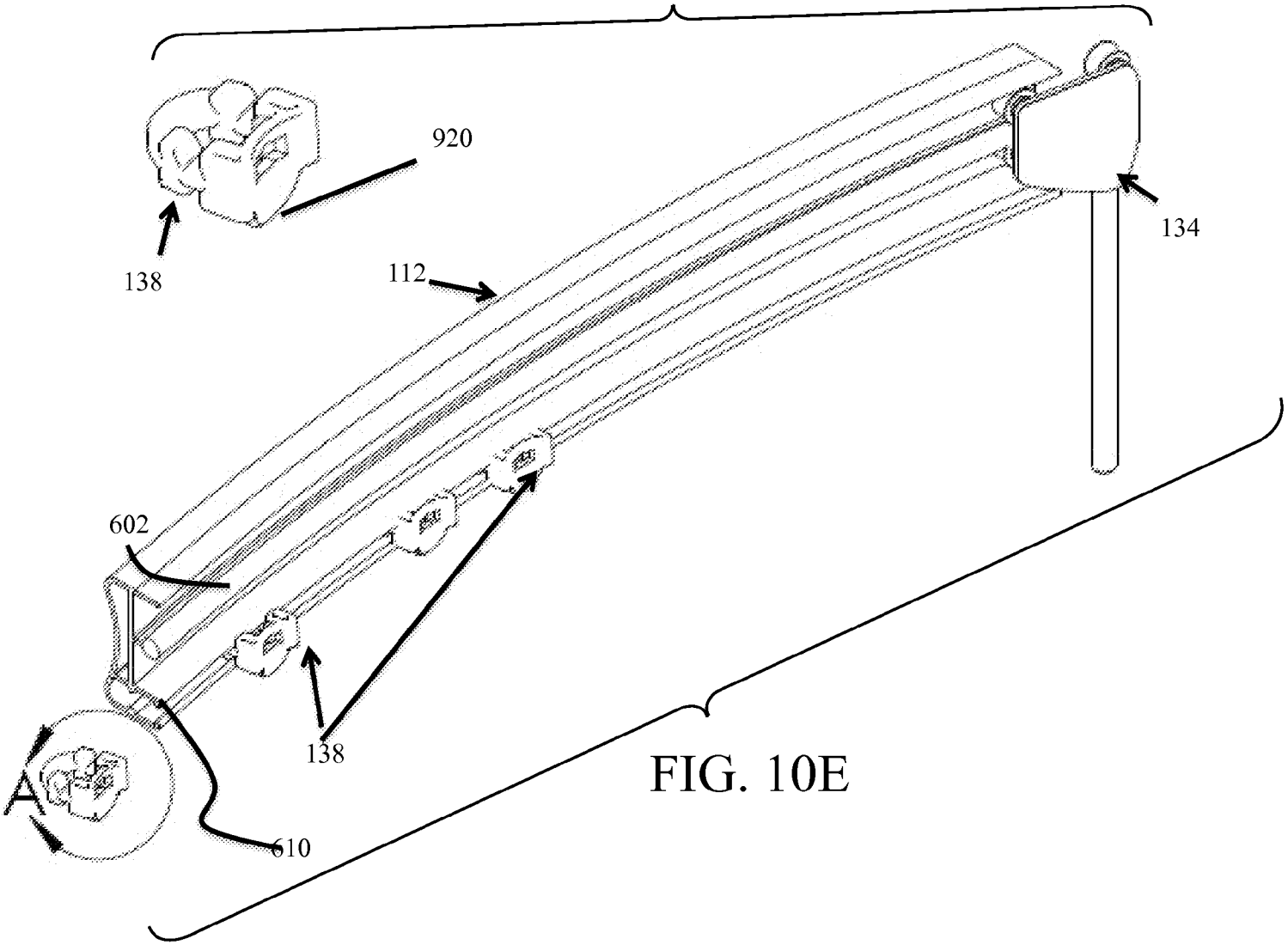

After installing the stability brackets 126A and 126B, the distance between the inside 324 of both brackets 126A and 126B is measured to determine the length of the header 112 to be used for installation and assembly of the hybrid enclosure. As best illustrated in FIG. 10E, once the length of the header 112 is determined and cut accordingly, the second set of vertical reinforcement elements 138 are inserted within a header channel 602 of the header 112, with the extended lip 920 oriented downward. Thereafter, the upper articulation mechanism 134 is inserted onto a header track 602 of the header 112.

Figure 10F:
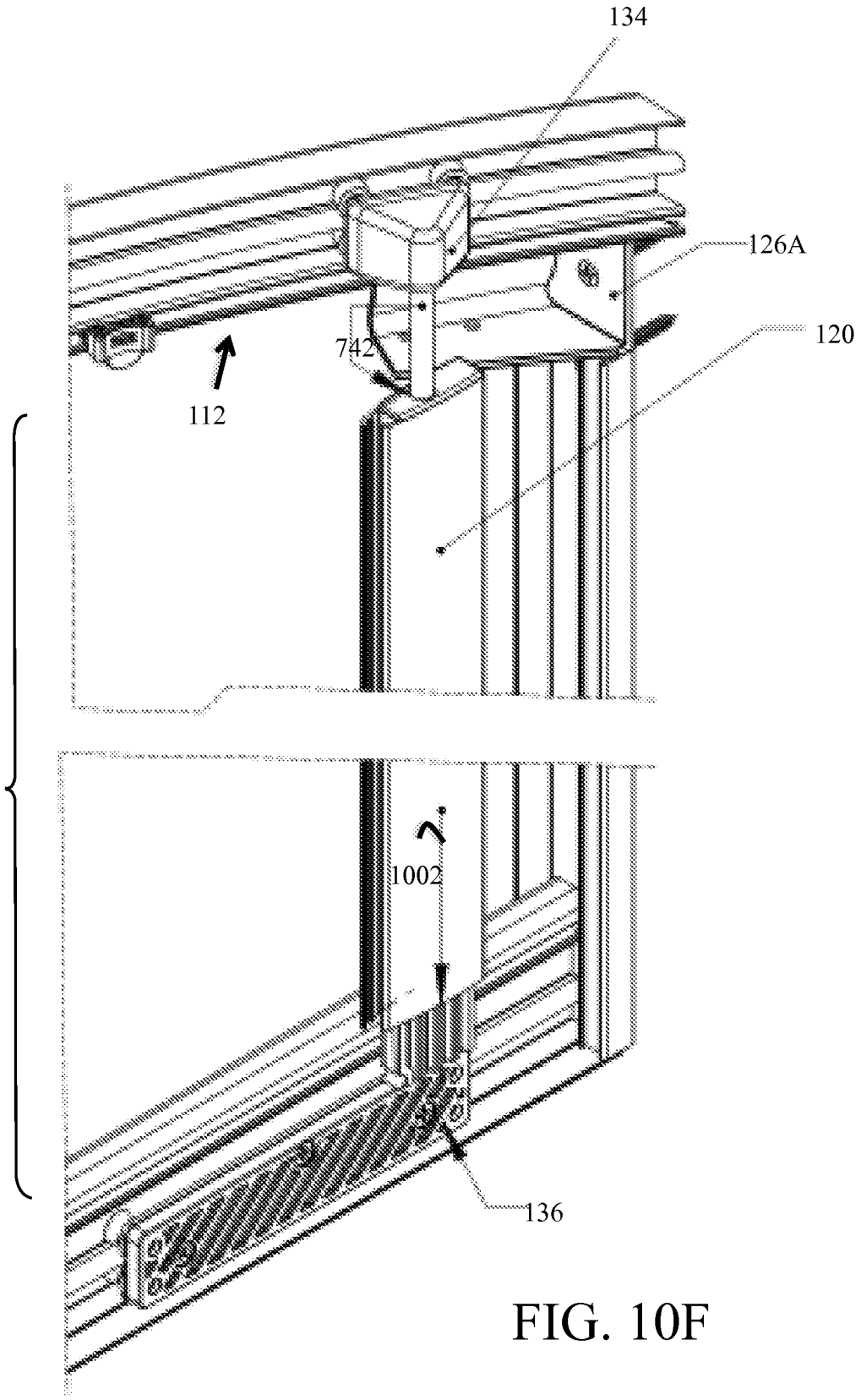

As best illustrated in FIG. 10F, after installing the upper articulation mechanism 134, the lower articulation mechanism 136 is first inserted into the bottom distal end section 137 of the stile 120, the upper articulation mechanism 134 is then inserted into the top distal end section 135 of the stile 120, and finally, the first and second distal ends 103 and 105 of the header 112 is engaged with the stability brackets 126A and 126B.

Figure 10G:
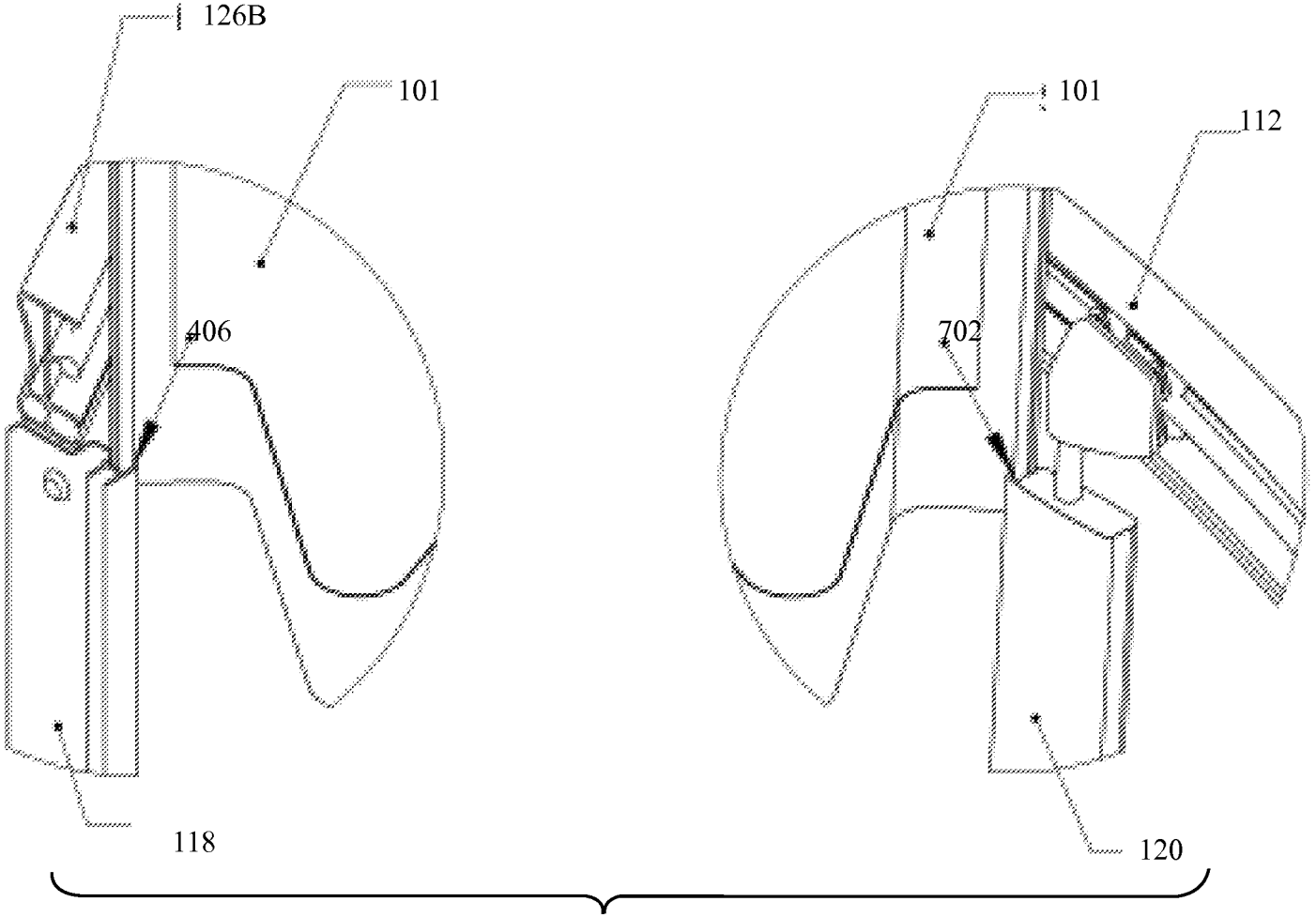
Figure 10H:
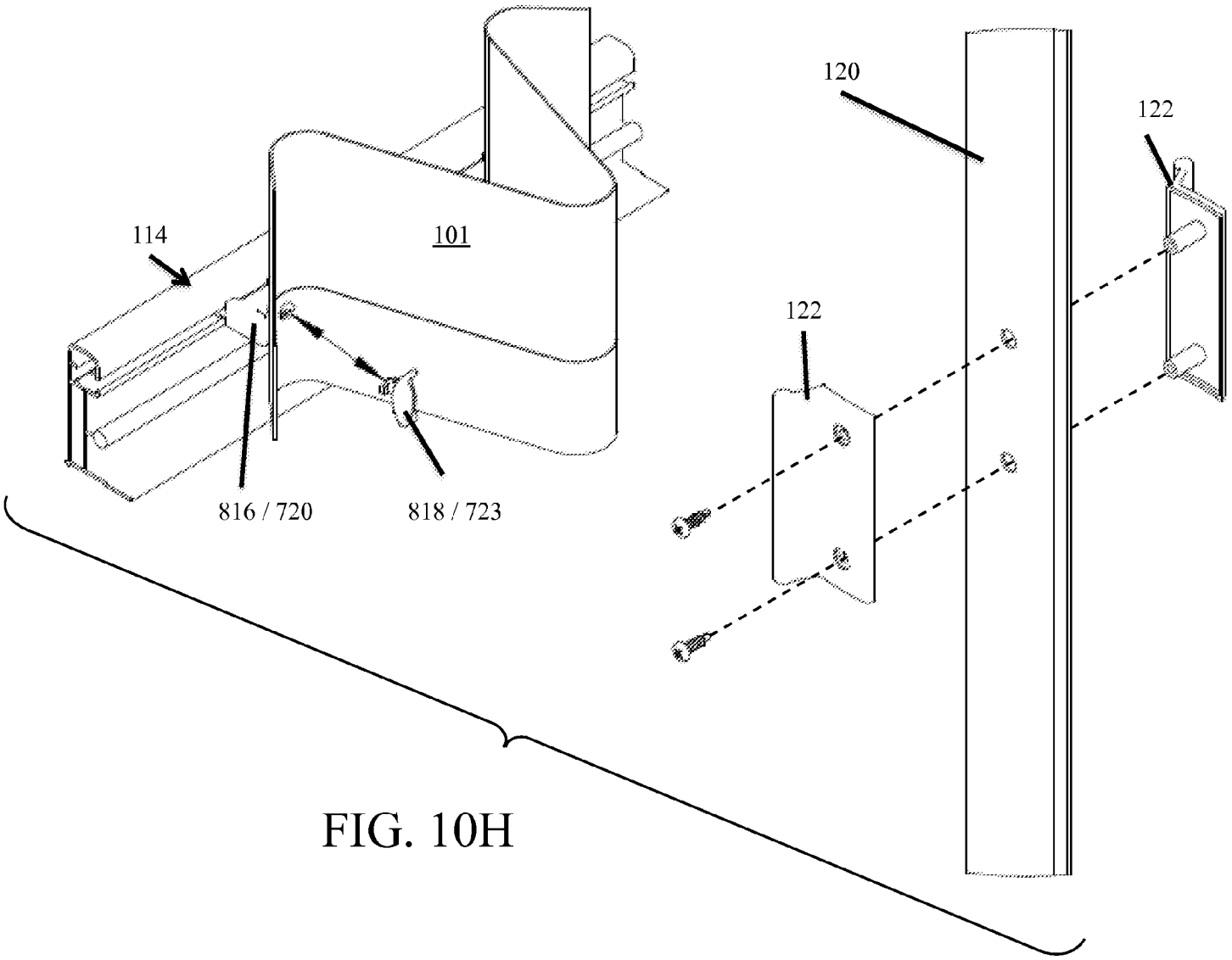

Finally, as illustrated in FIGS. 10G and 10H, the flexible cover 101 is coupled with the stile 120, one of the first and second wall jambs, and the respective first and the second vertical reinforcement elements and of the sill 114 and the header 112. The stile includes the channel 702 that extends longitudinally along the axial length of the stile 120 with a profile that receives a first periphery edge 226 of the flexible cover 101. The one of the first and second wall jambs (in this non-limiting exemplary instance, second wall jamb 118) also includes a channel 406 that extend longitudinally along the axial length of the wall jamb with a profile that receives a second periphery edge 408 of the flexible cover 101. Thereafter, associating the bottom and top 111 and 113 of the flexible cover 101 with a first piece 816 and 720 of the respective first and second vertical reinforcement elements 138 and 140. It should be noted that there is a pre-drilled hole on the top and bottom 111 and 113 of the flexible cover (through the stiffener also). The flexible cover 101 is engaged with the first piece 816 and 720 by inserting the first piece through these holes. Then, the second piece (the T-shaped interlock) 818/723 of the respective first and second vertical reinforcement is passed through the holes to engage with and interlock with the first piece 816/720, securely mounting the flexible cover with the sill and the header. As a final step, the stile handle 122 is coupled with the stile 120 for assembly of the hybrid enclosure.

Figure 11A:
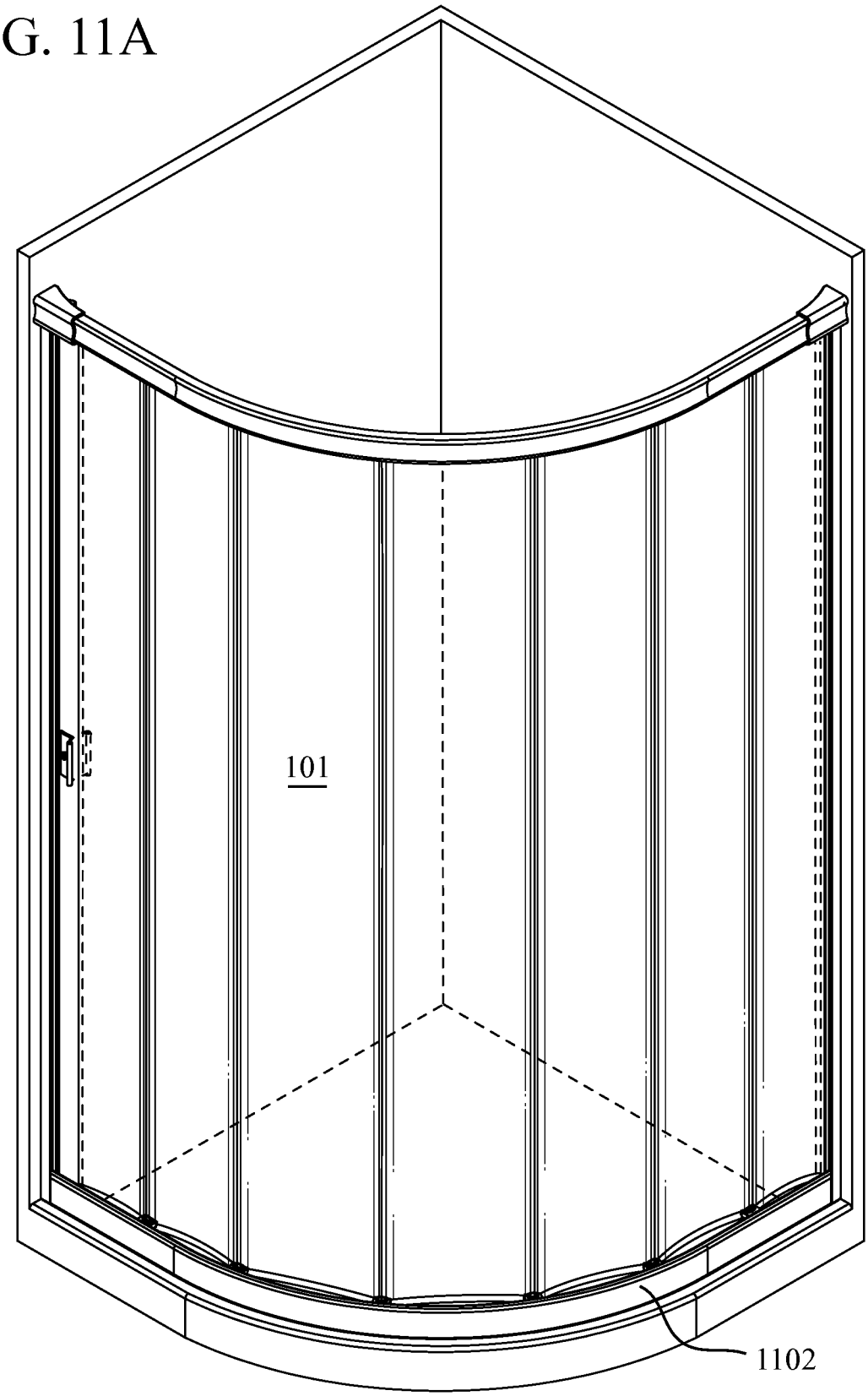
FIGS. 11A to 11C are exemplary illustrations of a hybrid enclosure used with in a corner-shower area in accordance with the present invention.
Figure 11B:
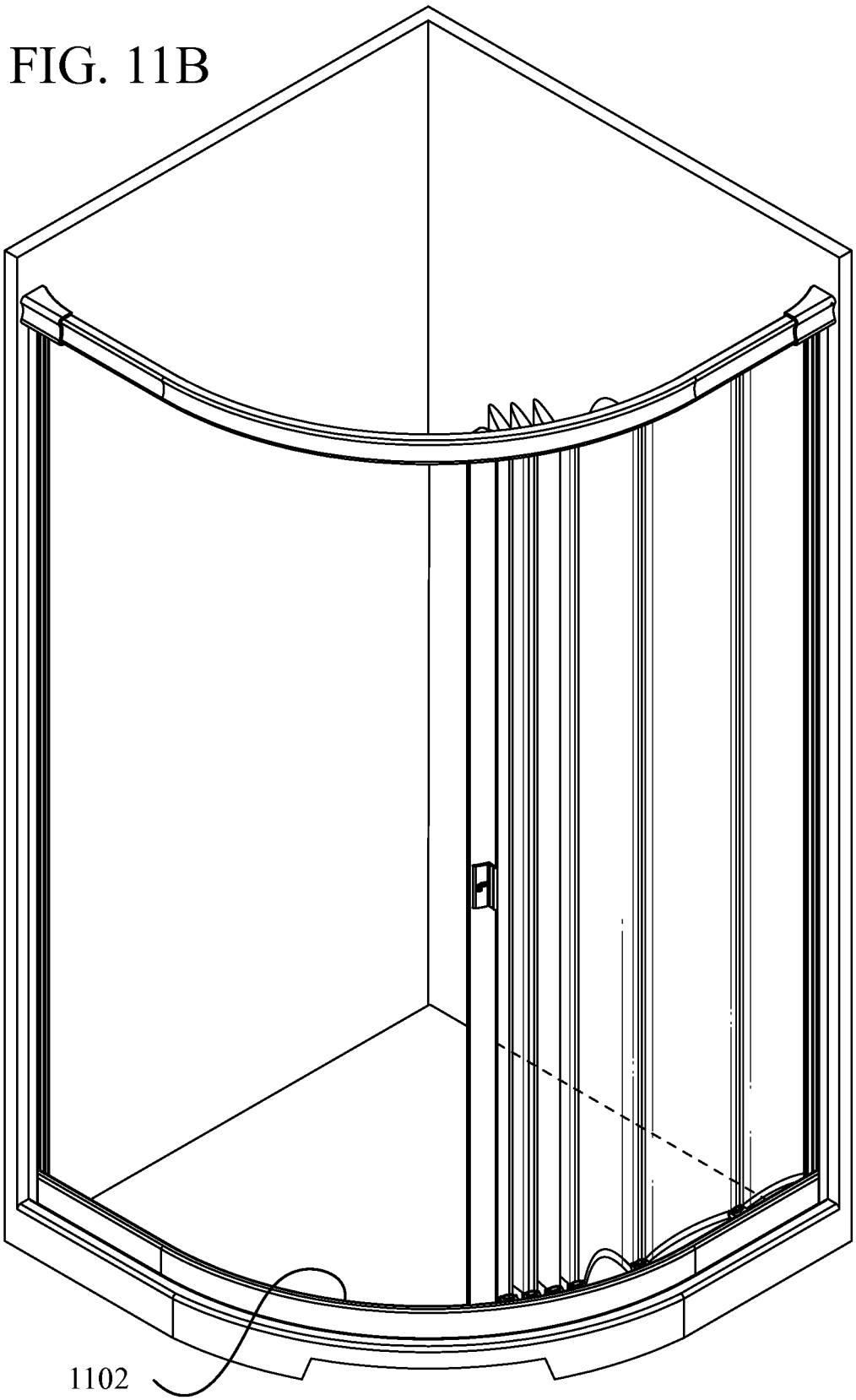
Figure 11C:
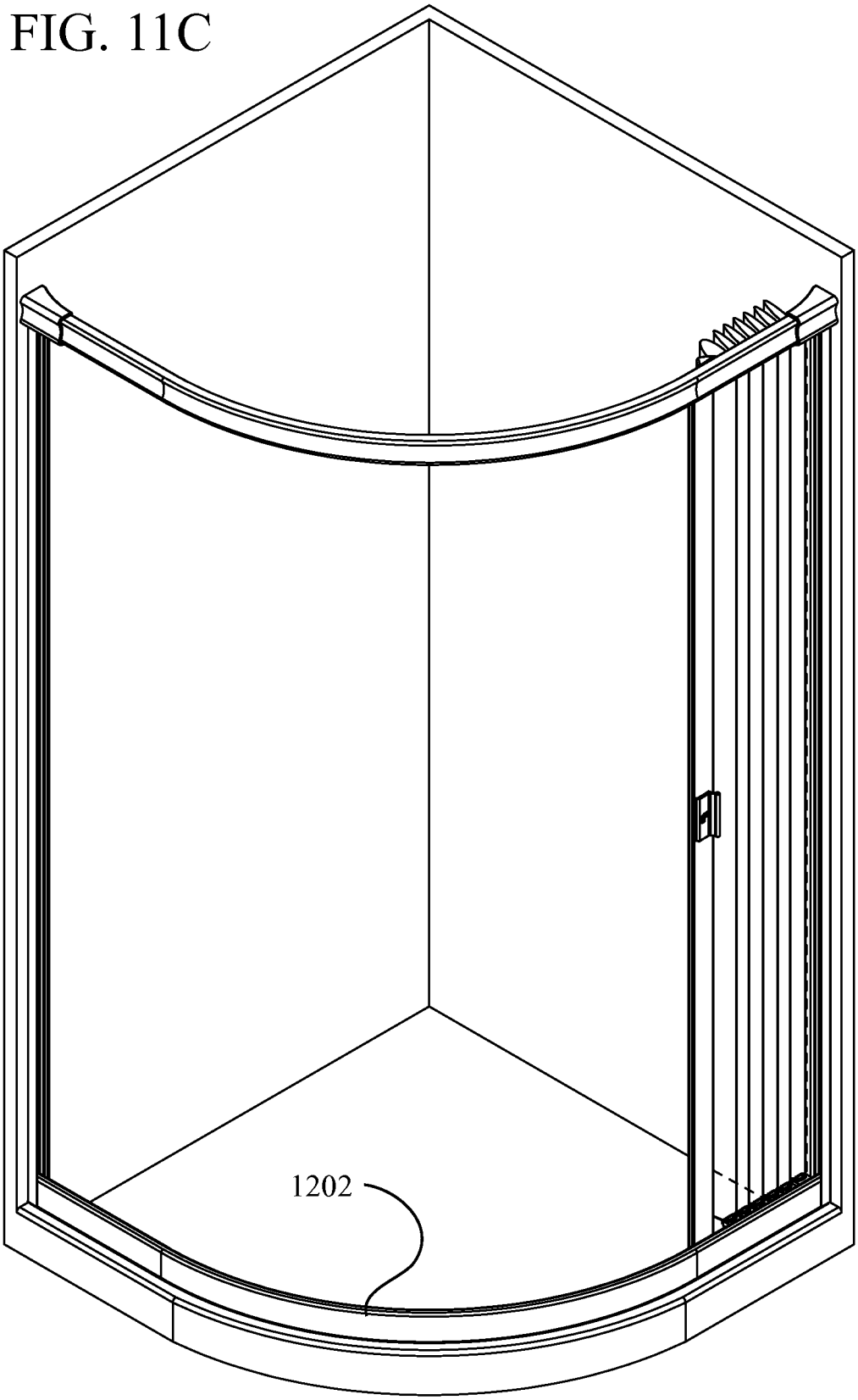

FIGS. 11A to 11C are exemplary illustrations of a hybrid enclosure used with in a corner-shower area in accordance with the present invention. The hybrid enclosure 1100 of FIGS. 11A to 11C includes similar corresponding or equivalent components, interconnections, and or cooperative relationships as the hybrid enclosure 100 that is shown in FIGS. 1A-1 to 10H, and described above. Therefore, for the sake of brevity, clarity, convenience, and to avoid duplication, the general description of FIGS. 11A to 11C will not repeat every corresponding or equivalent component and or interconnections that has already been described above in relation to hybrid enclosure 100 that is shown in FIGS. 1A-1 to 10H.

As illustrated in FIGS. 11A to 11C, the hybrid enclosure 1100 is comprised of a curved header 112 and a curved sill 1102. In this particular instance, the axial length 121 of the stile 122 of the hybrid enclosure 1100 need not vary since the longitudinal axis 141 of the header 112 and the longitudinal axis 143 of the sill 1102 do coincide (or exist) within same vertical plane. Stated otherwise, since a vertical plane passing through the longitudinal axis 141 of the header 112 is the same as the vertical plane passing through the longitudinal axis 143 of the sill 1102, then the axial length 121 of the stile 122 along is longitudinal axis 139 need not vary.

Figure 12:
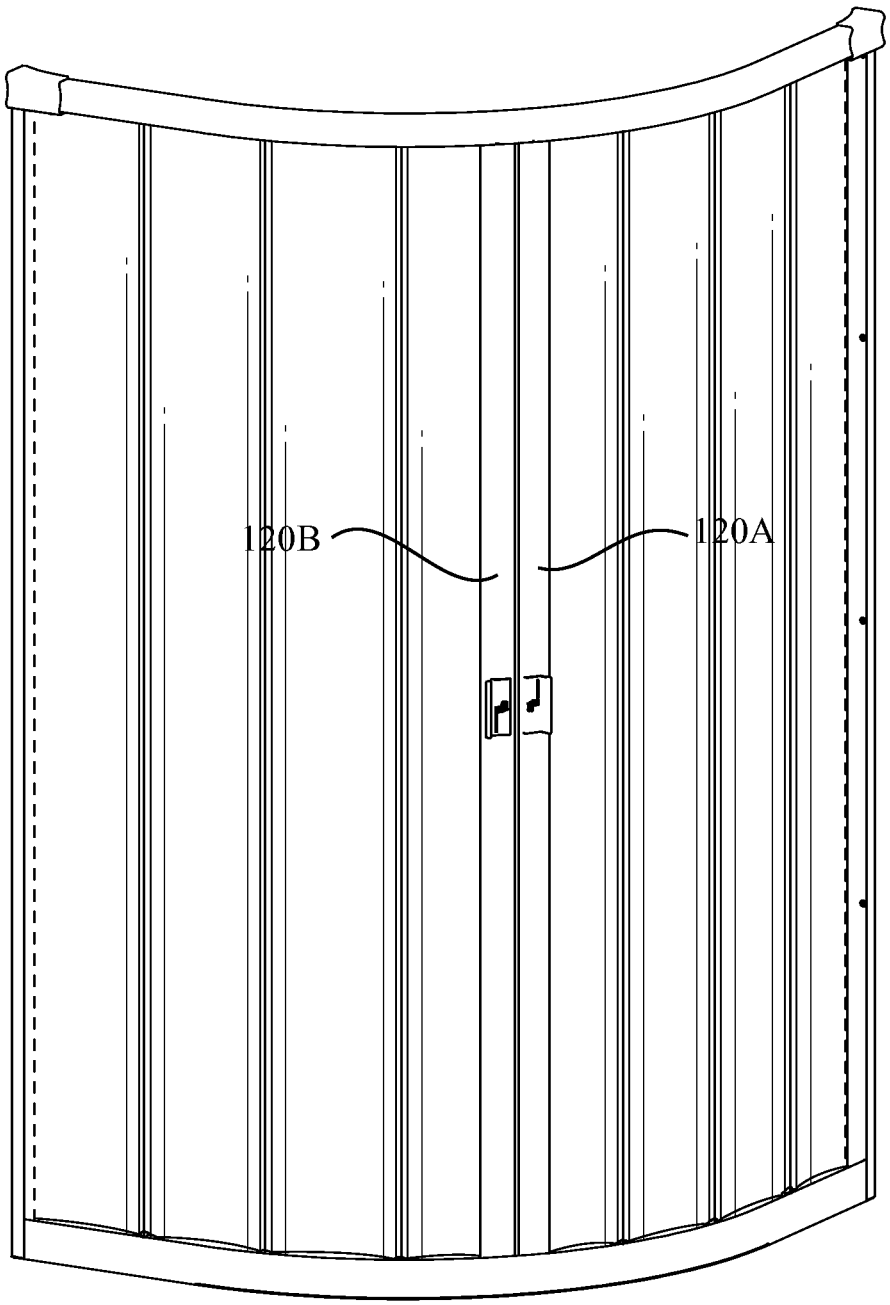
FIG. 12 is an exemplary illustration of a hybrid enclosure used with in a corner-shower area using two stiles in accordance with the present invention.

FIG. 12 is an exemplary illustration of a hybrid enclosure used with in a corner-shower area in accordance with the present invention. The hybrid enclosure 1200 of FIG. 12 includes similar corresponding or equivalent components, interconnections, and or cooperative relationships as the hybrid enclosure 100 and 1100 that are shown in FIGS. 1A-1 to 11C, and described above. Therefore, for the sake of brevity, clarity, convenience, and to avoid duplication, the general description of FIG. 12 will not repeat every corresponding or equivalent component and or interconnections that has already been described above in relation to hybrid enclosure 100 and 1100 that are shown in FIGS. 1A-1 to 11C.

As illustrated in FIG. 12, the hybrid enclosure 1200 is comprised of two stiles 120A and 120B, rather the single stile 120 illustrated in FIGS. 1A-1 to 11C. In this particular instance, ingress/egress into and from a shower area is accessed from the middle rather than one of the distal ends of the header/sill.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A hybrid enclosure, comprising:

a cover coupled with a frame and at least one stile that functions to confine a space;

the stile has an axial length that varies longitudinally during operation;

the frame includes:

a sill;

a header;

a first jamb and a second jamb coupled between the sill and the header at a respective first and second distal ends of the sill and the header; and wherein: the cover has an upper and lower sides coupled respectively with header and sill, and a first and a second lateral ends coupled with one of the respective first jamb or second jamb, and at least one stile;

the header is curved, extending beyond a contour of a first structure;

the stile includes an extension element that moves longitudinally along the axial length of the stile to vary a reach of the stile in relation to the header and the sill as the stile moves along a reciprocating path, thereby varying the axial length of the stile to enable articulation of the stile along the curved header, and one of a straight, curved, and the combination of straight and curved configuration sill;

the extension element is coupled with an articulation mechanism that houses a set of rollers that ride along a track of the header, with the articulation mechanism rotating about a longitudinal axis of the extension element to enable the stile to articulate around the curved header.

2. The hybrid enclosure as set forth in claim 1, wherein:

the sill is coupled with a first structure.

3. The hybrid enclosure as set forth in claim 2, wherein:

the sill has a length that extends longitudinally along a length of the first structure.

4. The hybrid enclosure as set forth in claim 2, wherein:

the sill has a length that conforms to a contour length of the first structure;

and the header is configured independent of the sill contour length.

5. The hybrid enclosure as set forth in claim 1, wherein:

while the stile articulates around the curved header at a top distal end of the stile, the stile is continuously and progressively contracted longitudinally along the axial length of the stile as the stile moves along a reciprocating path towards the first and second distal ends of the header and the sill, and is fully contracted at the first and second distal ends;

the stile is continuously and progressively extended longitudinally along the axial length of the stile as the stile moves along the reciprocating path towards an apex of the curved header, and is fully extended at the apex.

6. The hybrid enclosure as set forth in claim 1, wherein:

the sill has one of a straight, a curved, and a combination of straight and curved configuration.

7. The hybrid enclosure as set forth in claim 1, wherein:

the stile includes a first housing at the top distal end of the stile, within which the extension element is housed and reciprocally moves to vary the axial length of the stile.

8. The hybrid enclosure as set forth in claim 1, wherein:

an angle between a longitudinal axis of the stile and a horizontal plane of the first structure varies, while the longitudinal axis of the stile remains substantially perpendicular to a longitudinal axis of the header and sill.

9. The hybrid enclosure as set forth in claim 8, wherein:

the longitudinal axis of the stile is maintained substantially perpendicular in relation to the longitudinal axis of the sill by a L-shaped beam.

10. The hybrid enclosure as set forth in claim 9, wherein:

the L-shaped beam has an integral span section that is coupled with a sill track, and an integral support section substantially perpendicular the span section that is coupled with the stile.

11. The hybrid enclosure as set forth in claim 10, wherein:

the integral support section is housed within the stile at a bottom distal end of the stile, inserted along the axial length of the stile to maintain and support a weight of the stile; and an axial length of the span section is oriented parallel the axial length of the sill, and coupled with the sill track by a connection module having a set of wheels that ride along the sill track.

12. The hybrid enclosure as set forth in claim 1, further comprising:

a posturing mechanism associated with the cover to provide proper posture for the cover during operation.

13. The hybrid enclosure as set forth in claim 12, wherein:
the posturing mechanism includes:
horizontal reinforcement for horizontal posturing of the cover;
lateral reinforcement elements for vertical posturing of the distal lateral ends of cover.

14. The hybrid enclosure as set forth in claim 13, wherein
the cover is coupled with the header and sill by a set of vertical reinforcement elements positioned along a horizontal span of the cover, which aid in the vertical posturing of the entire cover.

15. The hybrid enclosure as set forth in claim 13, wherein:
the lateral reinforcement elements of the cover are detachably coupled with one of the first and second wall jamb and the stile.

16. A posturing mechanism for a cover, comprising:
first and second horizontal reinforcement elements that include horizontally oriented stiffeners that add reinforcement horizontally across upper and lower end of the cover;
integral first and second lateral reinforcement elements are comprised of interlock ends having cross-sectional profiles that extend longitudinally along a length of first and second lateral ends of the cover, and mate and interlock with a mating structure; and
vertical reinforcement elements that are associated with the first and second horizontal reinforcement elements at predetermined locations.

17. The posturing mechanism for a cover as set forth in claim 16, wherein:
the vertical reinforcement elements are comprised of guide mechanisms that maintain and hold the cover in a generally vertical orientation.

18. The posturing mechanism for a cover as set forth in claim 17, wherein:
guide mechanisms are oriented towards a first direction at a first angle to pull upward the first horizontal reinforcement element.

19. A stile, comprising:
an adjustable mechanism that includes:
adjustable members with translation, axial, and rotation motions to adjust stile position, extension, and orientation.

20. The stile as set forth in claim 19, wherein:
the adjustable mechanism is comprised of a top adjustment mechanism positioned at a top distal end of the stile and a bottom adjustment mechanism positioned at a bottom distal end of stile.

21. A stile, comprising:
adjustable members that provide for:
a translation that moves the stile along a reciprocating path;
an axial motion that varies during operation of the stile to longitudinally vary an axial length of the stile;
a rotational motion that varies an angular tilt between a longitudinal axis of the stile in relation to a horizontal plane.

22. A hybrid enclosure, comprising:
a cover coupled with a frame and at least one stile that functions to confine a space;
the stile has an axial length that varies longitudinally during operation;
the frame includes:
a sill;
a header;
a first jamb and a second jamb coupled between the sill and the header at a respective first and second distal ends of the sill and the header; and
wherein: the cover has an upper and lower sides coupled respectively with header and sill, and a first and a second lateral ends coupled with one of the respective first jamb or second jamb, and at least one stile;
a track of the sill has a substantially circular cross-sectional profile that extends longitudinally along a length of the track and enables a set of concaved wheels to roll on the track and rotate about an axial length of the substantially circular track while moving transversally across the sill, with a first concaved wheel and a second concaved wheel of the set of concaved wheels substantially oriented opposite, across the substantially circular track.

23. The hybrid enclosure as set forth in claim 22, wherein:
the wheels are comprised of a ride surface that is concaved with lateral projections that hug the sill track profile, thereby preventing the wheels from disengaging the track.

24. The hybrid enclosure as set forth in claim 22, wherein:
the track of the sill further include a second channel that extends longitudinally along the length of the track and enables a posturing mechanism to slide within the track while moving transversally across the sill.

25. A cover, comprising:
an upper end with a first set of holes;
a lower end with a second set of holes;
a first lateral end; and
a second lateral end;
the upper and lower ends further including respective first and second horizontal reinforcement elements comprised of horizontally oriented stiffeners that add reinforcement, horizontally across upper and lower end of the cover to provide horizontally spanning rounded pleading horizontally across the cover;
the first and second lateral ends further include respective integral first and second lateral reinforcement elements comprised of interlock ends having cross-sectional profiles that extend longitudinally along a length of first and second lateral ends of cover, and mate and interlock with a mating structure.

26. A stile, comprising:
an upper portion associated with a header
a lower portion associated with a sill; and
having a longitudinal axis that is maintained substantially perpendicular in relation to a longitudinal axis of the sill using an L-shaped beam associated with stile and sill;
a track of the sill has a substantially circular cross-sectional profile that extends longitudinally along a length of the track that enables a set of concave wheels to roll on the track and rotate about an axial length of the substantially circular track while in motion across the sill, with a first concaved wheel and a second concaved wheel of the set of concaved wheels substantially oriented opposite, across the substantially circular track.

27. A hybrid enclosure, comprising:
a cover coupled with a frame and at least one stile that functions to confine a space;
the stile has an axial length that varies longitudinally during operation;
the frame includes:
a sill;
a header;

a first jamb and a second jamb coupled between the sill and the header at a respective first and second distal ends of the sill and the header; and wherein: the cover has an upper and lower sides coupled respectively with header and sill, and a first and a second lateral ends coupled with one of the respective first jamb or second jamb, and at least one stile;

the header is curved, extending beyond a contour of a first structure;

the stile includes an extension element that moves longitudinally along the axial length of the stile to vary a reach of the stile in relation to the header and the sill as the stile moves along a reciprocating path, thereby varying the axial length of the stile to enable articulation of the stile along the curved header, and one of a straight, curved, and the combination of straight and curved configuration sill;

an angle between a longitudinal axis of the stile and a horizontal plane of the first structure varies, while the longitudinal axis of the stile remains substantially perpendicular to a longitudinal axis of the header and sill;

the longitudinal axis of the stile is maintained substantially perpendicular in relation to the longitudinal axis of the sill by a L-shaped beam;

the L-shaped beam has an integral span section that is coupled with a sill track, and an integral support section substantially perpendicular the span section that is coupled with the stile;

the integral support section is housed within the stile at a bottom distal end of the stile, inserted along the axial length of the stile to maintain and support a weight of the stile; and an axial length of the span section is oriented parallel the axial length of the sill, and coupled with the sill track by a connection module having a set of wheels that ride along the sill track.

* * * * *